US008170445B2

(12) United States Patent
Kanno et al.

(10) Patent No.: US 8,170,445 B2
(45) Date of Patent: May 1, 2012

(54) PROCESS CARTRIDGE AND ELECTROPHOTOGRAPHIC IMAGE FORMING APPARATUS

(75) Inventors: Kazuhiko Kanno, Odawara (JP); Yasufumi Yoshino, Numazu (JP); Katsuhiko Oba, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 12/985,751

(22) Filed: Jan. 6, 2011

(65) Prior Publication Data

US 2011/0103829 A1 May 5, 2011

Related U.S. Application Data

(62) Division of application No. 12/196,701, filed on Aug. 22, 2008, now Pat. No. 8,059,988.

(30) Foreign Application Priority Data

May 27, 2008 (JP) ..... 2008-138045

(51) Int. Cl.
*G03G 21/16* (2006.01)
*G03G 21/18* (2006.01)

(52) U.S. Cl. ..... 399/111; 399/113

(58) Field of Classification Search ..... 399/110, 399/111, 112, 113, 167
See application file for complete search history.

(56) References Cited

U.S. PATENT DOCUMENTS 5,768,658 A 6/1998 Watanabe et al.
5,815,644 A 9/1998 Nishiuwatoko et al.
5,870,655 A 2/1999 Nishiuwatoko et al.
5,893,006 A 4/1999 Kanno et al.
5,926,666 A 7/1999 Miura et al.
5,937,240 A 8/1999 Kanno et al.
5,940,657 A 8/1999 Yokomori et al.
5,950,049 A 9/1999 Yokomori et al.
6,070,029 A 5/2000 Nishiuwatoko et al.
6,072,969 A 6/2000 Yokomori et al.
6,101,349 A * 8/2000 Ohashi et al. ..... 399/110

(Continued)

FOREIGN PATENT DOCUMENTS

JP 2005-266781 9/2005

(Continued)

OTHER PUBLICATIONS

Office Action in Japanese Patent Application No. 2008-138045, dated Apr. 8, 2010.

(Continued)

*Primary Examiner* — Sandra Brase
(74) *Attorney, Agent, or Firm* — Fitzpatrick, Cella, Harper & Scinto

(57) ABSTRACT

A process cartridge is detachably mountable to a main assembly of an electrophotographic image forming apparatus. The cartridge includes an electrophotographic photosensitive drum, a drum unit supporting the drum, a developing unit supporting a developing roller and swingably coupled with the drum unit, drum and developing roller rotating force receiving portions first and second positionable portions positioned at first and second main assembly side positioning portion by contacting to the first main assembly side positioning portions by contacting by the urging force of first and second main assembly side urging members, a developing device spacing force receiving portion, first and second cartridge side rotation regulating portions for limiting rotation of the drum unit by abutting first and second main assembly side rotation regulating portions, when the drum and developing roller rotating force receiving portions receive the rotating forces or when the developing device spacing force receiving portion receives the urging force from the main assembly.

14 Claims, 26 Drawing Sheets

U.S. PATENT DOCUMENTS

| | | | |
|---|---|---|---|
| 6,345,164 | B1 | 2/2002 | Yokomori et al. |
| 6,381,430 | B1 | 4/2002 | Yokomori et al. |
| 6,496,667 | B2 | 12/2002 | Shiratori et al. |
| 6,516,168 | B2 | 2/2003 | Shiratori et al. |
| 6,560,422 | B2 | 5/2003 | Kanno et al. |
| 6,681,088 | B2 | 1/2004 | Kanno et al. |
| 6,735,403 | B2 | 5/2004 | Kanno et al. |
| 6,782,219 | B2 | 8/2004 | Yoshino et al. |
| 6,834,173 | B2 | 12/2004 | Yamaguchi et al. |
| 6,915,092 | B2 | 7/2005 | Yamaguchi et al. |
| 6,937,834 | B2 | 8/2005 | Kanno et al. |
| 6,947,687 | B2 | 9/2005 | Yamaguchi et al. |
| 6,961,528 | B2 | 11/2005 | Yamaguchi et al. |
| 6,980,758 | B2 | 12/2005 | Murayama et al. |
| 6,980,759 | B2 | 12/2005 | Kanno et al. |
| 6,983,115 | B2 | 1/2006 | Isobe et al. |
| 7,058,337 | B2 | 6/2006 | Hashimoto et al. |
| 7,068,965 | B2 | 6/2006 | Yoshino et al. |
| 7,116,925 | B2 | 10/2006 | Yamaguchi |
| 7,155,137 | B2 | 12/2006 | Yasui et al. |
| 7,162,174 | B2 | 1/2007 | Suzuki et al. |
| 7,184,686 | B2 | 2/2007 | Kanno et al. |
| 7,292,808 | B2 | 11/2007 | Murofushi |
| 2007/0071495 | A1 | 3/2007 | Hashimoto et al. |
| 2007/0160388 | A1 | 7/2007 | Yoshimura et al. |
| 2007/0206971 | A1 | 9/2007 | Yoshino |
| 2008/0138105 | A1 | 6/2008 | Kanno et al. |
| 2008/0138106 | A1 | 6/2008 | Kanno et al. |
| 2008/0138110 | A1 | 6/2008 | Yoshino et al. |

FOREIGN PATENT DOCUMENTS

| | | |
|---|---|---|
| JP | 2007-213025 | 8/2007 |

OTHER PUBLICATIONS

Translation of Office Action in Japanese Patent Application No. 2008-138045, dated Apr. 13, 2010.

* cited by examiner (a)

(b)

PROCESS CARTRIDGE AND ELECTROPHOTOGRAPHIC IMAGE FORMING APPARATUS

This is a divisional of co-pending U.S. patent application Ser. No. 12/196,701, filed Aug. 22, 2008.

FIELD OF THE INVENTION AND RELATED ART

The present invention relates to a process cartridge, and an image forming apparatus which employs a process cartridge.

Here, the term "electrophotographic image forming apparatus" means an apparatus which forms an image on a recording medium with the use of an electrophotographic image forming method. As the examples of an electrophotographic image forming apparatus, an electrophotographic copying machine, an electrophotographic printer (for example, a laser beam printer, a LED printer, etc.), a facsimile machine, a word processor, etc., may be included.

The term "process cartridge" means a cartridge in which an electrophotographic photosensitive drum, and processing means, more specifically, a charging means, a developing means or cleaning means, are integrally disposed, and which is removably mountable in the main assembly of an electrophotographic image forming apparatus. It also means a cartridge in which an electrophotographic photosensitive drum, and at least one processing means, more specifically, at least one among a charging means, a developing means, and a cleaning means, are integrally disposed, and which is removably mountable in the main assembly of an electrophotographic image forming apparatus. Further, it means a cartridge in which an electrophotographic photosensitive drum, and at least one processing means, more specifically, a developing apparatus, are integrally disposed, and which is removably mountable in the main assembly of an electrophotographic image forming apparatus.

In the field of an electrophotographic image forming apparatus which uses an electrophotographic process, it has been a common practice to employ a process cartridge system, that is, a system that places an electrophotographic photosensitive drum, and one or more processing means for processing an electrophotographic photosensitive drum, in a cartridge which is removably mountable in the main assembly of an electrophotographic image forming apparatus. A process cartridge system makes it possible for a user to perform some of the ordinary maintenance operations by himself (herself), that is, without relying on a service person. Thus, the employment of a process cartridge system can significantly improve an electrophotographic image forming apparatus in operational efficiency. Therefore, a process cartridge system is widely in use in the field of an electrophotographic image forming apparatus.

Roughly describing, the image forming operation of an electrophotographic image forming apparatus is as follows: A beam of light emitted from a laser, an LED, an ordinary light source, etc., is projected upon an electrophotographic photosensitive drum, while being modulated according to the information regarding an image to be formed. As the beam of light is projected upon the electrophotographic photosensitive drum, an electrostatic latent image is formed on the photosensitive drum. This electrostatic latent image is developed by a developing apparatus. Then, the developed electrostatic latent image on the photosensitive drum is transferred onto a recording medium, yielding a print (copy), that is, recording medium having an intended image.

As one of the structural designs for accurately positioning a process cartridge, such as the one described above, relative to the main assembly of an electrophotographic image forming apparatus, the following one has been known. That is, each of the left and right lateral plates located in the main assembly of the image forming apparatus is provided with a groove (recess) for positioning a photosensitive drum. Further, the main assembly of the image forming apparatus is provided with a pair of springs, which are located at the left and right ends of the main assembly, one for one, to keep a pair of bearings, with which the lengthwise ends of the photosensitive drum were provided, pressed upon the surfaces of the groove (recess) of the corresponding lateral plate. With the pair of bearings kept pressed upon the lateral plates, one for one, the cartridge is kept accurately positioned relative to the main assembly of the image forming apparatus. Further, as a cartridge is inserted into the main assembly of the image forming apparatus, the projection with which each of the abovementioned springs is provided comes into contact with the corresponding bearing, being thereby rotated by the pressure applied by the process cartridge. Then, as soon as the bearing rides over the projection, the projection presses the bearing upon the surfaces of the abovementioned groove (recess). Further, the regulating portion with which the drum unit of a cartridge is provided engages with the counterpart with which the main assembly of the image forming apparatus is provided, thereby preventing the photosensitive member unit from moving further. Further, the process cartridge is pressed upward (U.S. Pat. No. 6,681,088).

It has been desired that even in the case of the combination of a process cartridge and an electrophotographic image forming apparatus, such as the one described above, the cartridge is positioned relative to the main assembly of the image forming apparatus just as accurately as a process cartridge in accordance with the prior art is positioned relative to the main assembly of an image forming apparatus in accordance with the prior art.

SUMMARY OF THE INVENTION

The primary object of the present invention is to provide a process cartridge which is designed to be accurately positioned relative to the main assembly of an image forming apparatus by being pressed upward in the main assembly, and yet, can be reliably positioned relative to the main assembly, and an electrophotographic image forming apparatus compatible with the process cartridge.

Another object of the present invention is to provide a process cartridge which is designed to be accurately positioned relative to the main assembly of an image forming apparatus by being pressed upward in the main assembly, and yet, is significantly higher in the level of accuracy with which a process cartridge is positioned relative to the main assembly of an image forming apparatus, than a process cartridge in accordance with the prior art, and also, to provide an electrophotographic image forming apparatus compatible with the process cartridge.

Another object of the present invention is to provide a process cartridge which can be reliably positioned relative to the main assembly of an image forming apparatus even when it is receiving the rotational force for rotating its development roller and photosensitive drum from the main assembly, and also, to provide an electrophotographic image forming apparatus compatible with the process cartridge.

Another object of the present invention is to provide a process cartridge which can be reliably positioned relative to the main assembly of an image forming apparatus even when it is receiving the force for separating its development roller from its photosensitive drum from the main assembly, and also, to provide an electrophotographic image forming apparatus compatible with the process cartridge.

Another object of the present invention is related to a process cartridge which is designed to be accurately positioned relative to the main assembly of an image forming apparatus by being pressed upward in the main assembly, and is to provide a process cartridge which can be reliably positioned relative to the main assembly even when it is receiving the rotational force for rotating its development roller and photosensitive drum from the main assembly, and an electrophotographic image forming apparatus compatible with the cartridge.

Another object of the present invention is also related to a process cartridge which is designed to be accurately positioned relative to the main assembly of an image forming apparatus by being pressed upward in the main assembly, and is to provide a process cartridge which can be reliably positioned relative to the main assembly even when it is receiving the force for separating its development roller from its photosensitive drum from the main assembly, and an electrophotographic image forming apparatus compatible with the cartridge.

Another object of the present invention is also related to a process cartridge which is designed to be accurately positioned relative to the main assembly of an image forming apparatus by being pressed upward in the main assembly, and is to provide a process cartridge which can be accurately positioned relative to the main assembly even when it is receiving the rotational force for rotating its development roller and photosensitive drum from the main assembly, and an electrophotographic image forming apparatus compatible with the cartridge.

According to an aspect of the present invention, there is provided a process cartridge detachably mountable to a main assembly of an electrophotographic image forming apparatus. The apparatus includes a first main assembly side positioning portion, a second main assembly side positioning portion, a first main assembly side urging member for upward urging, a second main assembly side urging member for upward urging, a first main assembly side rotation regulating portion, a second main assembly side rotation regulating portion, a drum rotating force applying portion, a developing roller rotating force applying portion, and a developing device spacing force applying portion. The process cartridge comprises: an electrophotographic photosensitive drum; a drum unit supporting the electrophotographic photosensitive drum; and a developing unit supporting a developing roller for developing an electrostatic latent image formed on the electrophotographic photosensitive drum while being in contact with the electrophotographic photosensitive drum. The developing unit is swingably coupled with the drum unit. The cartridge also comprises a drum rotating force receiving portion for receiving a rotating force for rotating the electrophotographic photosensitive drum from the drum rotating force applying portion in a state in which the process cartridge is mounted to the main assembly. The drum rotating force receiving portion is provided at a leading end of the drum unit with respect to a mounting direction in which the process cartridge is mounted to the main assembly. The cartridge also comprises a developing roller rotating force receiving portion for receiving a rotating force for rotating the developing roller from the developing roller rotating force applying portion in a state in which the process cartridge is mounted to the main assembly. The developing roller rotating force receiving portion is provided at a leading end of the developing unit with respect to the mounting direction. The cartridge further comprises a first cartridge side portion-to-be-positioned for being positioned at the first main assembly side positioning portion by contacting to first main assembly side positioning portion by an urging force of the first main assembly side urging member in the state. The first cartridge side portion-to-be-positioned is provided on a downstream side of the drum unit with respect to the mounting direction. The cartridge also comprises a second cartridge side portion-to-be-positioned for being positioned at the second main assembly side positioning portion by contacting the second main assembly side positioning portion by an urging force of the second main assembly side urging member in the state. The second cartridge side portion-to-be-positioned is provided on an upstream side of the drum unit with respect to the mounting direction. The cartridge also comprises a developing device spacing force receiving portion, provided on the developing unit, for receiving an urging force for spacing the developing roller from the electrophotographic photosensitive drum from the developing device spacing force applying portion in the state. In addition, the cartridge includes a first cartridge side rotation regulating portion for limiting rotation of the drum unit by abutting the first main assembly side rotation regulating portion in the state, when the drum rotating force receiving portion and the developing roller rotating force receiving portion receive the rotating forces from the main assembly or when the developing device spacing force receiving portion receives the urging force from the main assembly. The first cartridge side rotation regulating portion is provided on a downstream side of the drum unit with respect to the mounting direction. Further, the cartridge comprises a second cartridge side rotation regulating portion for limiting rotation of the drum unit by abutting the second main assembly side rotation regulating portion in the state, when the drum rotating force receiving portion and the developing roller rotating force receiving portion receive the rotating forces from the main assembly or when the developing device spacing force receiving portion receives the urging force from the main assembly. The second cartridge side rotation regulating portion is provided on an upstream side of the drum unit with respect to the mounting direction.

The present invention ensures that even a process cartridge designed to be positioned relative to the main assembly of an image forming apparatus by being pressed upward in the main assembly is accurately positioned relative to the main assembly.

The present invention improves a process cartridge designed to be positioned relative to the main assembly of an image forming apparatus by being pressed upward in the main assembly, in terms of the level of accuracy with which a process cartridge is positioned relative to the main assembly of an image forming apparatus.

According to the present invention, a process cartridge can be reliably positioned relative to the main assembly of an image forming apparatus even when the cartridge is receiving the force for rotating its development roller and photosensitive drum from the main assembly while the process cartridge is in the main assembly.

According to the present invention, a process cartridge can be reliably positioned relative to the main assembly even when the cartridge is receiving the force for separating its development roller from its photosensitive drum from the main assembly while the process cartridge is in the main assembly.

According to the present invention, even a process cartridge designed to be accurately positioned relative to the main assembly of an image forming apparatus by being pressed upward in the main assembly can be reliably positioned relative to the main assembly even when the cartridge is receiving the force for rotating its development roller and photosensitive drum, from the main assembly while the process cartridge is in the main assembly.

According to the present invention, even a process cartridge designed to be accurately positioned relative to the main assembly of an image forming apparatus by being pressed upward in the main assembly can be reliably positioned relative to the main assembly even when the cartridge is receiving the force for separating its development roller from its photosensitive drum, from the main assembly while the process cartridge is in the main assembly.

According to the present invention, even a process cartridge designed to be accurately positioned relative to the main assembly of an image forming apparatus by being pressed upward in the main assembly can be accurately positioned relative to the main assembly even when the cartridge is receiving the force for rotating its development roller and photosensitive drum, from the main assembly while the process cartridge is in the main assembly.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

Hereinafter, the process cartridge (which hereafter will be referred to simply as a cartridge) and electrophotographic color image forming apparatus (which hereafter will be referred to simply as an image forming apparatus), in the first embodiment of the present invention will be described with reference to the appended drawings.

(General Structure of Image Forming Apparatus)

Figure 1:
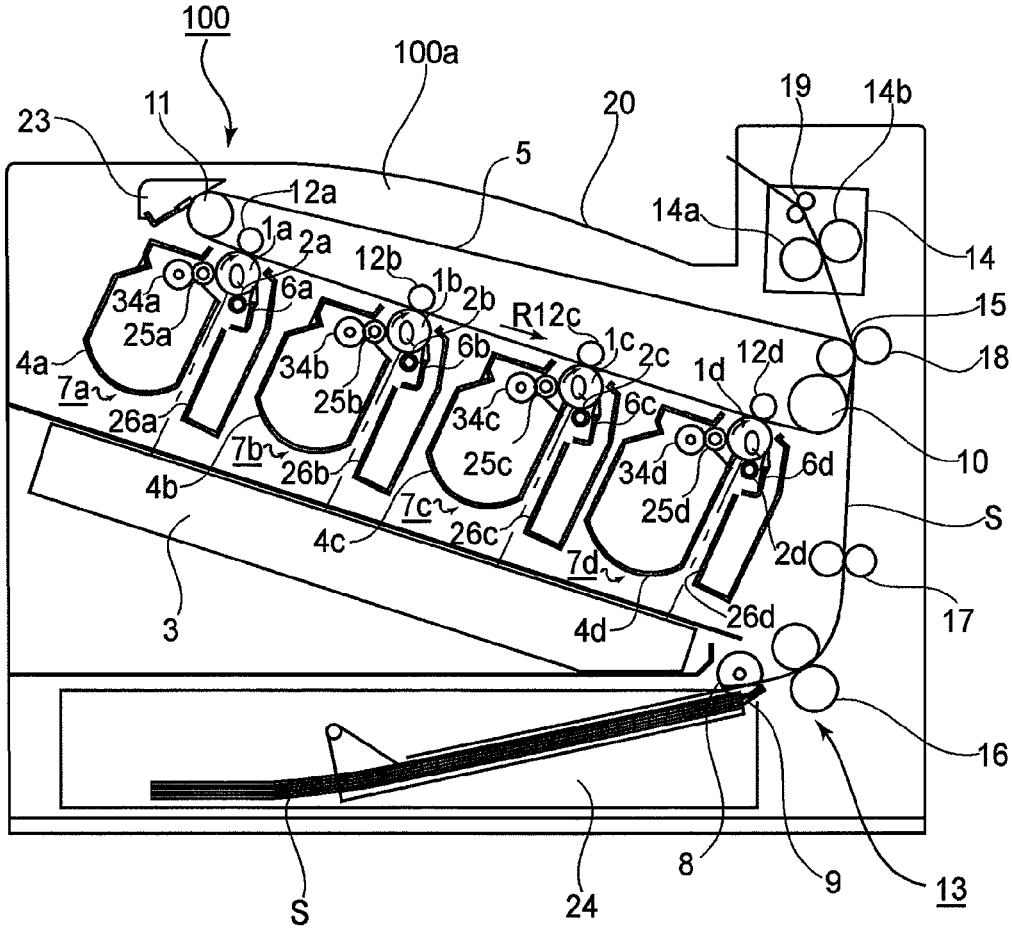
FIG. 1 is a schematic drawing of the electrophotographic color image forming apparatus in the first embodiment of the present invention, showing the general structure of the apparatus.

First, referring to FIG. 1, the general structure of the image forming apparatus will be described. The image forming apparatus 100 shown in FIG. 1 has four cartridge compartments (22*a*-22*d*) (FIG. 3), into which four cartridges are mounted, one for one. The four cartridge compartments (22*a*-22*d*) are juxtaposed in tandem, in a straight line which is slanted relative to the horizontal direction. The cartridges 7 (7*a*-7*d*), which are to be mounted into the four cartridge compartments (22*a*-22*d*), one for one, are provided with electrophotographic photosensitive members 1 (1*a*, 1*b*, 1*c*, and 1*d*), respectively; each cartridge 7 is provided with a single photosensitive drum 1.

The abovementioned electrophotographic photosensitive drum 1 (which hereafter will be referred to as a photosensitive drum 1) is rotationally driven in the clockwise direction of the drawing by a driving member (unshown). Each process cartridge 7 is provided with multiple processing means, more specifically, a cleaning member 6 (6*a*, 6*b*, 6*c*, or 6*d*) and a charge roller 2 (2*a*, 2*b*, 2*c*, or 2*d*), which process the photosensitive drum 1. The processing means are arranged in the adjacencies of the peripheral surface of the photosensitive drum 1 in the same order as the order in which they are listed above. The cleaning member 6 cleans the developer (which here after may be referred to as developer) remaining on the peripheral surface of the photosensitive drum 1 after the image transfer from the photosensitive drum 1. The charge roller 2 uniformly charges the peripheral surface of the photosensitive drum 1. The process cartridge 7 is also provided with a development unit 4 (4*a*, 4*b*, 4*c*, or 4*d*) which develops the abovementioned electrostatic latent image with the use of toner. Also arranged in the adjacencies of the peripheral surface of the photosensitive drum 1 are a scanner unit 3, and an intermediary transfer belt 5. The scanner unit 3 forms an electrostatic latent image on the peripheral surface of the photosensitive drum 1 by projecting a beam of laser light upon the peripheral surface of the photosensitive drum 1 while modulating the laser beam according to the information regarding the image to be formed. The intermediary transfer belt 5 is a belt onto which four toner images, different in color, formed on the photosensitive drums 1 are sequentially transferred in layers. The photosensitive drum 1, the cleaning member 6, and the charge roller 2 are integrated as a drum unit 26. The drum unit 26 and the development unit 4 are joined, making up a process cartridge 7 (which hereafter will be referred to simply as cartridge 7), which is removably mountable in the main assembly 100*a* of the image forming apparatus 100 by a user.

The intermediary transfer belt 5 is stretched around a driver roller 10 and a tension roller 11, being thereby suspended by the two rollers 10 and 11. There are four primary transfer rollers 12 (12*a*-12*d*), which are inside the loop which the intermediary transfer belt 5 forms. The primary transfer rollers 12*a*-12*d* are positioned so that they oppose the photosensitive drums 1*a*-1*d*, with the intermediary transfer belt 5 sandwiched between the primary transfer rollers 12*a*-12*d* and photosensitive drums 1*a*-1*d*, respectively. To the transfer belt 5, a transfer bias is applied by a bias applying means (unshown).

As a toner image is formed on the peripheral surface of the photosensitive drum 1, which is being moved in the direction indicated by an arrow mark Q, it is transferred (primary transfer), by applying a positive bias to the primary transfer roller 12, onto the intermediary transfer belt 5, which is being circularly moved in the direction indicated by an arrow mark R. The same image forming operations, except for the toner used by the developing unit, are sequentially carried out in the four process cartridges. As a result, four toner images, different in color, are deposited in layers on the intermediary transfer belt 5, and are conveyed to the secondary transfer portion 15.

In synchronism with the abovementioned image forming operation carried out in each process cartridge, a sheet of a recording medium S (which hereafter will be referred to simply as a recording medium S) is fed into, and conveyed in, the apparatus main assembly 100*a* by a recording medium conveying means made up of a sheet feeding apparatus 13, a pair of registration rollers 17, etc. The sheet feeding apparatus 13 has a sheet feeder cassette 24, a sheet feeding and conveying roller 8, and a pair of sheet conveyance rollers 16. The sheet feeder cassette 24 stores multiple sheets of the recording medium S. The sheet feeding and conveying roller 8 feeds a sheet of the recording medium S into the apparatus main assembly 100*a*, and conveys the recording medium S in the apparatus main assembly 100*a*, or feeds in succession multiple recording media S into the apparatus main assembly 100*a*, and conveys the recording media S in the apparatus main assembly 100*a*. The sheet feeder cassette 24 can be pulled out of the apparatus main assembly 100*a* in the frontward direction. As a recording medium S is fed into the apparatus main assembly 100*a* by the sheet feeding and conveying roller 8, it is pressed upon the roller 8 by a separation pad 9. Thus, if two or more recording media S are pulled out together from the sheet feeder cassette 24, only the recording medium which is in contact with the roller 8 is conveyed into the apparatus main assembly 100*a* while being separated from the rest by the combination of the roller 8 and pad 9 (one-sided sheet separating method based on friction).

As the sheet S is conveyed inward of the apparatus main assembly 100*a* by the sheet feeding apparatus 13, it is conveyed to the secondary transfer portion 15 by the pair of registration rollers 17. In the secondary transfer portion 15, the positive bias is applied to the secondary transfer roller 18. As a result, the four toner images, different in color, on the intermediary transfer belt 5 are transferred together (secondary transfer) onto the sheet S which is being conveyed through the secondary transfer portion 15.

A fixing portion 14, is a fixing means of the apparatus main assembly. It is a portion of the apparatus main assembly 100*a* which fixes the toner images on the sheet S, and onto the sheet S by applying heat and pressure to the sheet S and toner images thereon. A fixation belt 14*a* is cylindrical. It is guided by a belt guiding member (unshown) provided with a heat generating means, such as a heater, which is bonded to the belt guiding member. The fixation belt 14*a* is kept pressed upon the pressure roller 14*b*, forming a fixation nip, so that a preset amount of contact pressure is maintained between the fixation belt 14*a* and pressure roller 14*b*.

After the unfixed toner images are sequentially transferred onto the sheet S through the four image forming portions, the sheet S is conveyed to the fixing portion 14, and is conveyed through the fixation nip, that is, the interface between the fixation belt 14*a* and pressure roller 14*b*, while being subjected heat and pressure. As a result, the unfixed toner images on the sheet S become fixed to the sheet S. After the fixation of the toner images to the sheet S, the sheet S is discharged into a delivery tray 20 by a pair of discharge rollers 19.

The toner remaining on the peripheral surface of the photosensitive drum 1 after the toner image transfer is removed by the cleaning member 6. The removed toner is recovered into the removed toner chamber in the photosensitive member unit 26 (26*a*-26*d*).

The toner remaining on the intermediary transfer belt 5 after the second transfer, that is, the transfer of the toner images onto the sheet S from the intermediary transfer belt 5, is removed by a transfer belt cleaning apparatus 23. The removed toner is conveyed through a waste toner conveyance passage (unshown), and is recovered into a waste toner recovery bin (unshown) located in the rear end portion of the apparatus main assembly 100*a*.

(Cartridge)

Figure 2:
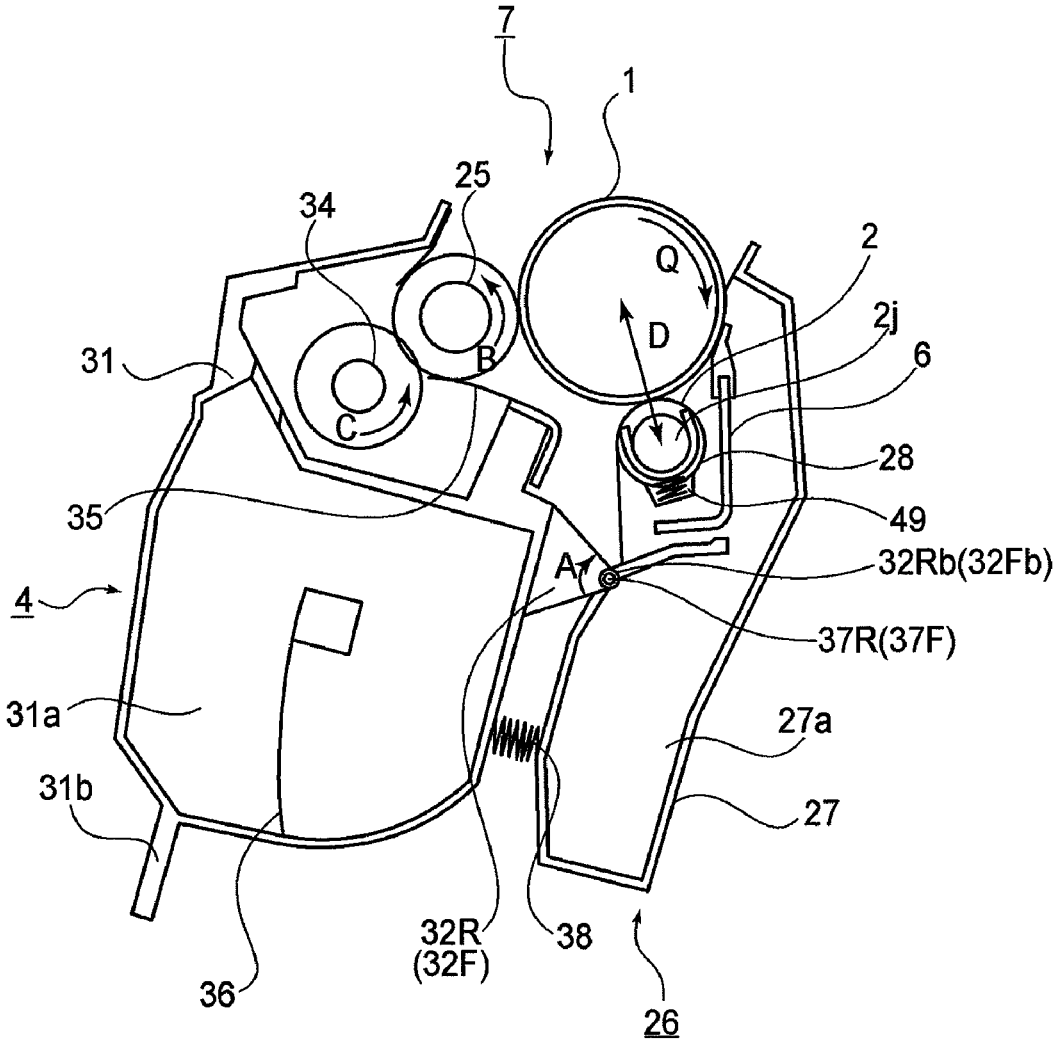
FIG. 2 is a sectional view of the cartridge in the first embodiment of the present invention.

Next, referring to FIG. 2, the cartridge in this embodiment will be described. FIG. 2 is a sectional view of the cartridge 7 in the first embodiment, at a plane parallel to the front panel of the image forming apparatus 100. There is a toner t in the cartridge 7. Incidentally, the cartridges 7*a*, 7*b*, 7*c*, and 7*d*, which correspond to yellow, magenta, cyan, and black toners t, respectively, are the same in structure.

Each cartridge 7 is made up of a drum unit 26 and a development unit 4. The drum unit 26 has the photosensitive drum 1, a charge roller 2 (charging means), and a cleaning member 6 (cleaning means). The development unit 4 has a development roller 25 (developing means). The photosensitive drum 1 is rotatably supported by the frame 27 of the drum unit 26, with a pair of bearings interposed between the drum unit frame 27 and photosensitive drum 1. The bearings will be described later. The photosensitive drum 1 is rotationally driven in synchronism with the progression of an image forming operation, by the driving force transmitted from a motor (unshown) to the drum unit 26.

The charge roller 2 and the cleaning member 6 are positioned in the adjacencies of the peripheral surface of the photosensitive drum 1 as described previously. As the residual toner, that is, the toner remaining on the peripheral surface of the photosensitive drums 1, is removed by the cleaning member 6, it falls into the toner chamber 27*a* for the removed residual toner. The drum unit frame 27 is fitted with a pair of charge roller bearings 28, which are movable in the direction indicated by an arrow mark D, which coincides with the axial line of the photosensitive drum 1 and the axial line of the charge roller 2. The axle 2*j* of the charge roller 2 is rotatably supported by the pair of charge roller bearings 28. Further, the bearings 28 are kept pressed toward the photosensitive drum 1 by a pair of charge roller pressing members 49.

The development unit 4 has the development roller 25 and a development unit frame 31. The development roller 25 rotates in contact with the photosensitive drum 1, in the direction indicated by an arrow mark B. The end walls of the development unit frame 31, in terms of the lengthwise direction of the cartridge 7, are fitted with a pair of development roller bearing members (32R and 32F), one for one. The development roller 25 is rotatably supported by the development unit frame 31 (bearings members 32R, 32F). The development unit 4 is also provided with a toner supply roller 34 and a development blade 35, which are positioned in the adjacencies of the peripheral surface of the development roller 25. The toner supply roller 34 rotates in contact with the development roller 25 in the direction indicated by an arrow mark C. The development blade 35 is for regulating in thickness the toner layer on the development roller 25. Further, the development unit 4 is provided with a toner conveying member 36, which is in the toner storage portion 31*a* of the development unit frame 31, and conveys the toner in the toner storage portion 31*a* to the toner supply roller 34 while stirring the toner.

The development roller bearing members 32R and 32F (which hereafter will be referred to simply as bearing members 32R and 32F) of the development unit 4 are provided with holes 32Rb and 32Fb, respectively. The development unit 4 is connected to the photosensitive member unit 26, with a pair of shafts (connective pins) 37 (37R and 37F) fitted in the abovementioned holes 32Rb and 32Fb of the bearing members 32Rb and 32Fb, in such manner that the development unit 4 is rotationally movable about the shafts (connective pins) 37 in the direction indicated by an arrow mark A. The development unit 4 is kept pressured by a pair of compression springs 38. Thus, during an image forming operation, the development roller 25 is kept in contact with the photosensitive drum 1 by the compression springs 38.

(Structural Arrangement for Mounting Cartridge into Image Forming Apparatus Main Assembly)

Next, referring to FIG. 3, the portions of the apparatus main assembly, which make it possible to removably mount the cartridge 7 into the apparatus main assembly 100*a*, will be described.

Figure 3:
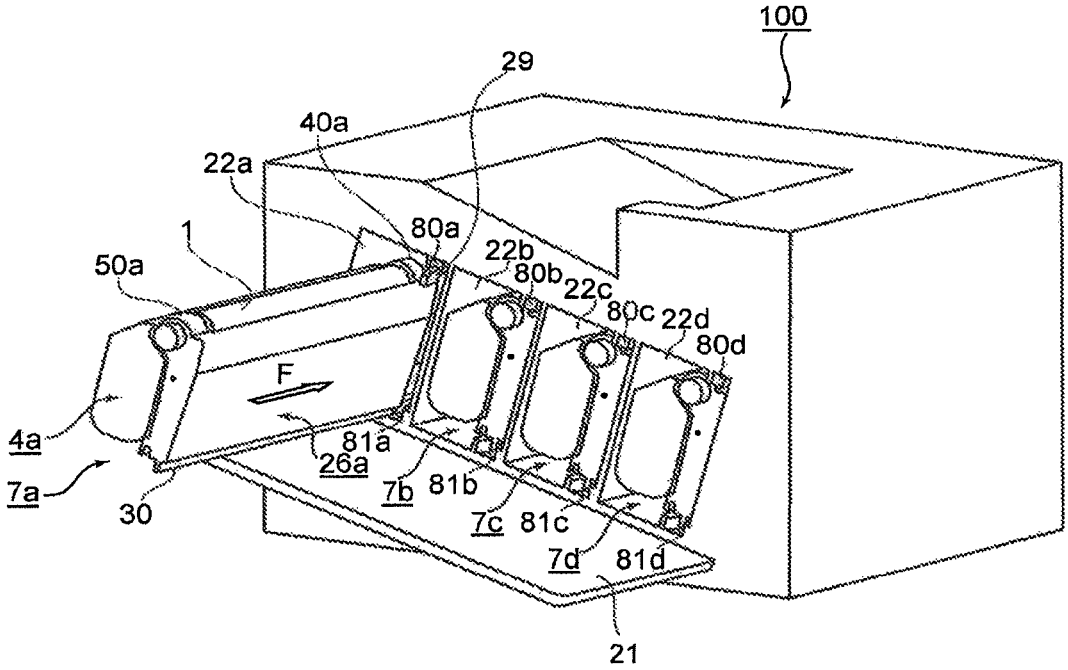
FIG. 3 is a perspective view of the image forming apparatus in the first embodiment, into which one of the cartridges therefore is about to be inserted.

FIG. 3 is a perspective view of the apparatus main assembly 100*a* when the cartridge 7*a* is about to be inserted into the apparatus main assembly 100*a*. Incidentally, the direction in which the cartridge 7 is mounted into the apparatus main assembly 100*a* in this embodiment is the direction indicated by an arrow mark F, which is parallel to the axial line of the photosensitive drum 1. That is, the apparatus main assembly 100*a* is structured so that the cartridge 7 is to be inserted from the front side of the apparatus main assembly 100*a*, in the front-to-rear direction in FIG. 1, and also, so that the cartridge 7 is removably mountable in the apparatus main assembly 100*a*.

Referring to FIG. 3, the apparatus main assembly 100*a* is provided with a front cover 21, which is attached to the front panel of the apparatus main assembly 100*a* and can rotatably opened frontward. As the front cover 21 is opened, the four cartridge compartments (22*a*-22*d*), which accommodate the four cartridges 7 (7*a*-7*d*), respectively, are exposed. The four cartridge compartments (22*a*-22*d*) are juxtaposed in tandem, in a straight line which is slanted relative to the horizontal direction. Each cartridge compartment (22*a*-22*d*) is provided with a first cartridge guide (80*a*-80*d*) and a second cartridge guide (81*a*-81*d*). The first and second cartridge guides 80*a*-80*d* and 81*a*-81*d* are at the top and bottom ends, respectively, of the compartment (22*a*-22*d*), and extend from the front end of the compartment 22 to the rear end of the compartment (22*a*-22*d*). Correspondingly, the cartridge 7 is provided with a cartridge guiding projection 29 (first portion of cartridge 7 by which cartridge is guided into or out of cartridge compartment (22*a*-22*d*)) and a cartridge guiding rib 30 (second portion of cartridge by which cartridge is guided into or out of cartridge compartment (22*a*-22*d*)). If it is necessary to mount the cartridge 7 into the cartridge compartment (22*a*-22*d*), the cartridge 7 is to be pushed in the direction indicated by the arrow mark F, with the cartridge guiding portions 29 and rib 30 of the cartridge 7 aligned with the first and second cartridge guides 80*a*-80*d* and 81*a*-81*d* of the cartridge compartment (22*a*-22*d*) (apparatus main assembly 100*a*).

In terms of the direction in which the cartridge 7 is inserted into the cartridge compartment (22*a*-22*d*), the abovementioned cartridge guiding first portion 29 (projection) of the cartridge 7 is at the leading end of the cartridge 7. In terms of the vertical direction, it is at the top of the cartridge 7. The cartridge guiding second portion 30 (rib) of the cartridge 7 is at the bottom of the cartridge 7, and extends from the leading end of the cartridge 7 to the trailing end.

As the cartridge 7 is inserted into the cartridge compartment (22*a*-22*d*) far enough for the leading end of the cartridge 7 to reach a preset point in the compartment (22*a*-22*d*), the main assembly contacting portions 40*a* and 50*a* of the cartridge 7, which are at the leading and trailing ends, respectively, of the cartridge 7, are positioned relative to the apparatus main assembly 100*a*, positioning thereby the cartridge 7 relative to the apparatus main assembly 100*a*. This ends the mounting of the cartridge 7.

Figure 4:
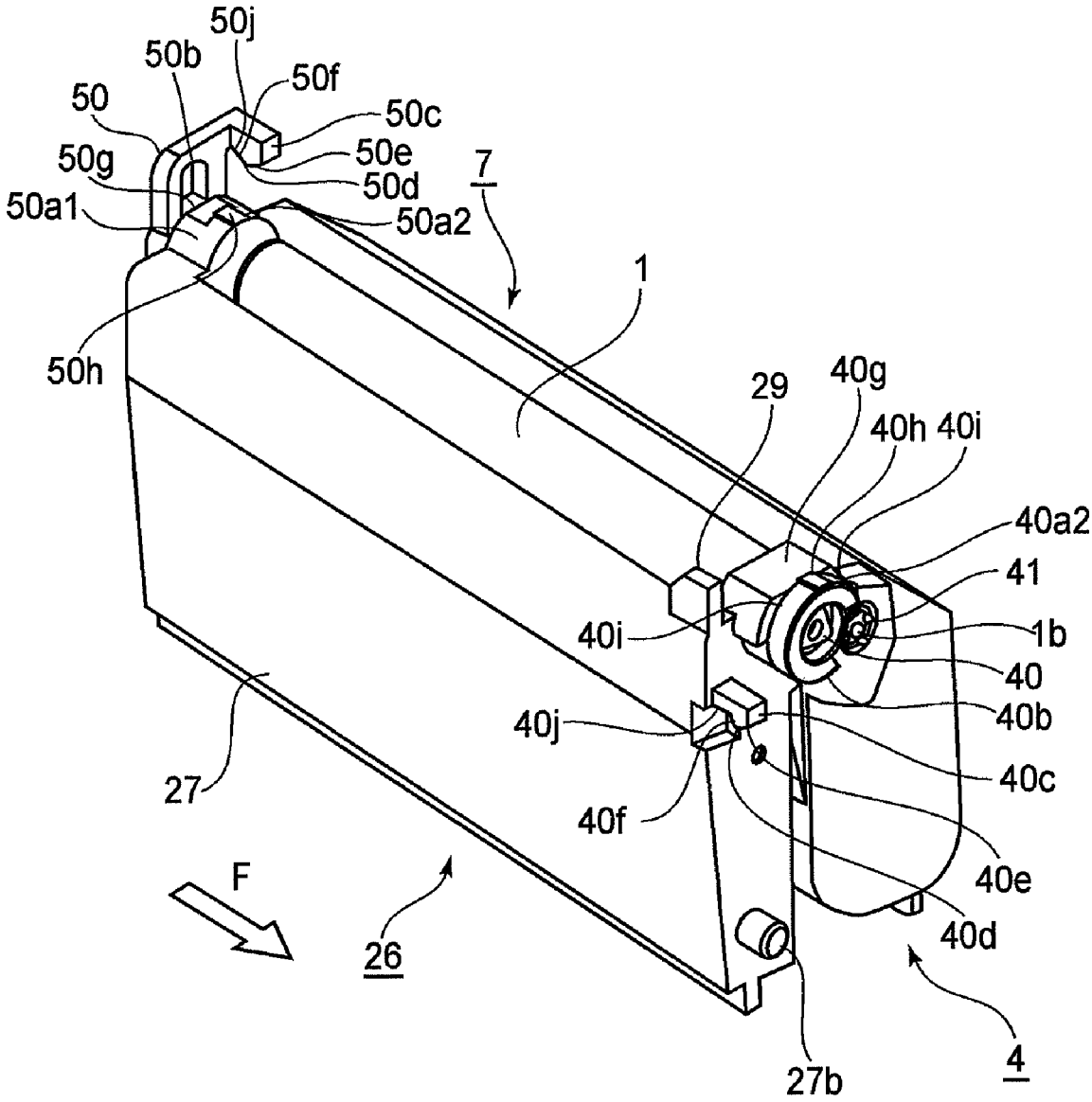
FIG. 4 is an external perspective view of one of the cartridges in the first embodiment of the present invention.
Figure 5:
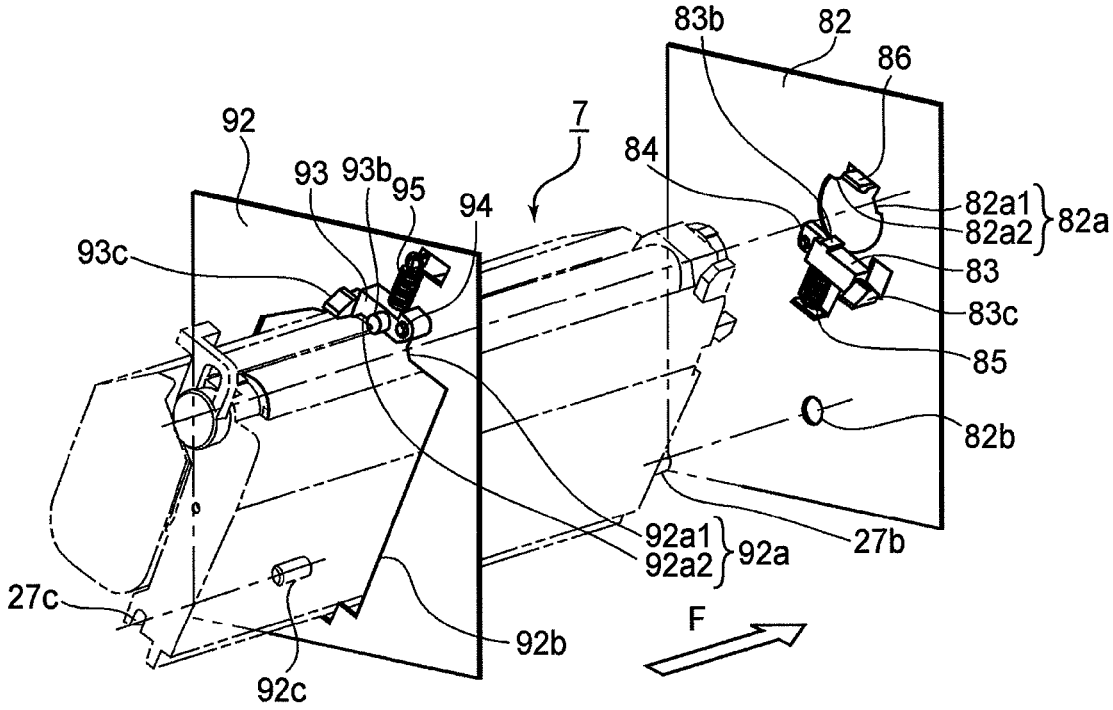
FIG. 5 is a schematic perspective view of the structural components, with which the main assembly of the image forming apparatus in the first embodiment is provided for positioning the process cartridge relative to the main assembly, and the pressing mechanism, with which the main assembly is provided for pressing the process cartridge.

As the rotational force for rotating the photosensitive drum 1, development roller 25, etc., in the cartridge 7 is transmitted to the cartridge 7, it tends to rotationally move the cartridge 7. Thus, in order to prevent the cartridge 7 from being rotationally moved by this force, the cartridge 7 is provided with a projection 27*b* (cartridge rotation regulating portion) (FIG. 4) and a groove 27*c* (FIGS. 15 and 16) (second cartridge rotation regulating portion). The projection 27*b* is on the outward surface of the leading end wall of the cartridge 7, in terms of the cartridge mounting direction F, and extends downstream in the direction parallel to the cartridge mounting direction F (cartridge advancement direction). The groove 27*c* is in the front end portion of the bottom surface of the cartridge 7. It is U-shaped in cross section. Further, the apparatus main assembly 100*a* is provided with a projection 92*c* (FIG. 5) and a hole 82*b* (cartridge rotation regulating first portion of apparatus main assembly 100*a*) (FIG. 5). The projection 92*c* is on the inward surface of the front wall of the apparatus main assembly 100*a*, and perpendicularly projects inward of the apparatus main assembly 100*a*. The hole 82*b* is a part of the rear wall of the apparatus main assembly 100*a* and is elongated in cross section. As the cartridge 7 is moved into the image forming position in the apparatus main assembly 100*a*, the projection 27*b* of the cartridge 7 fits into the hole 82*b* of the apparatus main assembly 100*a*, and the projection 92*c* of the apparatus main assembly 100*a* fits into the groove 27*c* of the cartridge 7.

How the cartridge 7 is prevented from rotationally moving as the driving force is transmitted to the cartridge 7, will be described later in detail.

As described above, the cartridge guiding projection 29 of the cartridge 7 is on the top surface of the cartridge 7, and is at the leading end, in terms of the direction in which the cartridge 7 is advanced in to the apparatus main assembly 100*a* when the cartridge 7 is mounted into the apparatus main assembly 100*a*. The cartridge guiding rib 30 of the cartridge 7 is on the bottom surface of the cartridge 7, and extends from leading end to the trailing end of the cartridge 7. Further, in terms of the direction perpendicular to the axial line of the photosensitive drum 1, the projection 29 and rib 30 are on the same side of the photosensitive drum 1.

Thus, the cartridge 7 remains stable while it is advanced into the apparatus main assembly 100*a*.

The portions of the cartridge 7, and the portions of the apparatus main assembly 100*a*, which are involved in the accurate positioning of the cartridge 7 relative to the apparatus main assembly 100*a*, will be described later in detail regarding their structure.

(Structural Arrangement for Positioning Cartridge Relative to Image Forming Apparatus Main Assembly, and Structural Arrangement for Keeping Cartridge Pressed)

Next, referring to FIGS. 4-7, and 14, the structural arrangement for accurately positioning the cartridge 7 relative to the apparatus main assembly 100*a*, and the structural arrangement for pressing the cartridge 7 upon the cartridge positioning portions of the apparatus main assembly 100*a* and keeping the cartridge pressed thereupon, will be described. FIG. 4 is an external perspective view of the cartridge 7, and FIG. 14 is a top plan view of the cartridge 7.

Referring to FIG. 4, which is an external perspective view of the cartridge 7, the photosensitive drum 1 which the cartridge 7 has is rotatably supported at the lengthwise ends of its rotational axle (unshown), by a pair of bearings 40 and 50, one for one, which are solidly attached to the front and rear walls of the drum unit frame 27, one for one.

Figure 14:
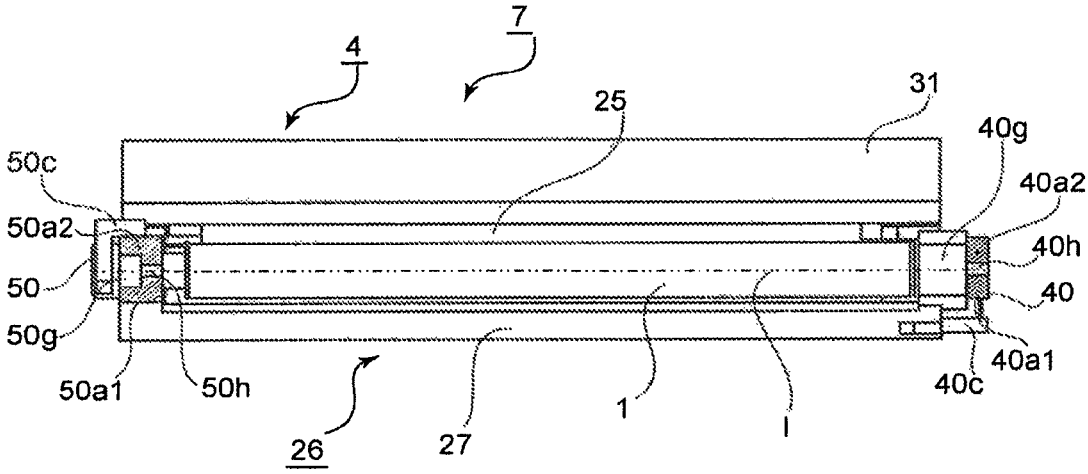
FIG. 14 is a top plan view of the cartridge in the first embodiment of the process cartridge.

Referring to FIGS. 4 and 14, the bearing 40 of the cartridge 7, which is at the rear end of the cartridge 7, that is, the leading end of the cartridge 7 in terms of the direction in which the cartridge 7 advances in the apparatus main assembly 100*a* when it is mounted into the apparatus main assembly 100*a*, has the main assembly contacting first portion 40*a* (which has portions 40*a*1 and 40*a*2), which is a part of the top surface of the bearing 40. More specifically the main assembly contacting first portion 40*a* (having portions 40*a*1 and 40*a*2), that is, the first portion of the bearing 40, which is for accurately positioning the rear side of the cartridge 7 relative to the apparatus main assembly 100*a*, is a part of the upwardly facing portion of the peripheral surface of the bearing 40 which is arcuate in cross section. The bearing 40 is the drum shaft bearing first member, and supports the photosensitive drum 1 at one of the lengthwise ends of the drum 1 in terms of the axial direction of the photosensitive drum 1. In terms of the cartridge advancement direction in the apparatus main assembly 100*a*, the bearing 40 is at the downstream end of the cartridge 7.

The bearing 40 is also provided with a bearing pressing member catching portion 40*b*, which is pressed by a bearing pressing member 83 (pressuring member, upwardly pushing member) (FIG. 5), which will be described later. The portion 40*b* of the bearing 40 is below the main assembly contacting portion 40*a*.

Incidentally, the abovementioned cartridge advancement direction means the direction in which the cartridge 7 advances into the apparatus main assembly 100*a* when a user mounts the cartridge 7 into the apparatus main assembly 100*a*. That is, the cartridge advancement direction is the same as the abovementioned cartridge mounting direction F.

The main assembly contacting portion 40*a* is made up of two portions, that is, the main assembly contacting portion 40*a*1 and main assembly contacting portion 40*a*2, which are on the one side of the axial line I of the photosensitive drum 1 and the other (FIG. 14), one for one. The axial line I is the axial line of the photosensitive drum 1, which is parallel to the lengthwise direction of the photosensitive drum 1. That is, the axial line I is parallel to the lengthwise direction of the cartridge 7. In other words, the cartridge 7 is provided with the main assembly contacting first portion 40*a*1 and main assembly contacting second portion 40*a*2, which are on one side of the axial line I and the other, respectively. Further, the main assembly contacting first and second portions 40*a*1 and 40*a*2 (which position the leading end of cartridge relative to apparatus main assembly 100*a*) oppose each other across the axial line I (FIG. 14).

The bearing pressing member catching portion 40*b* of the bearing 40 is on the downstream side of the photosensitive drum 1 in terms of the abovementioned cartridge advancement direction. As seen from the direction, (FIG. 9(*c*)), in which the bearing pressing member 83 (pressure applying first member, upwardly pressing member of apparatus main assembly 100*a*), presses on the bearing 40, the bearing pressing member catching portion 40*b* is between the main assembly contacting first portion 40*a*1 and the main assembly contacting second portion 40*a*2 (roughly at the mid point between portions 40*a*1 and 40*a*2). This structural arrangement ensures that as the bearing pressing member catching portion 40*b* is pressed by the bearing pressing member 83, the main assembly contacting portion 40*a* is placed in contact with a bearing catching portion 82*a* (cartridge positioning first portion of apparatus main assembly 100*a*), being thereby accurately positioned relative to the apparatus main assembly 100*a*.

In this embodiment, the cartridge 7 is provided with the main assembly contacting first portion 40*a*1 and main assembly contacting second portion 40*a*2, in order to ensure that the leading end of the cartridge 7 is accurately positioned, and is kept accurately positioned, relative to the apparatus main assembly 100*a*. However, the number of the cartridge positioning portions at the leading end of the cartridge 7 in terms of the cartridge mounting direction, may be only one.

Referring again to FIG. 4, the rear bearing 40 is provided with a bearing pressing member pressing portion 40*c* (bearing pressing member pressing first portion) for causing the bearing pressing member 83 to move back into its retreat position. In terms of the direction which is horizontal and perpendicular to the cartridge advancement direction, the bearing pressing member pressing portion 40*c* (which hereafter may be referred to simply as pressing portion 40*c*) is located farther from the center of the cartridge 7 than the abovementioned bearing pressing member catching portion 40*b* is. In terms of the cartridge advancement direction, the bearing pressing member pressing portion 40*c* is on the downstream end wall of the cartridge 7, and perpendicularly projects downstream from the end wall. The tip portion of the pressing portion 40*c* is provided with a projection 40*d*, which projects downward. The projection 40*d* is triangular in cross section. That is, it has gently slanted surfaces 40*e* and 40*f*, which are on the downstream side and upstream side, respectively, of the apex of the projection 40*d*, in terms of the cartridge advancement direction.

Also referring to FIG. 4, the top portion of the peripheral surface of the rear bearing 40 has a main assembly contacting first portion (surface) 40*h* (cartridge rotation regulating first portion of cartridge 7), which is positioned higher than the main assembly contacting portion 40*a*. The main assembly contacting first surface 40*h* is flat and is between the main assembly contacting first portion 40*a*1 and main assembly contacting second portion 40*a*2. Further, the rear bearing 40 is provided with a surface 40*g*, which is positioned lower than the main assembly contacting first portion 40*h*. Further, the rear bearing 40 is provided with a main assembly contacting surface 40*i*, which is another surface of the bearing 40, which positions the cartridge 7 relative to the apparatus main assembly 100*a* in terms of the lengthwise direction of the cartridge 7. As the cartridge 7 is moved into the apparatus main assembly 100*a*, the main assembly contacting surface 40*i* comes into contact with the inward surface of the rear wall of the apparatus main assembly 100*a*, and remains in contact therewith, ensuring that the cartridge 7 is accurately positioned relative to the apparatus main assembly 100*a* in terms of the lengthwise direction of the cartridge 7, and also, that the cartridge 7 remains accurately positioned relative to the apparatus main assembly 100*a* in terms of the lengthwise direction of the cartridge 7 after the mounting of the cartridge 7 into the apparatus main assembly 100*a*.

Next, the front bearing 50 (photosensitive drum axle bearing second bearing which is at the other end, in terms of direction parallel to axial line of photosensitive drum 1, from the end supported by rear bearing 40), that is, the photosensitive drum axle bearing member located at the trailing end of the cartridge 7 in terms of the cartridge advancement direction, will be described. The front bearing 50 has a cartridge positioning second portion 50*a* of the cartridge 7 (which has portions 50*a*1 and 50*a*2) (FIGS. 4 and 14), which is for positioning the front side of the cartridge 7 relative to the apparatus main assembly 100*a* in terms of the direction perpendicular to the abovementioned cartridge advancement direction. The cartridge positioning portion 50*a* is a top portion of the peripheral surface of the arcuate portion of the bearing 50, being therefore accurate, as seen from the direction parallel to the axial line of the photosensitive drum 1. The front bearing 50 is also provided with a bearing pressing member catching portion 50*b*, which comes into contact with the apparatus main assembly 100*a* as upward force is applied to the front bearing 50 by a cartridge lifting member 93 (FIG. 5), which will be described later. The bearing pressing member catching portion 50*b* is positioned higher than the cartridge positioning portion 50*a*.

Like the main assembly contacting portion 40*a*, the above mentioned cartridge positioning front portion 50*a* has a cartridge positioning portion 50*a*1 (third cartridge positioning portion) and a cartridge positioning portion 50*a*2 (fourth cartridge positioning portion), which are on one side the axial line I of the photosensitive drum 1 and the other side, respectively. That is, the cartridge positioning third portion 50*a*1 and cartridge positioning fourth portion 50*a*2 opposes each other across the axial line I (FIG. 4).

In terms of the cartridge advancement direction, the bearing pressing member catching portion 50*b* is on the downstream side of the photosensitive drum 1. Further, as seen from the direction, indicated by a arrow mark K (FIG. 11(*c*)), in which the cartridge 7 is lifted by the cartridge lifting member 93 (cartridge pressing second member of main assembly 100*a*), the bearing pressing member catching portion 50*b* is between the cartridge positioning third portion 50*a*1 and cartridge positioning fourth portion 50*a*2 (roughly at mid point between portions 50*a*1 and 50*a*2). This structural arrangement ensures that as upward force is applied to the bearing pressing member catching portion 50*b*, the cartridge positioning portion 50*a* is placed in contact with the cartridge contacting portion 92*a* of the apparatus main assembly 100*a*, accurately positioning the cartridge 7 relative to the apparatus main assembly 100*a*.

In this embodiment, the front bearing 50 has the cartridge positioning third portion 50*a*1 and cartridge positioning fourth portion 50*a*2 as the portions for accurately positioning the rear side of the cartridge 7 relative to the apparatus main assembly 100*a*. Therefore, it is ensured that the cartridge 7 is more reliably pressed, and kept pressed, upon the cartridge contacting portion 92*a* of the apparatus main assembly 100*a*. However, the number of the cartridge positioning portion for positioning the rear side of the cartridge 7 may be only one.

Also referring to FIG. 4, the front bearing 50 is provided with a bearing pressing member pressing portion 50*c* (pressing member pressing second portion) for causing the cartridge lifting member 93 to move back into its retreat position. In terms of the direction, which is horizontal, and perpendicular to the cartridge advancement direction, the bearing pressing member pressing portion 50*c* (which hereafter may be referred to simply as the contacting portion 50*c*) is located farther from the center of the cartridge 7 than the abovementioned bearing pressing member catching portion 50*b* is. In terms of the cartridge advancement direction, the bearing pressing member pressing portion 50*c* is on the downstream end wall of the cartridge 7, and perpendicularly projects downstream. The tip portion of the bearing pressing member pressing portion 50*c* is provided with a projection 50*d*, which projects downward. The projection 50*d* is triangular in cross section. That is, it has gently slanted surfaces 50*e* and 50*f*, which are on the downstream side and upstream side, respectively, of the apex of the projection 50*d*, in terms of the cartridge advancement direction.

Referring again to FIG. 4, the front bearing 50 also has a main assembly contacting surface (portion) 50*h* (cartridge contacting second portion: cartridge positioning second portion of bearing 50), which is a part of the top surface of the front bearing 50. The main assembly contacting portion 50*h* is positioned higher than the cartridge positioning portion 50*a* is. The main assembly contacting second portion 50*h* is flat and is between the cartridge positioning third portion cartridge 50*a*1 and cartridge positioning fourth portion cartridge 50*a*2. Further, the front bearing 50 is provided with a surface 50*g*, which is positioned lower than the main assembly contacting second portion 50*h*.

Figure 6:
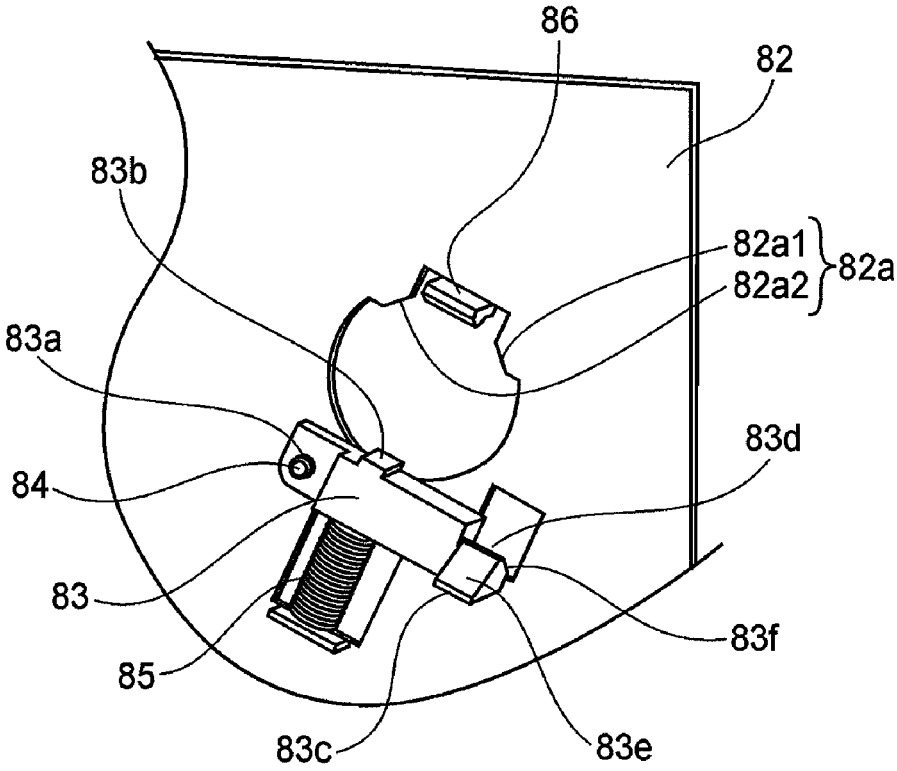
FIG. 6 is a detailed perspective view of the cartridge positioning assembly and cartridge pressing mechanical assembly, which are located at the rear end of the main assembly of the image forming apparatus in the first embodiment of the present invention.
Figure 7:
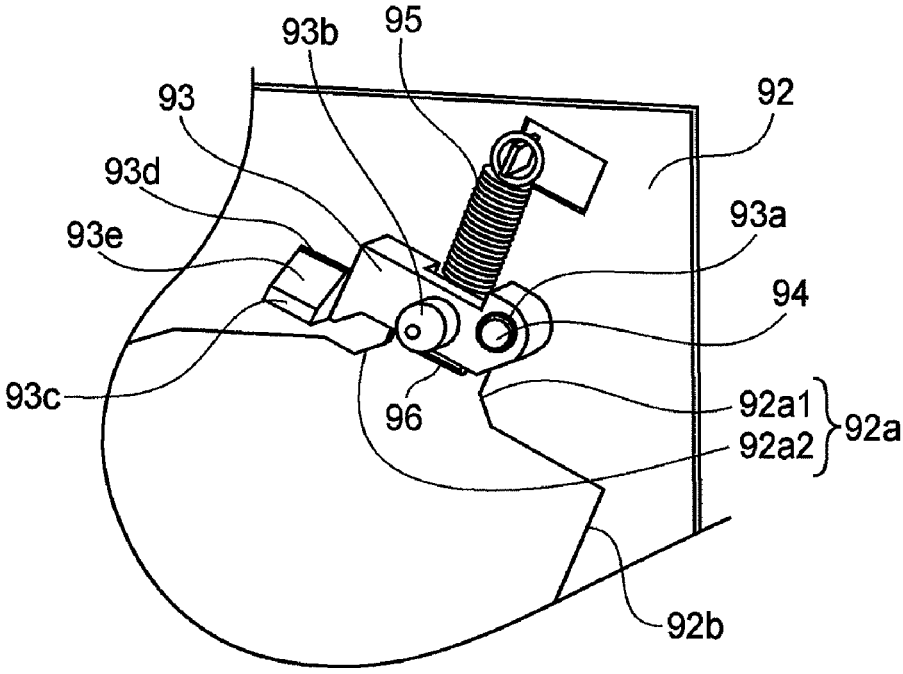
FIG. 7 is a detailed perspective view of the cartridge positioning assembly and bearing pressing mechanism, which are located at the front end of the main assembly of the image forming apparatus in the first embodiment of the present invention.

Next, the portions of the structure of the apparatus main assembly 100*a*, which are for accurately positioning the cartridge 7 and keeping the cartridge 7 pressed upon the cartridge positioning portions of the apparatus main assembly 100*a* will be described. FIG. 5 is a schematic drawing for describing the portions of the image forming apparatus main assembly, which are for accurately positioning the cartridge 7 and keeping the cartridge 7 pressed upon the cartridge positioning portions of the apparatus main assembly 100*a*. FIG. 6 is a detailed drawing for describing the rear portions of the image forming apparatus main assembly 100*a*, which are for accurately positioning the cartridge 7 and keeping the cartridge 7 pressed upon the cartridge positioning portions of the apparatus main assembly 100*a*. FIG. 7 is a detailed drawing for describing the front portions of the image forming apparatus main assembly, which are for accurately positioning the cartridge 7 and keeping the cartridge 7 pressed upon the cartridge positioning portions of the apparatus main assembly 100*a*.

Referring to FIG. 5, the apparatus main assembly 100*a* is provided with lateral plates 82 and 92, which are at the rear and front ends of the apparatus main assembly 100*a*, in terms of the cartridge mounting direction. The lateral plate 92 is provided with an opening 92*b*, which makes it possible for the cartridge 7 to be removable mounted into the apparatus main assembly 100*a*. That is, it is through the opening 92*b* that the cartridge 7 is inserted into the apparatus main assembly 100*a*. More specifically, as the cartridge 7 is inserted into the apparatus main assembly 100*a* through the opening 92*b*, the cartridge 7 is guided into the apparatus main assembly 100*a* by the above described top cartridge guide 80*a*-80*d* and bottom cartridge guide 81*a*-81*d* (FIG. 3) in the direction indicated by the arrow mark F. It is also through the opening 92*b* that the cartridge 7 is removed from the apparatus main assembly 100*a*. These operations are to be carried out by a user.

Referring to FIG. 6, the lateral plate 82 is has the above-mentioned bearing catching portion 82*a* (which has portions 82*a*1 and 82*a*2), that is, the bearing 40 positioning first portion of the apparatus main assembly 100*a*, which is for accurately positioning the bearing 40 (cartridge 7) relative to the apparatus main assembly 100*a* in terms of the direction perpendicular to the cartridge mounting direction (cartridge advancement direction). The lateral plate 82 is also provided with the bearing pressing member 83 (bearing pressing first member of apparatus main assembly 100*a*) for pressing the bearing 40 toward the bearing catching portion 82*a* by being under the pressure (elastic force) generated by a compression spring 85. This bearing pressing member 83 functions as a member for keeping the bearing 40 (cartridge 7) pressed upward by being under the pressure from the compression spring 85. The bearing pressing member 83 will be described later in detail.

The bearing pressing member 83 is on the opposite side of the bearing 40 accommodating hole of the lateral plate 82 from the bearing catching portion 82*a*. It has a hole 83*a*, in which a shaft 84 fixed to the lateral plate 82 is fitted. More specifically, the bearing pressing member 83 is structured, and is attached to the lateral plate 82, so that it is allowed to take a bearing pressing position, a retreat position, and a standby position. The bearing pressing position is the position for keeping the bearing 40 (cartridge 7) pressed upon the cartridge contacting portion 82*a*. The retreat position is the position into which it is moved to eliminate the pressure it applies to the bearing 40 (cartridge 7). The standby position is a position which corresponds to a preset point in the cartridge passage.

Further, the bearing pressing member 83 is provided with a cartridge (bearing) pressing portion 83*b*, which presses on the bearing 40 (cartridge 7) when the bearing pressing member 83 is in the bearing (cartridge) pressing position; the bearing (cartridge) pressing portion 83*b* corresponds in position to the bearing pressing member catching portion 40*b* of the bearing 40 of the cartridge 7. The bearing pressing member 83 is also provided with a bearing contacting first portion 83*c* for moving the bearing pressing member 83 into the retreat position. The bearing contacting first portion 83*c* corresponds in position to the bearing pressing member pressing portion 40*c*. The bearing contacting first portion 83*c* is provided with a projection 83*d*, which projects upward. The projection 83*d* is triangular in cross section. That is, it has gently sloped surfaces 83*e* and 83*f*, which are on the downstream side and upstream side, respectively, of the apex of the projection 83*d*, in terms of the cartridge advancement direction. In terms of the direction perpendicular to the cartridge mounting direction F, the bearing contacting first portion 83*c* is located farther from the axial line of the hole 83*a* than the bearing (cartridge) pressing portion 83*b* is. That is, in terms of the lengthwise direction of the bearing pressing member 83, the axial line of the hole 83*a*, bearing pressing portion 83*b*, and bearing contacting first portion 83*c* are arranged in the listed order.

Further, the lateral plate 82 is provided with a cartridge position regulating portion 86 (cartridge position regulating first portion of apparatus main assembly 100*a*) for regulating the upward movement of the cartridge 7 attributable to the reactive force generated when the bearing pressing member 83 is moved into its retreat position. The cartridge movement regulating portion 86 is formed of a resin, and is between the two portions 82*a*1 and 82*a*2 of the bearing catching portion 82*a* of the lateral plate 82.

Next, referring to FIG. 7, the lateral plate 92 has the above-mentioned cartridge insertion opening 92*b*. Further, the lateral plate 92 is provided with a cartridge catching portion 92*a* (which has portions 92*a*1 and 92*a*2), that is, the cartridge positioning second portion of the apparatus main assembly 100*a*, which is for accurately positioning the cartridge 7 (bearing 50) relative to the apparatus main assembly 100*a* in terms of the direction perpendicular to the cartridge mounting direction. The two portions 92*a*1 and 92*a*2 of the bearing catching portion 92*a* are at the top of the cartridge insertion opening 92*b*. Further, the lateral plate 92 is provided with the cartridge lifting member 93 (bearing pressing second member of apparatus main assembly 100*a*) for pressing the cartridge 7 (bearing 50) toward the bearing catching portion 92*a* by being under the force (tension) generated by a tensile spring 95. The cartridge lifting member 93 is positioned higher than the bearing catching portion 92*a*. Further, the lateral plate 92 is provided with a shaft 94, which is solidly fixed to the lateral plate 92, and the cartridge lifting member 93 is provided with a hole 93*a* (second hole of 93*a*). The shaft 94 is fitted in the hole 93*a*. The cartridge lifting member 93 is structured, and attached to the lateral plate 92, so that it is allowed to take a bearing pressing position (bearing pressing position), a retreat position, and a standby position. The bearing pressing position is the position for keeping the bearing 50 pressed upon the bearing catching portion 92*a*. The retreat position is the position into which the cartridge lifting member 93 is moved to eliminate the pressure it applied to the bearing 50. The standby position is a position which corresponds to a preset point in the cartridge passage.

Figure 10:
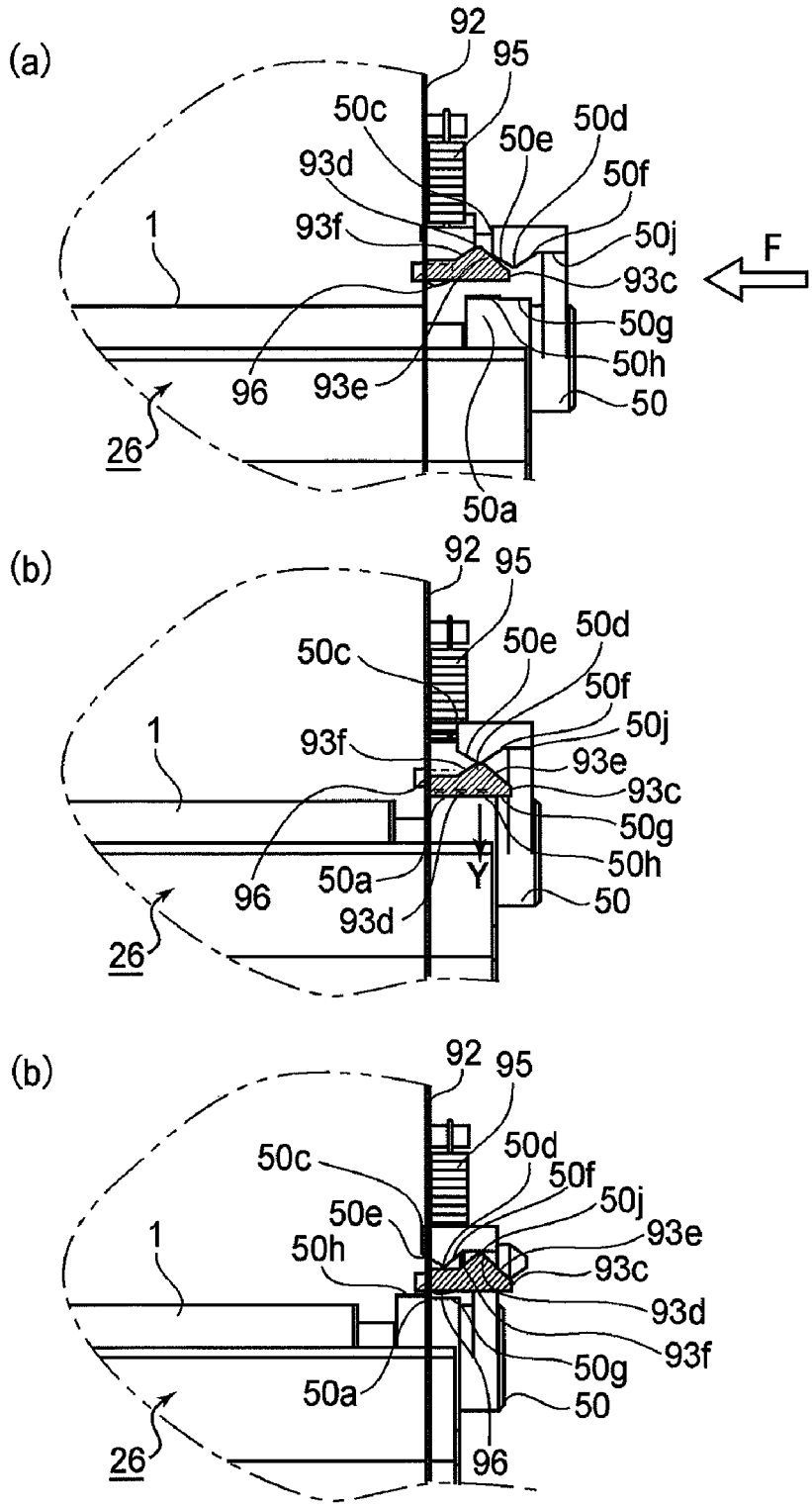
FIG. 10 is a schematic drawing of the bearing pressing mechanism located at the front end, as seen from the left side of the main assembly, showing the cartridge pressing operation of the mechanism.

Further, the cartridge lifting member 93 is provided with a bearing pressing portion 93*b*, which presses the bearing 50 upward when the cartridge lifting member 93 is in the bearing pressing position; the bearing pressing portion 93*b* corresponds in position to the bearing pressing member catching portion 50*b* of the cartridge 7. The cartridge lifting member 93 is also provided with a bearing contacting second portion 93*c* for moving the cartridge lifting member 93 into the retreat position. The bearing contacting second portion 93*c* corresponds in position to the bearing pressing member pressing portion 50*c*. The cartridge lifting member 93 is provided with a projection 93*d*, which projects upward. The projection 93*d* is triangular in cross section. That is, it has gently sloped surfaces 93*e* and 93*f*, which are on the downstream side and upstream side, respectively, of the apex of the projection 93*d*, in terms of the cartridge advancement direction (FIG. 10).

In terms of the direction perpendicular to the cartridge mounting direction, the bearing contacting second portion 93*c* is located farther from the axial line of the hole 93*a* than the bearing pressing portion 93*b*. That is, in terms of the lengthwise direction of the cartridge lifting member 93, the axial line of the hole 93*a*, bearing pressing member 93*b*, and bearing contacting second portion 93*c* are arranged in the listed order.

Further, the cartridge lifting member 93 is provided with a bearing position regulating portion 96 (cartridge position regulating second portion of apparatus main assembly 100*a*) for regulating the upward movement of the bearing 50 attributable to the reactive force generated when the cartridge lifting member 93 is moved into the retreat position. The bearing position regulating portion 96 is formed of a resin, and is between the two portions 92*a*1 and 92*a*2 of the bearing catching portion 92*a* of the lateral plate 92.

In this embodiment, the leading end portion of the cartridge 7 in terms of the cartridge mounting direction is pressed upward by the bearing pressing member 83 (bearing pressing member, cartridge lifting member) on the opposite side of the bearing accommodating hole of the lateral plate 82 from the bearing catching portion 82*a* so that the leading end portion of the cartridge 7 (bearing 40) is placed in contact with the bearing catching portion 82*a*, which is on the opposite side of the bearing accommodating hole of the lateral plate 82 from the bearing pressing member 83. On the trailing side of the cartridge 7 in terms of the cartridge mounting direction, the trailing end portion of the cartridge 7 (bearing 50) is pulled upward by the cartridge lifting member 93 (cartridge pulling member), which is positioned so that it will be above the trailing portion (bearing 50) of the cartridge 7, to place the bearing 50 in contact with the bearing catching portion 92*a* of the lateral plate 92, which is the top portion of the edge of the cartridge insertion opening 92*b*. That is, while the cartridge 7 is in its image forming position in the apparatus main assembly 100*a*, the bearing 40 is pressed upon the bearing catching portion 82*a* (bearing contacting portion) by the bearing pressing member 83. Therefore, the main assembly contacting first portion 40*a*1 and main assembly contacting second portion 40*a*2 (cartridge positioning portions at leading end of cartridge 7) are accurately positioned relative to the bearing catching portion 82*a* (cartridge positioning first portion of apparatus main assembly 100*a*).

Further, the bearing 50 is pressed upward by the upward force applied thereto by the cartridge lifting member 93. Therefore, the cartridge positioning third portion 50*a*1 and cartridge positioning fourth portion 50*a*2 (portions for positioning trailing end portion of cartridge) are placed in contact with the bearing catching portion 92*a* (having portions 92*a*1 and 92*a*2) (cartridge positioning second portion of apparatus main assembly 100*a*), respectively. The above described structural arrangement makes it possible to provide the lateral plate 92 with the cartridge insertion opening 92*b* through which the cartridge 7 is removably mountable into the cartridge spaces (cartridge compartments 22) in the apparatus main assembly 100*a*. Therefore, the bearing 50, which is the adjacencies of the cartridge positioning portion of the cartridge 7, can be directly pressed by the bearing pressing member 92, in the image forming apparatus 100 structured so that the cartridge 7 is to be mounted into the apparatus main assembly 100*a* in the direction parallel to the axial line of the photosensitive drum 1.

In other words, the above described structural arrangement makes it possible to directly press both the rear bearing 40 and front bearing 50. That is, the above described structural arrangement stabilizes the force by which the cartridge 7 (rear and front bearings 40 and 50) is pressed, and is kept pressed, upon the cartridge positioning portions of the apparatus main assembly 100*a*, ensuring that the cartridge 7 is accurately positioned, and remains accurately positioned, relative to the apparatus main assembly 100*a*. Therefore, it is ensured that the photosensitive drum 1 is accurately positioned, and remains accurately positioned, in contact with the intermediary transfer belt 5.

As described above, the cartridge 7 is provided with the photosensitive drum axle bearing first member 40, that is, the bearing which supports one end of the photosensitive drum 1 in terms of the direction parallel to the axial line of the photosensitive drum 1. Further, the main assembly contacting first surface 40*h* and main assembly contacting portion 40*a* (having portions 40*a*1 and 40*a*2) are portions of the peripheral surface of the drum axle bearing first member 40. In addition, the cartridge 7 is provided with the photosensitive drum axle bearing second member 50, that is, the bearing which supports the other end of the drum 1. The main assembly contacting second portion 50*h* and main assembly contacting portion 50*a* (cartridge positioning portion) (cartridge positioning third portion 50*a*1 and cartridge positioning fourth portion 50*a*2) are portions of the peripheral surface of the drum axle bearing second member 50. Therefore, it is ensured that the cartridge 7 is accurately positioned, and remains accurately positioned, relative to the apparatus main assembly 100*a*.

Further, in terms of the direction perpendicular to the axial line of the photosensitive drum 1, the main assembly contacting surface 40*h*, that is, the main assembly contacting first portion (cartridge movement regulating first portion of cartridge 7), is rendered different in position from the main assembly contacting first portion 40*a* (having portions 40*a*1 and 40*a*2). Also in terms of the direction perpendicular to the axial line of the photosensitive drum 1, the main assembly contacting surface 50*h*, that is, the main assembly contacting second portion (cartridge movement regulating second portion), is different in position from the bearing positioning second portion 50*a* (having portion 50*a*1 and 50*a*2) (cartridge positioning second portion). Further, in terms of the cartridge mounting direction, the main assembly contacting first surface 40*h* is at the leading end of the cartridge 7, whereas the main assembly contacting second surface 50*h* is at the trailing end of the cartridge 7. Therefore, it does not occur that the main assembly contacting portions 40*a* and 50*a* (cartridge positioning portions) rub against the apparatus main assembly 100*a* while the cartridge 7 is mounted into the apparatus main assembly 100*a*. Therefore, the cartridge 7 is accurately positioned relative to the apparatus main assembly 100*a*.

The summary of the description of the cartridge 7 and apparatus main assembly 100*a* in the first embodiment of the present invention is as follows:

The apparatus main assembly 100*a* is provided with the bearing catching portion 82*a* (having portions 82*a*1 and 82*a*2: cartridge positioning first portions) and bearing catching portion 92*a* (having portions 92*a*1 and 92*a*2): cartridge positioning second portions). The apparatus main assembly 100*a* is also provided with the lateral plate 82 (bearing pressing first member, cartridge raising (bearing raising) first member) for pressing the cartridge 7 (bearing 40) upward, and the cartridge lifting member 93 (cartridge (bearing) pressing second member) for pressing the cartridge 7 (bearing 50) upward. More specifically, the bearing pressing member 83 presses the cartridge 7 (bearing 40) from under the cartridge 7 (bearing 40), whereas the cartridge lifting member 93 presses the cartridge 7 (bearing 50) upward by pulling the cartridge 7 (bearing 50) from above.

It should be noted here that this embodiment is not intended to limit the present invention in the structure of the cartridge 7 and apparatus main assembly 100*a*. That is, in terms of the cartridge mounting direction, the bearing pressing member 93 and 83, that is, the members for pressing the cartridge 7 (bearing 50) upward, and keeping it pressed upward, may be positioned at the rear and front ends of the apparatus main assembly 100*a*, respectively, instead of the front and rear of the apparatus main assembly 100*a*, respectively, as they are in this embodiment. However, it is by the structural arrangement employed in this embodiment that the above described effects of this embodiment are obtained.

(Operation of Cartridge (Bearing) Pressing Mechanism During Moving and Removing of Cartridge)

Next, referring to FIGS. 8-11, the operation of the bearing pressing mechanism during the mounting of the cartridge into the image forming apparatus and the removing of the cartridge from the image forming apparatus 100 will be described.

Figure 8:
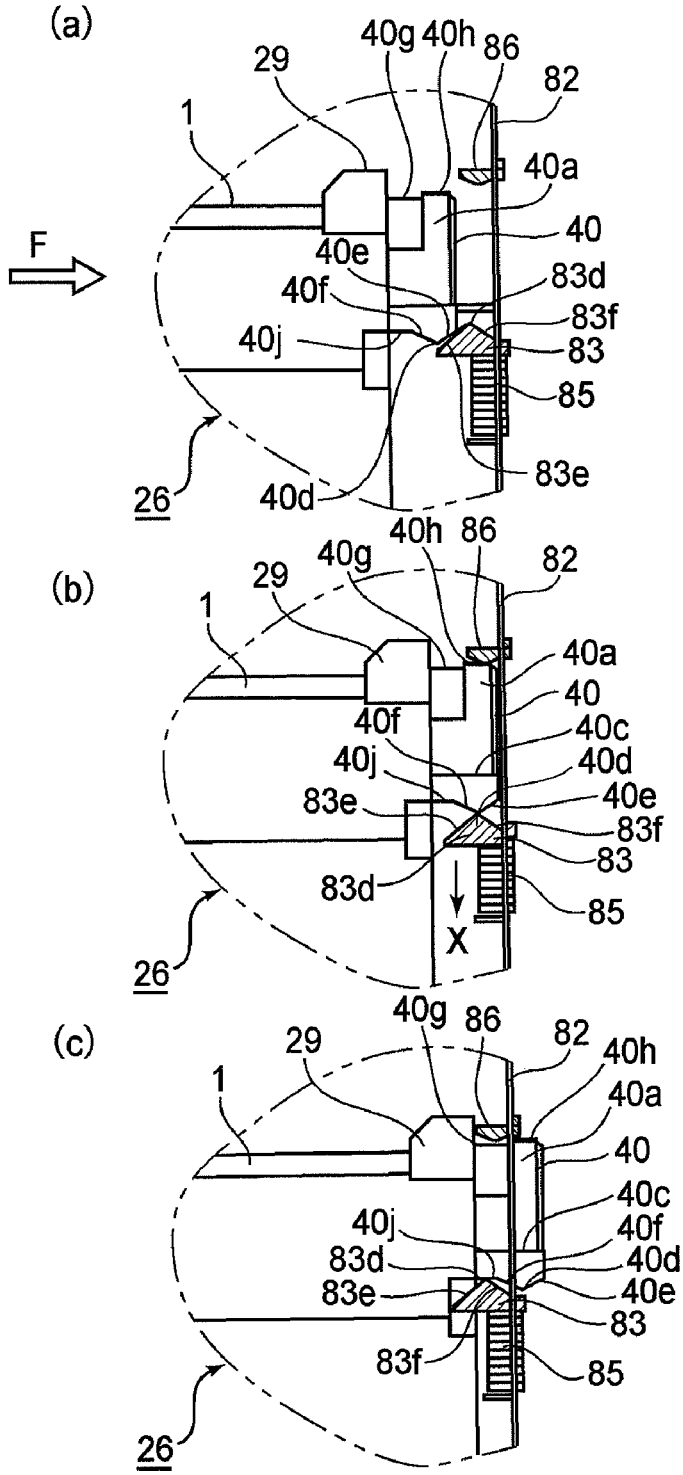
FIG. 8 is a schematic drawing of the bearing pressing mechanism (assembly) located at the rear end of the main assembly of the image forming apparatus in the first embodiment, as seen from the right side of the main assembly, showing the cartridge pressing operation of the mechanism.
Figure 9:
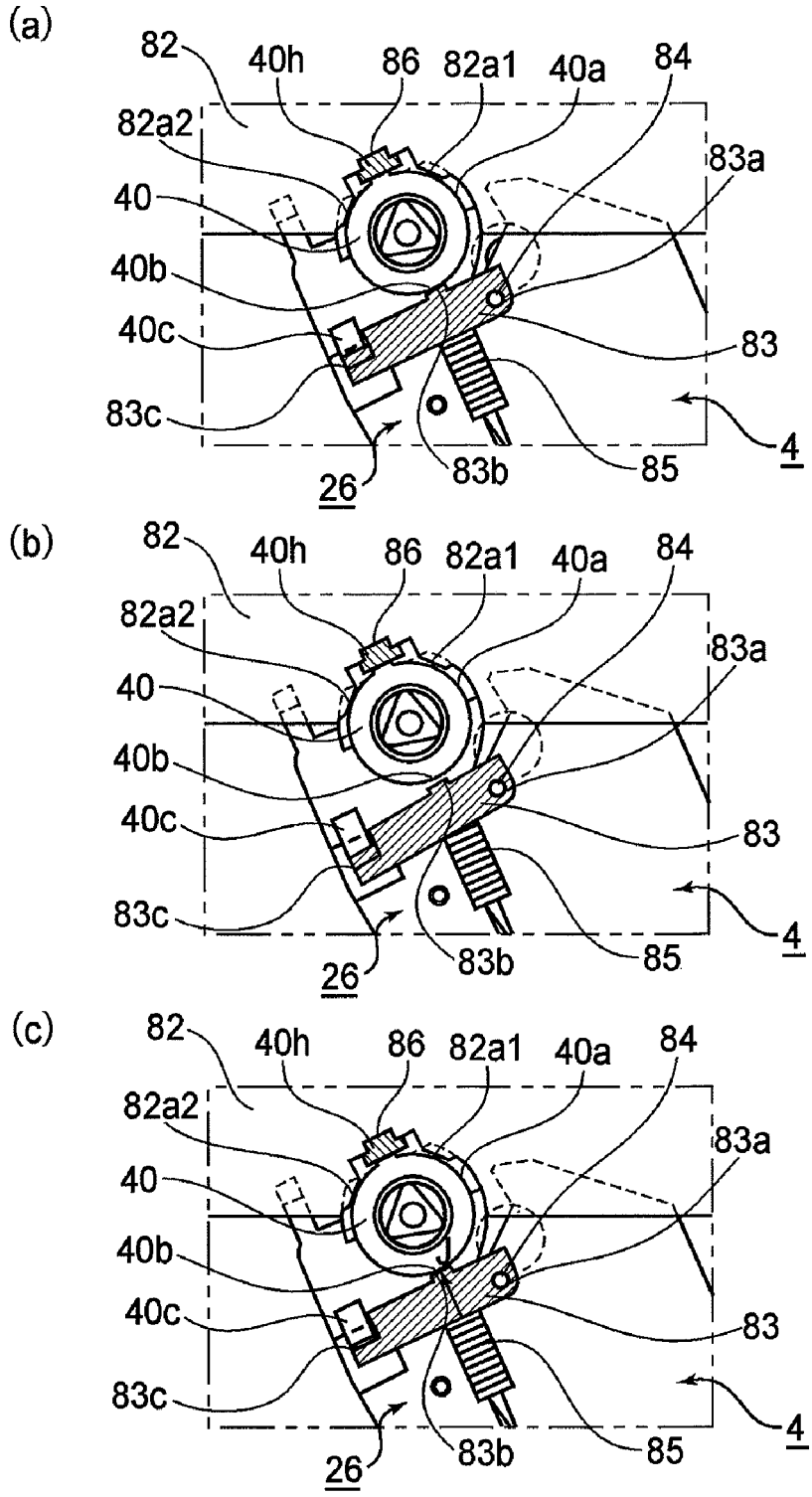
FIG. 9 is a schematic drawing of the bearing pressing mechanism located at the downstream end of the main assembly of the image forming apparatus in the first embodiment, as seen from the downstream side in terms of the direction in which the cartridge is mounted, showing the cartridge pressing operation of the mechanism.

(a) Rear End: Operation of Bearing Pressing Mechanism During Mounting and Removing of Cartridge FIG. 8 is a schematic drawing of the bearing pressing mechanism (assembly) on the rear side, as seen from the right side of the main assembly of the image forming apparatus, and shows the operation of the bearing pressing member. FIG. 9 is a schematic drawing of the bearing pressing mechanism on the rear side, as seen from the downstream side in terms of the direction in which the cartridge is mounted, and shows the bearing pressing operation of the mechanism.

The cartridge 7 is mounted in the direction indicated by the arrow mark F, as described above. Referring to FIGS. 8(*a*) and 9(*a*), as the cartridge 7 is inserted into the apparatus main assembly 100*a*, the sloped surface 40*e* of the bearing pressing member pressing portion 40*c* comes into contact with the slanted surface 83*e* of the bearing contacting first portion 83*c* (standby position). Then, as the cartridge 7 is inserted further, the bearing pressing member 83 is gradually moved downward by the bearing pressing member pressing portion 40*c*. As a result, the projection 40*d* of the bearing pressing member pressing portion 40*c* comes into contact with the projection 83*d* of the bearing contacting first portion 83*c*, and then, causes the bearing pressing member 83 to retreat in the direction indicated by an arrow mark X (retreat position), as shown in FIG. 8(*b*).

More specifically, the bearing pressing member 83 is made to retreat into the position in which its does not contact the bearing pressing member catching portion 40*b* of the bearing 40 (FIG. 9(*b*)). Therefore, while the cartridge 7 is mounted, the bearing pressing member catching portion 40*b* is not pressed by the bearing pressing portion 83*b*. The pressure which the bearing 40 receives when the cartridge 7 is mounted is cancelled by the bearing pressing member pressing portion 40*c*, which is positioned farther from the axial line of the hole 83*a* than the bearing catching portion 82*a*. That is, the force necessary to move the bearing 40 downward against the upward force (pressure) applied to the bearing 40 is reduced by the amount proportional to the ratio between the distance from the axial line of the hole 83*a* to the bearing pressing member catching portion 40*b* (83*b*), and the distance from the axial line of the hole 83*a* to the bearing pressing member pressing portion 40*c* (83*c*). Therefore, the amount of load to which the cartridge 7 is subjected when the cartridge 7 is mounted is sufficiently small relative to the amount of pressure applied to the cartridge 7 by the bearing pressing member 83. That is, this embodiment can reduce the amount of force necessary to mount the cartridge 7.

At the same time, the bearing 40 is pressed upward by the reactive force generated by the bearing pressing member 83 as the bearing pressing member 83 is moved downward into its retreat position by the bearing pressing member pressing portion 40*c*. However, the main assembly contacting surface 40*h* comes into contact with the cartridge movement regulating portion 86 of the apparatus main assembly 100*a*, that is, the bearing contacting first portion of the apparatus main assembly 100*a*, thereby regulating the upward movement of bearing 40. The positional relationship between the bearing position regulating portion 86 and main assembly contacting surface 40*h* is such that they remain in contact with each other until immediately before the main assembly contacting portions 40*a* comes into contact with the bearing catching portion 82*a*, that is, immediately before the main assembly contacting portions 40*a* is positioned by the bearing catching portion 82*a*. Therefore, during the mounting of the cartridge 7, the cartridge movement regulating portion 86, which is formed of a resin, and the main assembly contacting surface 40*h* continuously rub against each other from the moment the cartridge 7 begins to be pressed upward by the bearing pressing member 83 until immediately before the cartridge 7 is accurately positioned relative to the apparatus main assembly 100*a*, whereas the main assembly contacting portions 40*a* does not contact the bearing catching portion of the lateral plate 82 of the apparatus main assembly 100*a*, which is formed of thin steel plate or the like. Therefore, the main assembly contacting portions 40*a* and bearing catching portion 82*a* do not shave each other.

As the cartridge 7 is inserted even further, the bearing pressing member pressing portion 40*c* gradually disengages from the bearing contacting first portion 83*c*, allowing the bearing pressing member 83 to gradually move back from the retreat position to the bearing pressing position. The cartridge 7 is inserted until the rear lateral plate contacting portion 40*i* of the cartridge 7, which is the portion for positioning the cartridge 7 in terms of the lengthwise direction of the cartridge 7, comes into contact with the rear lateral plate 82 of the apparatus main assembly 100*a*. As the cartridge 7 is inserted as far as the rear lateral plate 82, the bearing pressing member catching portion 40*b* comes into contact with the bearing (cartridge) pressing portion 83*b*, causing the bearing 40 to be pressed in the bearing pressing direction, as shown in FIG. 9 in the bearing pressing position, as shown in FIGS. 8(*c*) and 9(*c*). As a result, the main assembly contacting portions 40*a* is placed in contact with the bearing catching portion 82*a* of the rear lateral plate 82 of the apparatus main assembly 100*a*, accurately positioning the bearing 40 (rear end portion of cartridge 7) relative to the apparatus main assembly 100*a* in terms of the direction perpendicular to the cartridge mounting direction. Also during this movement of the cartridge 7, the main assembly contacting surface 40*h* becomes disengaged from the cartridge movement regulating portion 86 of the apparatus main assembly 100*a*, creating a preset amount of gap between the cartridge movement regulating portion 86 and surface 40*g*. At the same time, bearing pressing member pressing portion 40*c* rides past the apex of projection 83*d* of the bearing contacting first portion 83*c*, creating a preset amount of gap between the surface 40*j* and bearing pressing member 83.

As descried above, the bearing pressing member 83 is capable of taking the standby position, the bearing pressing position (cartridge pressing position), and the retreat position. To describe in more detail, listing from the top, the standby position, bearing pressing position, and retreat position of the bearing pressing member 83 are positioned in the stated order. Therefore, the bearing pressing member 83 can apply a sufficient amount of pressure upon the cartridge 7 while the cartridge 7 is in its image forming position in the apparatus main assembly 100*a*.

Next, when it is necessary to take the cartridge 7 out of the apparatus main assembly 100*a*, the above described operation for mounting the cartridge 7 is to be carried in reverse. The pressure from the bearing pressing member 83, applied to the bearing 40 is, cancelled, as it is when the cartridge 7 is mounted, by the bearing pressing member pressing portion 40*c*, which is located farther from the axial line of the hole 83*a* than is the bearing pressing member catching portion 40*b*. Therefore, the amount of force necessary to remove the cartridge 7 is just as smaller as the amount of force necessary to mount the cartridge 7.

Whether it is when the cartridge 7 is mounted into, or removed from, the apparatus main assembly 100*a*, the bearing pressing member 83 must be moved in the direction perpendicular to the cartridge mounting direction F. In this embodiment, however, the projection 83*d* with which the bearing contacting first portion 83*c* is provided, is provided with gently slanted surfaces, which are on the downstream and upstream sides in terms of the cartridge mounting direction, whereas the projection 40*d* of the bearing pressing member pressing portion 40*c* is provided with gently slanted surfaces, which are on the downstream and upstream sides in terms of the cartridge mounting direction. Thus, when the cartridge 7 is mounted, the slanted surface 40*e* of the bearing pressing member pressing portion 40*c* comes into contact with the slanted surface 83*e* of the bearing contacting first portion 83*c*, whereas when the cartridge 7 is removed, the slanted surface 40*f* of the bearing pressing member pressing portion 40*c* comes into contact with the slanted surface 83*f* of the bearing contacting first portion 83*c*. Thus, as the cartridge 7 is moved, the bearing pressing member 83 is moved in the direction indicated by the arrow mark X. Because the cartridge 7 and apparatus main assembly 100*a* are structured so that the bearing pressing member 83 is moved by the interaction between the abovementioned gently slanted surfaces, the cartridge 7 can be smoothly mounted or removed.

Figure 11:
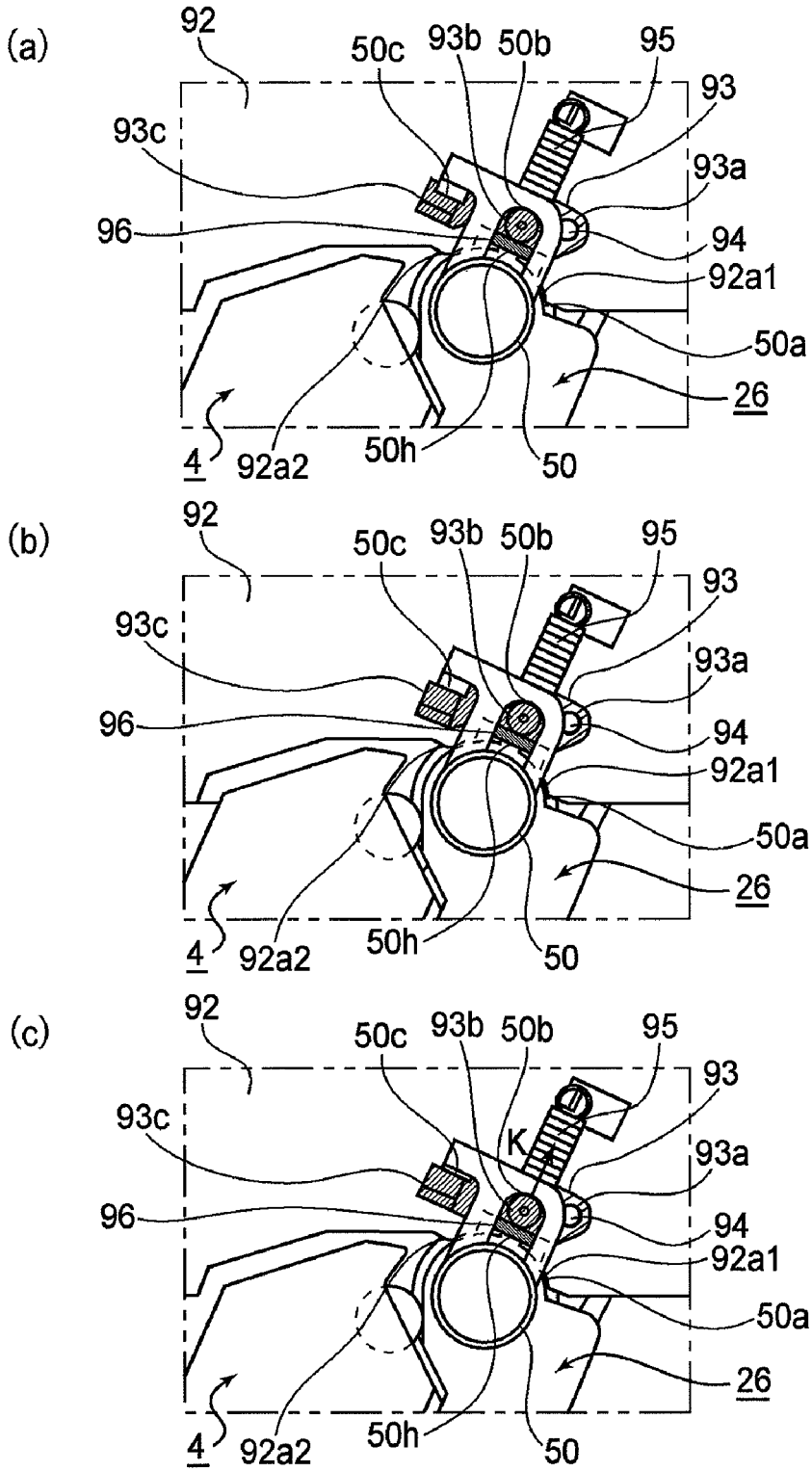
FIG. 11 is a schematic drawing of the bearing pressing mechanism located at the upstream end of the main assembly of the image forming apparatus, in terms of the cartridge mounting direction, as seen from the upstream side, showing the cartridge pressing operation of the mechanism.

(b) Front Side: Operation of Bearing Pressing Mechanism During Mounting or Removing of Cartridge FIG. 10 is a schematic drawing of the bearing pressing mechanism on the front side, as seen from the left side of the main assembly, and shows the operation of the mechanism. FIG. 11 is a schematic drawing of the bearing pressing mechanism on the upstream side in terms of the cartridge mounting direction, as seen from the downstream side in terms of the direction in which the cartridge is mounted, and shows the operation of the mechanism.

Referring to FIGS. 10(*a*) and 11(*a*), as the cartridge 7 is inserted into the apparatus main assembly 100*a*, the slanted surface 50*e* of the bearing pressing member pressing portion 50*c* of the front bearing 50 comes into contact with the slanted surface 93*e* of the cartridge lifting member 93 (standby position). Then, as the cartridge 7 is inserted further, the cartridge lifting member 93 is gradually moved downward by the bearing pressing member pressing portion 50*c*. That is, as the cartridge 7 is inserted into the apparatus main assembly 100*a*, the projection 50*d* of the bearing pressing member pressing portion 50*c* comes into contact with the projection 93*d* of the cartridge lifting member 93, and then, causes the cartridge lifting member 93 to retreat in the direction indicated by an arrow mark Y (retreat position), as shown in FIG. 10(*b*). During this movement of the cartridge lifting member 93, the cartridge lifting member 93 retreats into the position in which its bearing pressing portion 93*b* does not contact the bearing pressing member catching portion 50*b*, as shown in FIG. 11(*b*). Therefore, while the cartridge 7 is mounted, the bearing pressing member catching portion 50*b* is not subjected to any pressure.

The pressure which the bearing 50 receives from the cartridge lifting member 93 when the cartridge 7 is mounted is removed by the bearing pressing member pressing portion 50*c*, which is positioned farther from the axial line of the hole 93*a* than the bearing pressing member catching portion 50*b* is. Thus, the force necessary to move the cartridge lifting member 93 downward against the force (pressure) which presses the bearing 50 (cartridge 7) upward is reduced by the amount proportional to the ratio between the distance from the axial line of the hole 93*a* to the bearing pressing member catching portion 50*b* (93*b*), and the distance from the axial line of the hole 93*a* to the bearing pressing member pressing portion 50*c* (93). Therefore, the amount of load to which the bearing 50 (cartridge 7) is subjected when the cartridge 7 is mounted is sufficiently smaller than the amount of pressure which the bearing 50 (cartridge 7) receives from the cartridge lifting member 93. Thus, this embodiment can reduce the amount of force necessary for the operation for mounting the cartridge 7.

Also during this movement of the cartridge 7, the bearing 50 is pressed upward by the reactive force generated by the cartridge lifting member 93 as the cartridge lifting member 93 is moved downward into its retreat position. However, the main assembly contacting second portion 50*h* comes into contact with the cartridge movement regulating portion 96 of the apparatus main assembly 100*a*, that is, the cartridge contacting second portion of the apparatus main assembly 100*a*, regulating thereby the upward movement of the bearing 50 (cartridge 7). The positional relationship between the cartridge movement regulating portion 96 and the main assembly contacting second portion 50*h* is such that they remain in contact with each other until immediately before the main assembly contacting portion 50*a* (cartridge positioning portion) comes into contact with the bearing catching portion 92*a*, that is, until immediately before the main assembly contacting portion 50*a* (cartridge positioning portion) is positioned by the bearing catching portion 92*a*. Therefore, during the mounting of the cartridge 7, the cartridge movement regulating portion 96 of the apparatus main assembly 100*a*, which is formed of a resin, and the main assembly contacting second portion 50*h* continuously rub against (slide upon) each other from the moment the cartridge 7 begins to be pressed upward by the cartridge lifting member 93 until immediately before the cartridge 7 is positioned relative to the apparatus main assembly 100*a*, whereas the main assembly contacting portion 50*a* (cartridge positioning portion) does not rub against the bearing catching portion 92*a* of the lateral plate 92 of the apparatus main assembly 100*a*, which is formed of thin steel plate or the like. Therefore, the main assembly contacting portion 50*a* (cartridge positioning portion) and the bearing catching portion 92*a* do not shave each other.

As the cartridge 7 is inserted even further, the bearing pressing member pressing portion 50*c* gradually disengages from the cartridge lifting member 93, allowing the cartridge lifting member 93 to gradually move back from its retreat position to the bearing pressing position. The cartridge 7 is to be inserted until the rear lateral plate contacting portion 40*i* of the cartridge 7, which is the portion for positioning the cartridge 7 relative to the apparatus main assembly in terms of the lengthwise direction of the cartridge 7, comes into contact with the rear lateral plate 82 of the apparatus main assembly 100*a*. As the cartridge 7 is inserted far enough for the rear lateral plate contacting portion 40*i* to come into contact with the rear lateral plate 82, the bearing pressing member catching portion 50*b* comes into contact with the bearing pressing portion 93*b*, causing the bearing 50 (cartridge 7) to be pressed in the direction indicated by the arrow mark K (cartridge lifting direction, FIG. 11) (cartridge pressing position), as shown in FIGS. 10(*c*) and 11(*c*). As a result, the main assembly contacting portion 50*a* (cartridge positioning portion) is placed in contact with the bearing catching portion 92*a* of the rear lateral plate 92 of the apparatus main assembly 100*a*, accurately positioning the bearing 50 (cartridge 7) relative to the apparatus main assembly 100*a* in terms of the direction perpendicular to the cartridge mounting direction. Also during this movement of the cartridge 7, the main assembly contacting second portion 50*h* becomes disengaged from the cartridge movement regulating portion 96 of the apparatus main assembly 100*a*, creating a preset amount of gap between the cartridge movement regulating portion 96 and surface 50*g*. At the same time, the bearing pressing member pressing portion 50*c* moves past the bearing catching portion 93*c* of the cartridge lifting member 93, creating a preset amount of gap between the surface 50*j* and bearing catching portion 93*c*.

As described above, the cartridge lifting member 93 is capable of taking the standby position, the bearing pressing position (cartridge pressing position), and the retreat position. To describe in more detail, listing from the top, the standby position, the bearing pressing position, and the retreat position of the cartridge lifting member 93 are positioned in the stated order. Therefore, the cartridge lifting member 93 can apply to the bearing 50 (cartridge 7) a sufficient amount of pressure necessary to keep the bearing 50 (cartridge 7) accurately positioned relative to the apparatus main assembly 100*a* after the amounting of the cartridge 7.

Next, when it is necessary to take the cartridge 7 out of the apparatus main assembly 100*a*, the above described operation for mounting the cartridge 7 is to be carried in reverse. The pressure from the cartridge lifting member 93, under which the bearing 50 (cartridge 7) is located, is cancelled, as it is when the cartridge 7 is mounted, by the bearing pressing member pressing portion 50*c*, which is located farther from the axial line of the cartridge lifting member 93 than is the bearing pressing member catching portion 50*b*. Therefore, the amount of force necessary to remove the cartridge 7 is just as small as the amount of force necessary to mount the cartridge 7.

Whether it is when the cartridge 7 is mounted into the apparatus main assembly 100*a*, or removed from the apparatus main assembly 100*a*, the cartridge lifting member 93 must be moved in the direction perpendicular to the cartridge mounting direction. In this embodiment, however, the projection 93*d* of the cartridge lifting member 93 is provided with gently slanted surfaces, which are on the downstream and upstream sides in terms of the cartridge mounting direction, whereas the projection 50*d* of the bearing pressing member pressing portion 50*c* is provided with gently slanted surfaces, which are on the downstream and upstream sides in terms of the cartridge mounting direction. When the cartridge 7 is mounted, the slanted surface 50*e* of the bearing pressing member pressing portion 50*c* comes into contact with the slanted surface 93*e* of the cartridge lifting member 93, whereas when the cartridge 7 is removed, the slanted surface 50*f* of the bearing pressing member pressing portion 50*c* comes into contact with the slanted surface 93*f* of the cartridge lifting member 93. Thus, as the cartridge 7 is moved, the cartridge lifting member 93 is moved in the direction indicated by the arrow mark Y. Because the cartridge 7 and the apparatus main assembly 100*a* are structured so that the cartridge lifting member 93 is moved by the interaction between the abovementioned gently slanted surfaces, the cartridge 7 can be smoothly mounted or removed.

It should be noted here that it is roughly at the same time that the bearing pressing (positioning) front and rear mechanisms press upon the bearings (cartridge 7), or release the bearings (cartridge 7), when the cartridge 7 is mounted or removed, respectively. Further, the rotational direction of the bearing pressing member 83 is opposite from the rotational direction of the cartridge lifting member 93.

Figure 12:
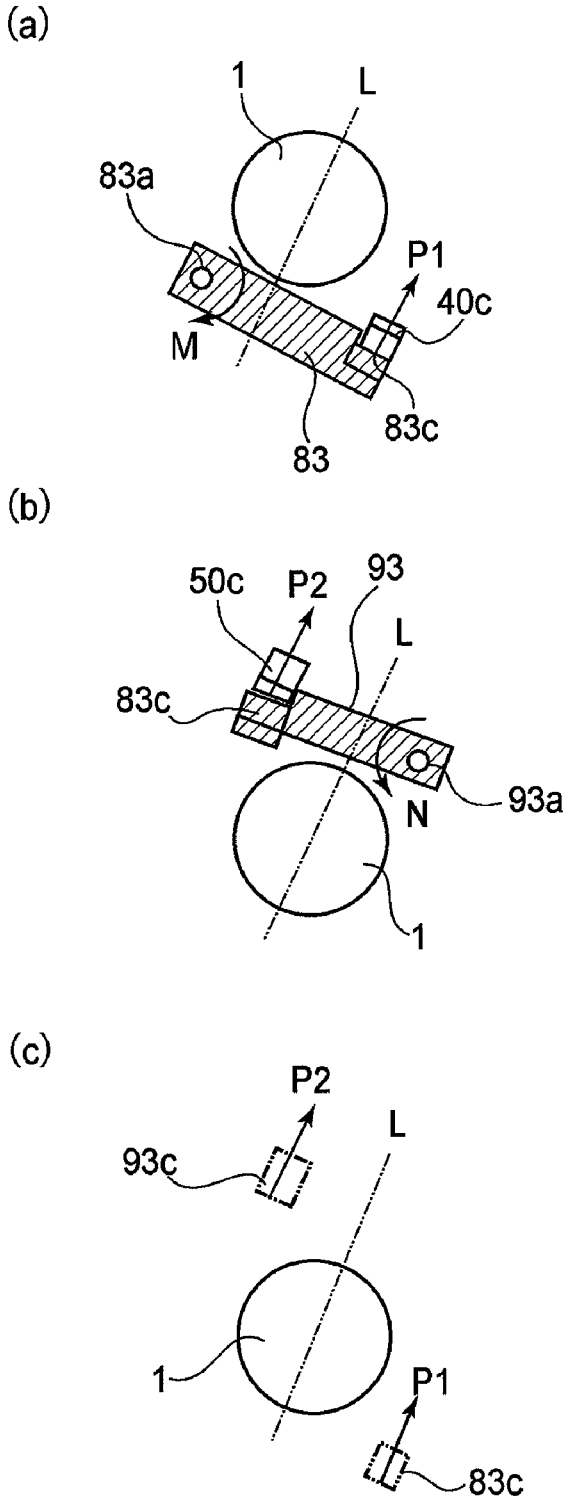
FIG. 12 is a schematic drawing for showing the directions, indicated by arrow marks P1 and P2, in which the bearing pressing member pressing portions 40*c* and 50*c* are pressed by the bearing pressing members 83 and 93, in the first embodiment.

To describe in more detail, referring to FIGS. 12(*a*) and 12(*b*), in terms of the direction perpendicular to the cartridge mounting direction, the hole 83*a*, that is, the hole of the cartridge pressing rear member 83 of the apparatus main assembly 100*a*, is on the left side of a line L which coincides with the axial line of the photosensitive drum 1 and extends in the direction in which the cartridge 7 is moved to be positioned relative to the apparatus main assembly 100*a*, whereas the bearing contacting first portion 83*c* is on the right side of the line L. On the other hand, the hole 93*a*, that is, the hole of the cartridge pressing front member 93 of the apparatus main assembly 100*a*, is on the right side of the line L, and the bearing catching portion 93*c* is on the left side of the line L.

That is, the bearing pressing member 83, which is on the rear side, moves into its retreat position by being rotated in the direction indicated by an arrow mark M, whereas the cartridge lifting member 93, which is on the front side, moves into its retreat position by being rotated in the direction indicated by an arrow mark N. Thus, as the cartridge 7 is mounted or removed, the bearing member pressing member pressing portions 40*c* and 50*c* are pressed in the directions indicated by arrow marks P1 and P2, by the bearing pressing members 83 and 93, respectively, as shown in FIGS. 12(*a*) and 12(*b*). The direction indicated by the arrow mark P, that is, the direction in which the bearing pressing member pressing portion 40*c* is pressed, and the direction indicated by the arrow mark P2, that is, the direction in which the bearing member pressing member pressing portion 50*c* is pressed holds a preset angle relative to the line L, which is parallel to the direction in which the bearings 40 and 50 (cartridge 7) are pushed up. Further, referring to FIG. 12(*c*), the theoretical extension of the arrow mark P1 and that of the P2 are roughly symmetrically positioned with respect to the line L. Therefore, the cartridge 7 remains stable in attitude when it is mounted or removed. Therefore, the image forming apparatus 100 in this embodiment is superior to an electrophotographic image forming apparatus in accordance with the prior art, in terms of the operation for mounting or removing a process cartridge.

Further, during the mounting of the cartridge 7, the cartridge movement regulating portions 86 and 96 of the apparatus main assembly 100*a*, which are formed of a resin, continuously rub against (slide upon) the main assembly contacting surface 40*h* and main assembly contacting portion 50*h*, respectively, from the moment the cartridge 7 begins to be pressed upward by the bearing pressing member 83 and 93 until immediately before the bearings 40 and 50 (cartridge 7) are accurately positioned relative to the apparatus main assembly 100*a*, whereas the main assembly contacting portions 40*a* and 50*a* do not rub against the bearing catching portion 82*a* and 92*a* of the lateral plate 82 and 92 of the apparatus main assembly 100*a*, which are formed of thin steel plate or the like. Therefore, the main assembly contacting portions 40*a* and bearing catching portion 82*a* do not shave each other, and the main assembly contacting portion 50*a* (cartridge positioning portion) and bearing catching portion 92*a* do not shave each other.

As described above, the cartridge 7 and apparatus main assembly 100*a* in this embodiment are structured so that when the cartridge 7 is mounted or removed, the pressure applied to the cartridge 7 (bearings 40 and 50) by the bearing pressing portions of the bearing pressing members (cartridge positioning member), is cancelled by the combination of the bearing pressing member pressing portions of the cartridge 7 (bearing 40 and 50), and the bearing catching portions of the bearing pressing members, which are located farther from the rotational axes of the bearing pressing members than the bearing pressing portions of the bearing pressing member. Therefore, the amount of force necessary to mount or remove the cartridge 7 is sufficiently smaller than the amount of load to which the cartridge 7 is subjected by the bearing pressing members of the apparatus main assembly 100*a* when the cartridge 7 is mounted or removed. In other words, this embodiment can significantly reduce the amount of force necessary for the operation to mount or removed the cartridge 7, making it possible to provide an electrophotographic image forming apparatus which is significantly superior to a conventional electrophotographic image forming apparatus, in terms of the cartridge mounting or removing operation.

Further, the main assembly contacting portions of the bearings (cartridge 7) and the cartridge contacting portion of the apparatus main assembly 100*a* are prevented from being shaved by their counterparts when the cartridge 7 is mounted into, or removed from, the apparatus main assembly 100*a*. Therefore, it is ensured that the cartridge 7 is accurately positioned relative to the apparatus main assembly 100*a* throughout its service life.

Further, the image forming apparatus in this embodiment is structured so that the cartridge compartments are horizontally juxtaposed in tandem, and the intermediary transfer unit is placed above the space for the cartridge compartments, in order to make it possible to press the cartridges from below by the bearing pressing members to accurately position the cartridges relative to the main assembly of the image forming apparatus. However, this embodiment is not intended to limit the present invention in terms of the structure of an image forming apparatus. That is, the present invention is also applicable to an image forming apparatus in which its intermediary transfer unit is under its cartridge compartments so that the cartridges are to be pressed downward by the bearing pressing members. In the case of this structural arrangement, the photosensitive drums 1 are placed in contact with the intermediary transfer belt 5 by pressing the cartridges 7 downward.

In the case of an electrophotographic image forming apparatus, such as the one in this embodiment, which is structured so that the cartridges are pressed from below, the amount of force necessary to accurately position the cartridges must be set in consideration of the weight of each cartridge. Thus, in terms of the amount of force necessary to accurately position the cartridges, an electrophotographic image forming apparatus structured as the one in this embodiment is greater than an image forming apparatus structured so that the cartridges are pressed downward for positioning. That is, the former is greater than the latter, in the amount of force necessary to press the bearing pressing members. Therefore, the effects of the present invention can be enhanced by structuring an electrophotographic image forming apparatus, like the one in this embodiment, so that when a cartridge is mounted or removed, the pressure (pressing force) applied to the cartridge by the bearing pressing portions (cartridge pressing portions) of the bearing pressing members is cancelled by the combination of the bearing pressing member pressing portions of the bearings of the cartridge, and the bearing catching portions of the bearing pressing members, which are located farther from the rotational axis of the bearing pressing member than the bearing pressing portions of the bearing pressing members.

Further, in this embodiment, it is at both the front and rear ends of the apparatus main assembly 100*a* in terms of the cartridge mounting direction that when the cartridge is mounted or removed, the pressure applied to a cartridge by the bearing pressing portion of the bearing pressing member is cancelled by the combination of the bearing pressing member pressing portion of the bearing of the cartridge, and the bearing catching portion of the bearing pressing member, which is located farther from the rotational axis of the bearing pressing member than the bearing pressing portion of the bearing pressing member is. However, this embodiment is not intended to limit the present invention in terms of the structure of an image forming apparatus. That is, the present invention is also applicable to an electrophotographic image forming apparatus having only one bearing pressing member (cartridge pressing member), which is located at the front or rear end of the apparatus in terms of the cartridge mounting direction. However, providing both the front and rear ends of the main assembly of an image forming apparatus with a bearing pressing member (portion) can reduce the total amount of load to which the cartridge is subjected when it is mounted or removed. Further, providing both the front and rear ends of each cartridge compartment of an image forming apparatus with a bearing pressing member, and structuring the image forming apparatus so that the direction in which the cartridge is pressed upward by the bearing pressing member on the front end of the apparatus is symmetrical to the direction in which the cartridge is pressed upward by the bearing pressing member on the rear end of the apparatus, with respect to the axial line of the photosensitive drum, make it possible to keep the cartridge 7 stable in attitude when the cartridge 7 is mounted or removed.

(Mechanism for Keeping Development Roller Separated from Photosensitive Drum when Cartridge is in Apparatus Main Assembly)

Figure 13:
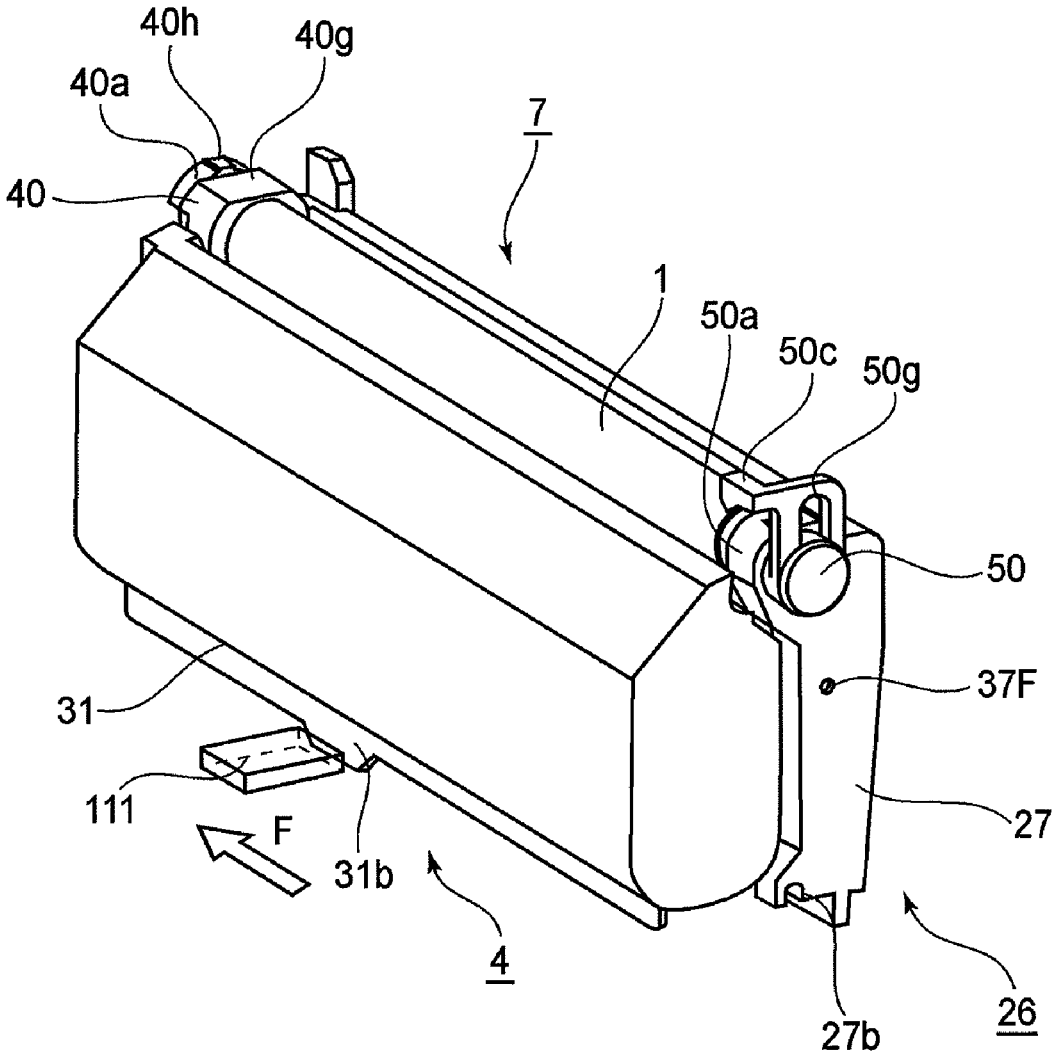
FIG. 13 is an external perspective view of the cartridge in the first embodiment.
Figure 15:
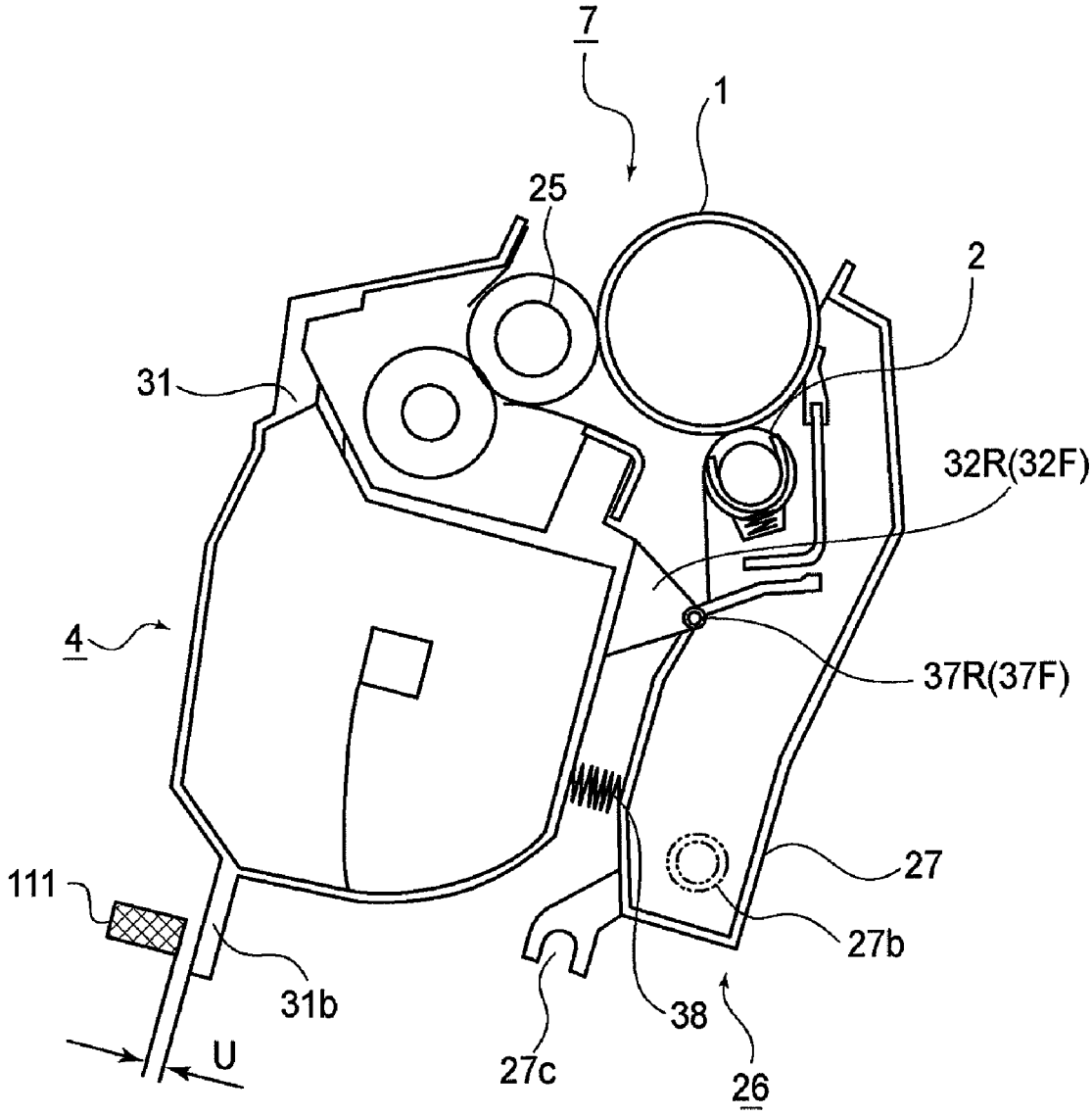
FIG. 15 is a schematic sectional view of the cartridge in the first embodiment, which is in its image forming position in the main assembly of the image forming apparatus, and the development roller of which is in contact with photosensitive drum of the cartridge.
Figure 16:
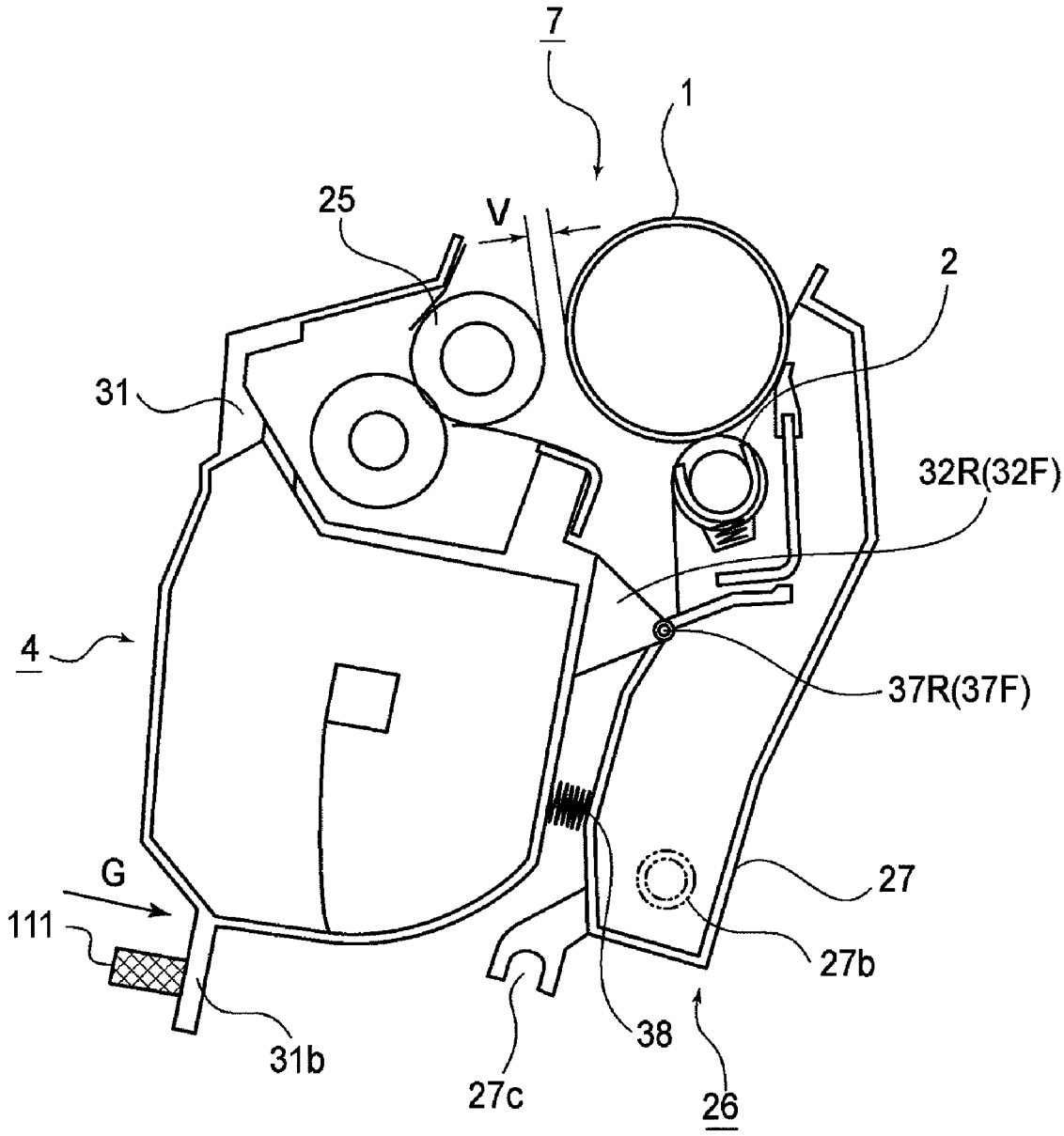
FIG. 16 is a schematic sectional view of the cartridge in the first embodiment, which is in its image forming position in the main assembly of the image forming apparatus, and the development roller of which is holding a preset amount of distance from the photosensitive drum of the cartridge.

Next, referring to FIGS. 13, 15, and 16, the mechanism for keeping separated the photosensitive drum 1 and development roller 25 in the cartridge 7 in accordance with the present invention, will be described. FIG. 13 is an external perspective view of the cartridge, and FIG. 15 is a schematic sectional view of the cartridge in the first embodiment, which has been accurately positioned in the main assembly of the image forming apparatus, and the development roller of which is in contact with photosensitive drum of the cartridge 7. FIG. 16 is a schematic sectional view of the cartridge 7 in the first embodiment, which has been accurately positioned in the main assembly of the image forming apparatus, and the development roller of which has been separated from the photosensitive drum of the cartridge.

In the first embodiment described above, the development roller 25 develops an electrostatic latent image, with the use of developer, while remaining in contact with the photosensitive drum 1. Further, when the development roller 25 is not used for development, it is kept separated from the photosensitive drum 1 as necessary.

Thus, the image forming apparatus 100 in this embodiment is structured so that the development roller 25 can be separated from the photosensitive drum 1.

More specifically, the apparatus main assembly 100*a* is provided with a development roller separating member 111 (development roller separating force applying portion), which is located in a preset position in the apparatus main assembly 100*a*, in terms of the direction in which the cartridge 7 is inserted into the apparatus main assembly 100*a* (FIGS. 13 and 15). The development roller separating member 111 is movable between a cartridge pressing position and a retreat position. The cartridge pressing position is the position in which the development roller separating member 111 presses on the development roller separating member catching portion 31*b* (which will be described later) of the cartridge 7. The retreat position is a preset distance away from the cartridge pressing position. The development roller separating member 111 separates the development roller 25 from the photosensitive drum 1 against the pressure applied to the development unit 4.

The development roller separating member 111 is a part of the apparatus main assembly 100*a*, and is moved between the abovementioned cartridge pressing position (FIG. 15) and retreat position (FIG. 16), by a cam (unshown) rotated by the rotational force from a motor (unshown) which rotates in response to a separation signal.

The above-mentioned pressure is the combination of the force generated by the compression springs 38 (elastic member) (FIGS. 2, 15, and 16) and the force generated by the tension springs (elastic members) (unshown). In terms of the cartridge mounting direction F, the compression spring 38 is at the downstream end of the cartridge 7, remaining compressed between the development unit 4 and the drum unit 26, and the tension spring is at the upstream end of the cartridge 7, remaining stretched by the development unit 4 and drum unit 26. Both the resiliency of the compression spring 38 and the resiliency of the tension spring generate force in the direction to keep the two units 4 and 26 pressed toward each other. One development roller separating member 111 is provided for each of the four cartridges 7 (7*a*-7*d*), which use yellow, magenta, cyan, and black toners, respectively.

The development unit 4 is provided with the development roller separating member catching portion 31*b* (development roller separation force receiving portion), which the development roller separating member 111 presses when it separates the development roller 25 from the photosensitive drum 1. The development roller separating member catching portion 31*b* is on the bottom surface of the development unit frame 31. On the other hand, the drum unit 26 is provided with a pair of shafts 27*b* and a pair of holes 27*c*, which are for regulating the rotational movement of the cartridge 7, which occurs as the cartridge 7 receives the force for rotating the photosensitive drum 1, the development roller 25, etc., from the apparatus main assembly 100*a*, and also, as the development roller separating member catching portion 31*b* is pressed by the development roller separating member 111. That is, each of the end walls of the drum unit 26 in terms of the cartridge mounting direction F is provided with the shaft 27*b* and groove 27*c*. The shaft 27*b* is the cartridge rotation regulating first portion of the cartridge 7, and the groove 27*c* is the cartridge rotation regulating second portion of the cartridge 7. As the cartridge 7 is mounted into the apparatus main assembly 100*a*, the shaft 27*b* engages into the cross-sectionally elongated hole 82*b* (cartridge rotation regulating first portion) (FIG. 5) of the apparatus main assembly 100*a*, and the shaft 92*c* (cartridge rotation regulating second portion) (FIG. 5) of the apparatus main assembly 100*a* engages into the groove 27*c* of the cartridge 7.

The above described structural arrangement makes it possible to accurately position the front and rear sides of the cartridge 7 relative to the apparatus main assembly 100*a*, and also, to cause the cartridge rotation regulating portions of the cartridge 7 to engage with the cartridge rotation regulating portions of the apparatus main assembly 100*a*, simply by mounting the cartridge 7 into the apparatus main assembly 100*a*, even in the case of an image forming apparatus structured so that the cartridge 7 is to be mounted into the apparatus main assembly 100*a* in the direction parallel to the axial line of the photosensitive drum 1. That is, the above described structural arrangement ensures that the cartridge 7 is accurately positioned relative to the apparatus main assembly 100*a*, in spite of its simplicity.

Also in this embodiment, the portions of the cartridge 7, which are for regulating the rotation of the cartridge 7, which occurs as the cartridge 7 receives the force for rotating the photosensitive drum 1 and the development roller 25 from the apparatus main assembly 100*a*, are the same as the portions of the cartridge 7, which are for regulating the rotation of the cartridge 7, which occurs as the cartridge 7 receives the force for separating the development roller 25 from the photosensitive drum 1. That is, the cartridge rotation regulating portions of the cartridge 7 are the shaft 27*b* and the groove 27*c*, whereas the cartridge rotation regulating portions of the apparatus main assembly 100*a* are the cross-sectionally elongated hole 82*b*, and the shaft 92*c*.

Figure 17:
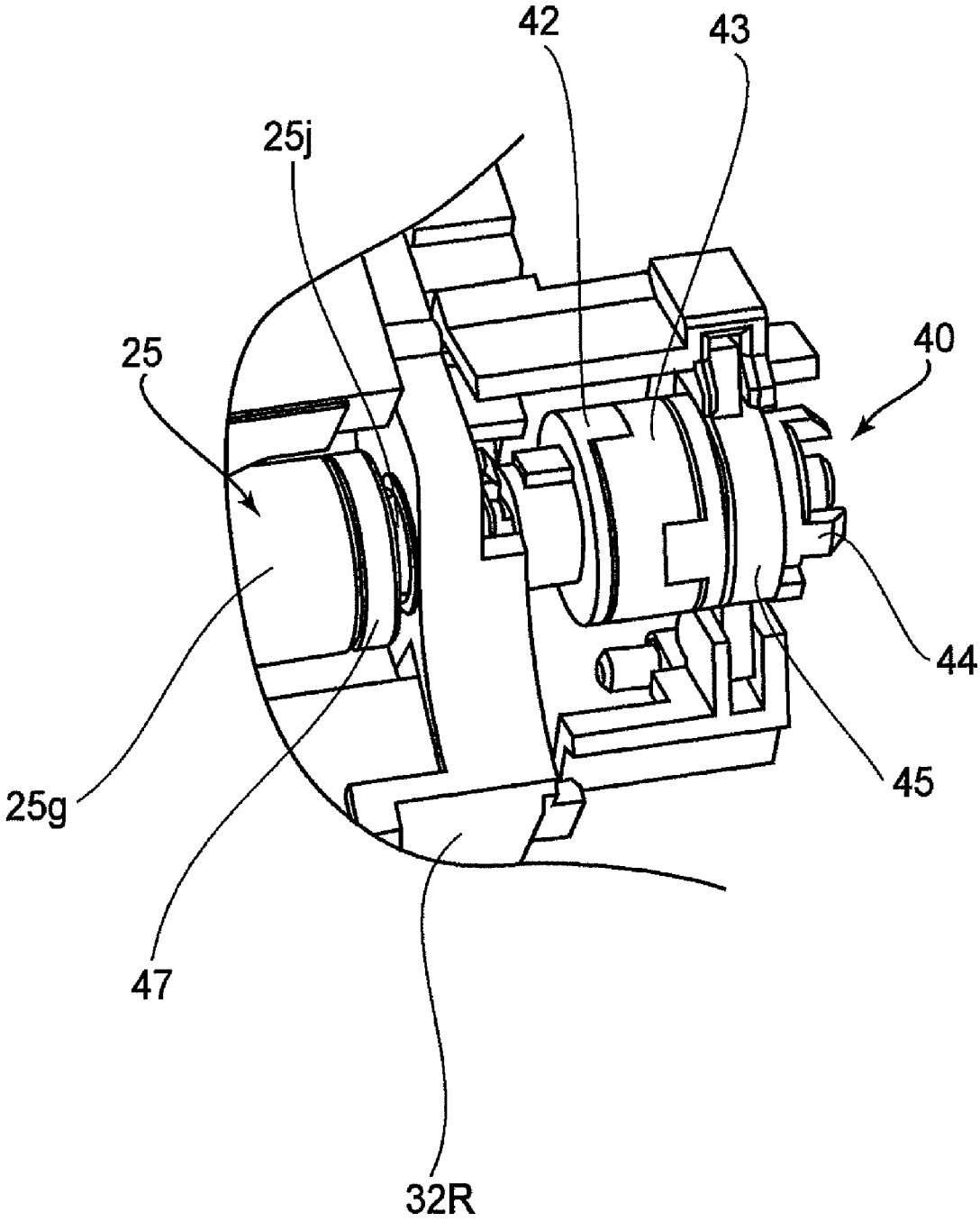
FIG. 17 is a schematic drawing for describing the development roller supporting portion of the cartridge in the first embodiment, showing the structure of the portion.

Referring to FIG. 16, when the apparatus main assembly 100*a* is not in action, the development roller separating member 111 is in the cartridge pressing portion. More specifically, as the apparatus main assembly 100*a* is stopped, the motor (unshown) is rotated in response to the development roller separation signal, moving the development roller separating member 111 in the direction indicated by an arrow mark G. Thus, the development roller separating member catching portion 31*b* of the development unit 4 is pressed in the direction indicated by the arrow mark G by the development roller separating member 111. At this point of the operation, the shaft 27*b* of the drum unit 26 is in the cross-sectionally elongated hole 82*b* of the apparatus main assembly 100*a*, and the shaft 92*c* of the apparatus main assembly 100*a* is in the groove 27*c* of the drum unit 26. Therefore, when the development unit 4 is pressed by the development roller separating member 111 in the direction indicated by the arrow mark G, the drum unit 26 does not move in the direction indicated by the arrow mark G. Therefore, the development unit 4 rotates about the shafts 37 (37R and 37F), that is, the shafts which connect the development unit 4 and drum unit 26. As a result, the development roller 25 is separated from the photosensitive drum 1 by a distance V, shown in FIG. 16, and remains separated by the distance V (FIG. 16). Therefore, even if the cartridge 7 is left unused for a long time in the apparatus main assembly 100*a*, the elastic layer of the development roller 25 does not deform. Therefore, the problem that the deformation of the elastic layer of the development roller 25 results in the formation of an image which is nonuniform in density does not occur. As described previously, the development roller 25 is made up of a core and a cylindrical rubber layer (elastic layer) fitted around the core (FIG. 17). Therefore, if the development roller 25 is left in contact with the photosensitive drum 1 for a long time, the cylindrical rubber layer is liable to sustain a compressional scar.

The shafts 37R and 37F are at one of the lengthwise end of the cartridge 7 and the other, respectively.

Also referring to FIG. 16, the cartridge 7 is designed so that after it is properly mounted in the apparatus main assembly 100*a*, the photosensitive drum 1 and the development roller 25 are above the horizontal plane which coincides with the axial line of the shaft 37, and the development roller separating member catching portion 31*b* is below the same plane, and also, so that the shaft 27*b* is at the bottom end of one of the lengthwise end of the drum unit 26, and the groove 27*c* is in the bottom end portion of the other (rear) lengthwise end of the drum unit 26. Therefore, it is ensured that when the development roller separating member catching portion 31*b* is pressed by the development roller separating member 111, the movement of the drum unit 26 is regulated by the cross-sectionally elongated hole 82, and the shaft 92*c*.

Further, the cartridge 7 is designed so that after the proper mounting of the cartridge 7 into the apparatus main assembly 100*a*, the development roller separating member catching portion 31*b* projects downward of the development unit 4 (FIG. 16). Therefore, there is a substantial distance between the point at which the development roller separating member catching portion 31*b* receives the pressure from the development roller separating member 111, and the shaft 27*b*, enhancing the force (pressure) applied to the development roller separating member catching portion 31*b*.

Further, in terms of the cartridge mounting direction F, the shaft 27*b* is at the leading end of the cartridge 7, and the groove 27*c* is at the trailing end, being in the portion of the development unit 4, which protrudes downward (FIGS. 15 and 16). Therefore, when the cartridge 7 is mounted into the apparatus main assembly 100*a* so that its lengthwise direction is parallel to its mounting direction, the cross-sectionally elongated hole 82*b* and the shaft 92*c* of the apparatus main assembly 100*a* do not interfere with the mounting of the cartridge 7. Incidentally, the groove 27*c* is not shown in FIG. 2, but, is shown in FIGS. 5 and 13.

As seen from the rear end of the cartridge 7 in terms of its lengthwise direction, the rotational direction of the photosensitive drum 1 is clockwise (indicated by arrow mark Q), and the rotational direction of the development roller 25 is counterclockwise (indicted by arrow mark B). Further, the rotational direction of the toner supply roller 34 is counterclockwise (indicated by arrow mark C) (FIG. 2).

As an image forming operation is initiated by a print start signal, the abovementioned motor rotates in synchronism with the development operation starting timing, and the development roller separating member 111 moves into the retreat position (FIG. 15), creating a distance U between the development roller separating member catching portion 31*b* and the development roller separating member 111. Thus, the development roller 25 is placed in contact with the photosensitive drum 1, being readied for image formation, by a preset amount of pressure, that is, the combination of the force (pressure) applied by the compression spring 38 and the force (pressure) applied by the tension spring (unshown).

In this embodiment, the development roller separating member catching portion 31*b* is on the bottom surface of the development unit frame 31, and is on the opposite side from the development roller 25 with respect to the shafts 37 (37R and 37F), the axial line of which coincides with the rotational axis of the development unit 4. Further, the distance between the development roller separating member catching portion 31*b* and the shaft 37 is greater than the distance between the development roller 25 and the shaft 37. It should be noted here that the positioning of the development roller separating member catching portion 31*b* does not need to be limited to the one in this embodiment. However, positioning the development roller separating member catching portion 31*b* on the opposite side from the development roller 25 with respect to the shaft 37, and farther from the shaft 37 than the development roller 25, makes it possible to reduce the amount of force necessary to separate the development roller 25 from the photosensitive drum 1. Therefore, positioning the development roller separating member catching portion 31*b* on the opposite side from the development roller 25 with respect to the shaft 37, and farther from the shaft 37 than the development roller 25, can reduce the amount of load to which the development roller separating member 111 is subjected when the development roller 25 is separated.

(Structural Arrangement for Inputting Driving Force into Cartridge in Apparatus Main Assembly)

Next, referring to FIGS. 17-21, the portion of the structure of the apparatus main assembly 100*a*, which is for inputting a driving force into the cartridge 7 in the apparatus main assembly 100*a* will be described.

FIG. 17 is a schematic drawing of one end (rear end) of the development roller 25 in terms of the lengthwise direction of the development roller 25.

Referring to FIG. 17, the shaft 25*j* of the development roller 25 is rotatably fitted in the center hole of the bearing 32R, being in contact with the bearing 32R. There is a spacer roller 47 between the rubber roller portion 25*g* of the development roller 25 and the bearing 32R, being rotatably fitted around the shaft 25*j*. The spacer roller 47 is for regulating in size the area of contact between the development roller 25 and photosensitive drum 1. Although described above is the development roller supporting structure of the rear end portion of the cartridge 7 in terms of the lengthwise direction of the development roller 25, the development roller supporting structure on the front end portion is the same as that of the rear end portion. That is, the other end portion of the shaft 25*j* is rotatably fitted in the center hole of the development roller bearing portion, which is an integral part of the development roller bearing member 32L.

In this embodiment, an Oldham's coupling 41, one of various couplings compatible with this embodiment, is used as the coupling (development roller coupling of cartridge, development roller rotating force receiving portion of cartridge) of the mechanism for inputting a development roller driving force into the cartridge 7.

Next, referring to FIGS. 18 and 19, the structure of Oldham's coupling 41 will be described. In order to make it easier to describe the structure of the Oldham's coupling, FIGS. 18 and 19 do not show the development roller bearing member 32R.

Figure 18:
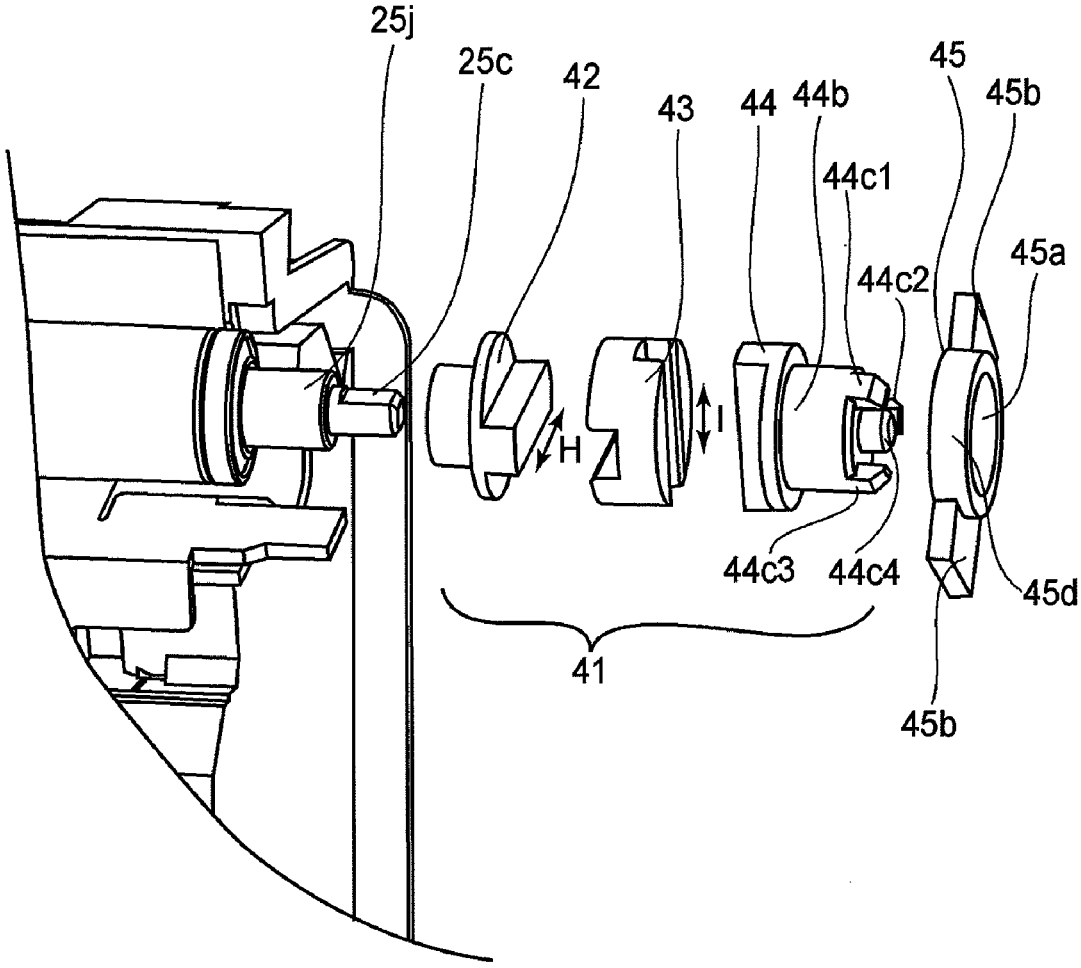
FIG. 18 is an exploded view of the development roller coupling and coupling bearing 45 of the cartridge in the first embodiment.
Figure 19:
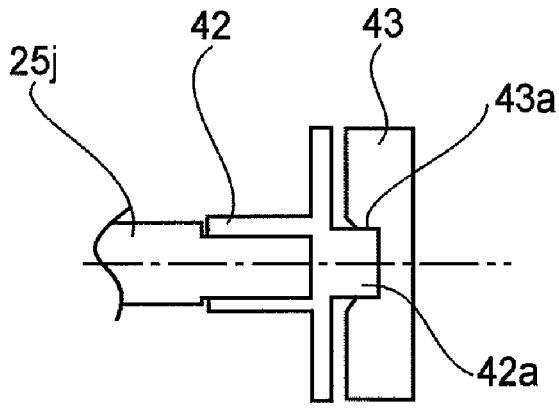
FIG. 19 is a sectional view of the development roller coupling of the cartridge in the first embodiment.
Figure 19:
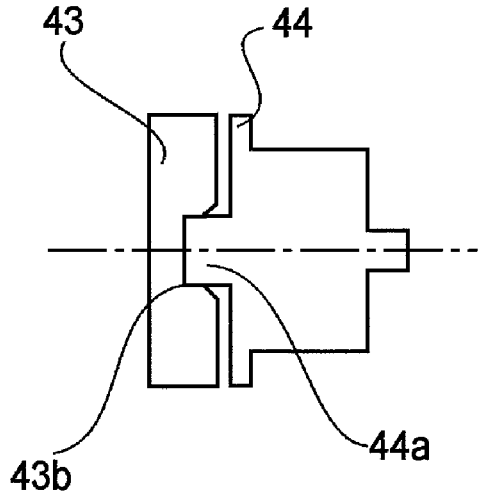

Referring to FIG. 18, the Oldham's coupling 41 has an engaging portion 42 on the development roller side, a middle engaging portion 43, and an engaging portion 44 on the apparatus main assembly side.

The engaging portion 42 is solidly attached to the end of the shaft 25*j*. As a means for solidly attaching the engaging portion 42, a spring pin, a parallel pin, etc., are available.

However, the Oldham's coupling 41 may be attached with the use of the method shown in FIG. 18. That is, the peripheral surface of the end portion of the shaft 25*j* is shaved flat (flattened portion 25*c*), and the engaging portion 42 is provided with a center hole, the cross section of which matches that of the flattened portion 25*c* so that the flatten portion 25*c* perfectly fits into the center hole of the engaging portion 42. The shaft portion 44*b* of the engaging portion 44 is fitted in the hole 45*a* of the development roller coupling (Oldham's coupling) bearing member 45 (which hereafter will be referred to simply as bearing 45), being rotatably supported by the bearing 45. Further, the engaging portion 44 is provided with multiple projections 44*c*1-44*c*4, which engage with the development roller coupling 53 (development roller rotating force transmitting portion) of the main assembly 100*a*, which is the driving force transmitting second member of the apparatus main assembly 100*a*. The projections 44*c*1-44*c*4 are integral parts of the engaging portion 44. The coupling 53 belongs to the apparatus main assembly 100*a*. The Oldham's coupling 41 can transmit the development roller driving force (second driving force) from the apparatus main assembly 100*a* to the development roller 25 while tolerating the misalignment between the axial lines of the coupling 53 and the axial line of the development roller 25. Further, the Oldham's coupling 41 can transmit the rotational force (second driving force) from the apparatus main assembly 100*a* to the development roller 25 whether the development roller 25 is in contact with the photosensitive drum 1 or not.

Next, referring to FIG. 19, the structure of the Oldham's coupling 41 will be described in detail. FIG. 19(*a*) is a sectional view of the Oldham's coupling 41, at a plane which is parallel to the direction indicated by an arrow mark H (FIG. 18) and coincides with the axial line of the Oldham's coupling 41. FIG. 19(*b*) is a sectional view of the Oldham's coupling 41, at a plane which is parallel to the direction indicated by an arrow mark I (FIG. 18) and coincides with the axial line of the Oldham's coupling 41. Referring to FIG. 19(*a*), the engaging portion 42 is provided with a tongue 42*a*, which is an integrally formed part of the engaging portion 42. The engaging portion 43 is provided with a groove 43*a*. The tongue 42*a* is fitted in the groove 43*a* so that the former can moved in the direction indicated by the arrow mark H (FIG. 18). Next, referring to FIG. 19(*b*), the engaging portion 44 is provided with a tongue 44*a*, which is an integral part of the engaging portion 44. The engaging portion 43 is provided with a groove 43*b*. The tongue 44*a* is fitted in the groove 43*b* so that the former can be moved in the direction indicated by the arrow mark I (FIG. 18).

Figure 20:
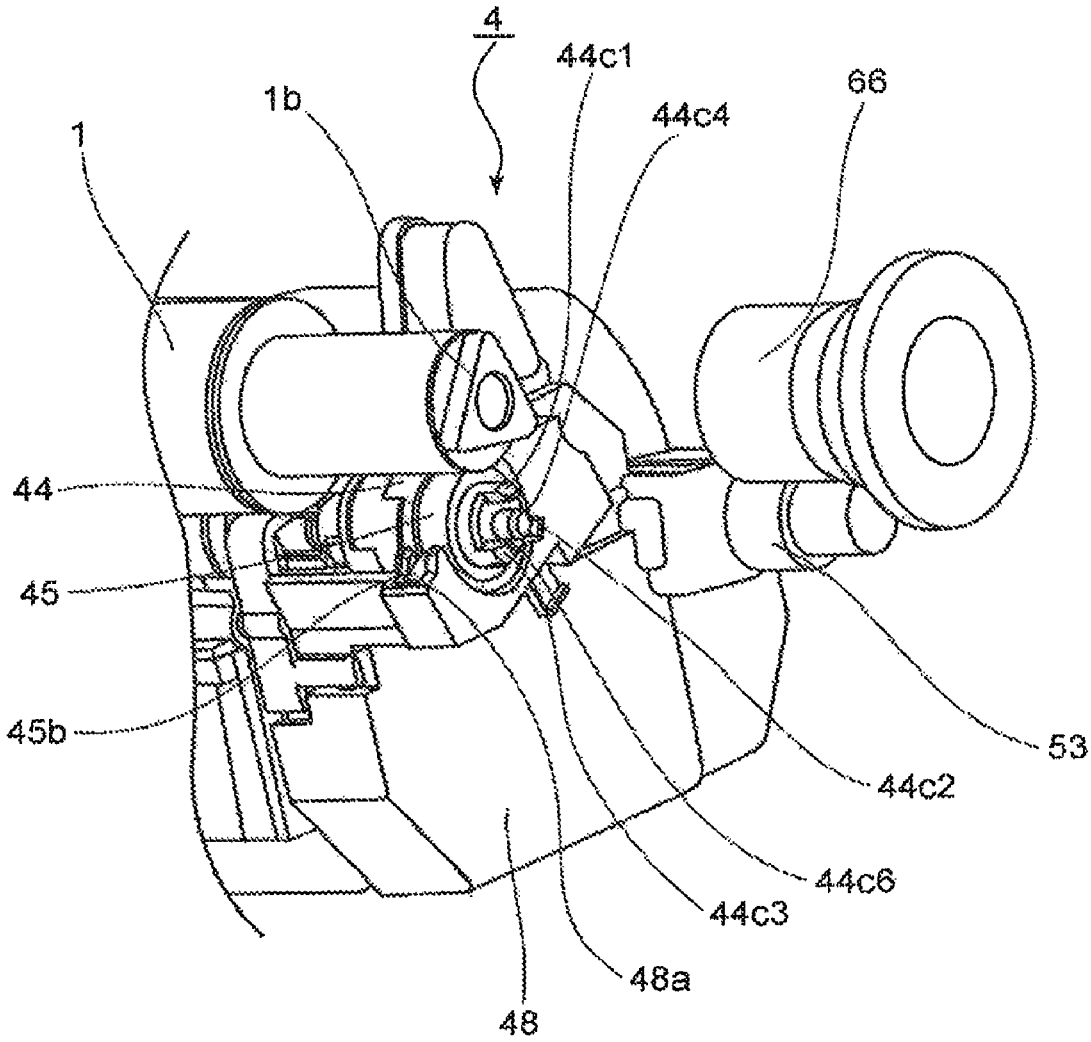
FIG. 20 is a perspective view of the couplings of the cartridge, and the couplings of the main assembly of the image forming apparatus, in the first embodiment.

FIG. 20 is a drawing for showing the structure of the couplings with which the cartridge 7 is provided.

The end surface of the engaging portion 44 of the Oldham's coupling 41 of the development unit 4 is provided with multiple projections 44*c*1-44*c*3, which project in parallel to the axial line of the Oldham's coupling 41. It is also provided with a centering boss 44*c*4 for aligning the axial line (rotational axis) of the Oldham's coupling 41 with the axial line of the coupling 53. The centering boss 44*c*4 projects from the end surface of the engaging portion 44 in the direction parallel to the axial line of the Oldham's coupling 41. On the other hand, one end of the photosensitive drum 1 in terms of the direction of its axial line has a drum coupling 1*b* (drum coupling of cartridge), which is in the form of a twisted triangular prism. Further, the guide portion 45*b* of the bearing 45 is fitted in the groove 48*a* of a side cover 48, and is guided by the groove 48*a*. The direction in which the guide portion 45*b* is guided is perpendicular to the axial line of the development roller 25. The side cover 48 is fixed to the development unit 4 with the use of small screws or the like (unshown). Thus, the engaging portion 44 is allowed to move in the direction perpendicular to the lengthwise direction of the development unit 4.

Figure 21:
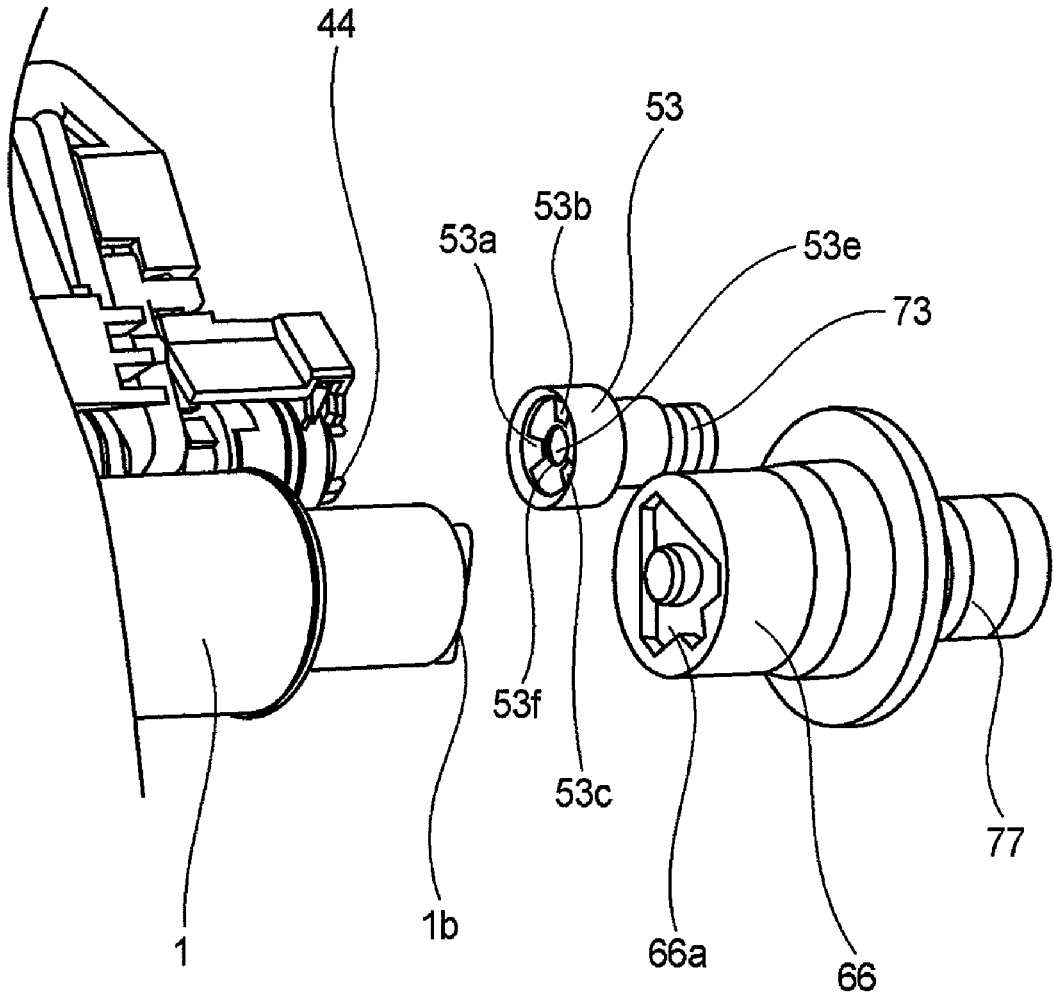
FIG. 21 is a perspective view of the cartridge driving first and second members of the main assembly of the image forming apparatus in the first embodiment.

FIG. 21 is a perspective view of the driving force transmitting couplings with which the apparatus main assembly 100*a* is provided, and shows the structure of the couplings.

Referring to FIG. 21, a coupling 66 (drum driving force transmitting coupling of apparatus main assembly, drum rotating force transmitting portion), which is for transmitting the rotational force from the apparatus main assembly 100*a* to the photosensitive drum 1, has a hole 66*a*, which is roughly triangular in cross section. More specifically, the hole 66*a* of the coupling 66 is roughly in the form of a triangular prism having multiple apexes (in cross section). Further, the coupling 53 (development roller driving force transmitting coupling of the main assembly, development roller driving force transmitting portion), which is for transmitting the rotational force (second rotationally driving force) from the apparatus main assembly 100*a* to the development roller 25, is provided with multiple holes 53*a*-53*c* (recesses). The coupling 66 is kept pressed toward the cartridge 7 by a pressing member 77, such as a compression spring. The coupling 66 is allowed to move in the direction parallel to the axial line of the photosensitive drum 1. If the coupling 1*b* is not in alignment with the hole 66*a* of the coupling 66 when the coupling 1*b* comes into contact with the coupling 66, the coupling 66 retreats by being pushed by the coupling 1*b*. Then, as the coupling 66 is rotated, the coupling 1*b* becomes aligned with the hole 66*a* of the coupling 66, and therefore, is allowed to engage with the coupling 66.

As a result, the rotational force is transmitted to the photosensitive drum 1 from the apparatus main assembly 100*a* through the couplings 66 and 1*b*.

The coupling 53 is kept pressed toward the cartridge 7 by a pressing member 73, such as a compression spring, in the direction parallel to the axial line of the photosensitive drum 1. However, the coupling 53 is attached to the apparatus main assembly 100*a* in such a manner that no play is provided for the coupling 53 in terms of the direction perpendicular to the axial line of the development roller 25. That is, the only direction in which the coupling 53 is allowed to move, besides the direction in which it is rotatable, is the direction parallel to its axial line.

As the cartridge 7 is inserted into the apparatus main assembly 100*a*, the engaging portion 44 comes into contact with the coupling 53. Sometimes, however, the projections 44*c*1-44*c*3 are not in alignment with the holes 53*a*-53*c* (recesses). In such a case, the ends of the projections 44*c*1-44*c*3 contact the portions of the coupling 53 other than the holes 53*a*-53*c* (recesses). Thus, the coupling 53 retreats against the pressure (elastic force) applied thereto by the pressing member 73, in the direction parallel to the axial line of the coupling 53. However, as the projections 44*c*1-44*c*3 become aligned with the holes 53*a*-53*c* (recesses) due to the rotation of the coupling 53, the coupling 53 advances by being under the pressure applied thereto by the pressing member 73, causing the projections 44*c*1-44*c*3 to engage into the holes 53*a*-53*c*, and also, causing the centering boss 44*c*4 (rotational force receiving member positioning portion) to fit into the centering hole 53*e* (rotational force transmitting member positioning portion). As a result, the axial line (rotational axis) of the engaging portion 44 and that of the coupling 53 align with each other, and the rotational force is transmitted to the development roller 25 from the coupling 53.

While the rotational force (first and second rotational forces) is transmitted to the cartridge 7, the shaft 27*b* (FIG. 4)

of the drum unit 26 is in the cross-sectionally elongated hole 82*b* (FIG. 5) of the apparatus main assembly 100*a*, and the shaft 92*c* (FIG. 5) of the apparatus main assembly 100*a* is in the groove 27*c* (FIG. 3) of the drum unit 26, which is U-shaped in cross section. Thus, the rotational movement of the cartridge 7, which occurs as the rotational force is transmitted from the apparatus main assembly 100*a* to the cartridge 7 is regulated.

The rotational force, which is transmitted to the cartridge 7 through the couplings 66 and 53, is provided by a motor, or motors, located in the apparatus main assembly 100*a*; the apparatus main assembly 100*a* may be provided with four motors so that each cartridge 7 is driven by the motor dedicated thereto, or only a single motor so that the four cartridges 7 are driven by the same motor.

(Action of Oldham's Coupling During Development Roller Separation in Cartridge)

Next, referring to FIGS. 22-25, the action of the Oldham's coupling 41, which occurs when the development roller 25 of the cartridge 7 in the first embodiment of the present invention is separated from the photosensitive drum 1, will be described.

Figure 22:
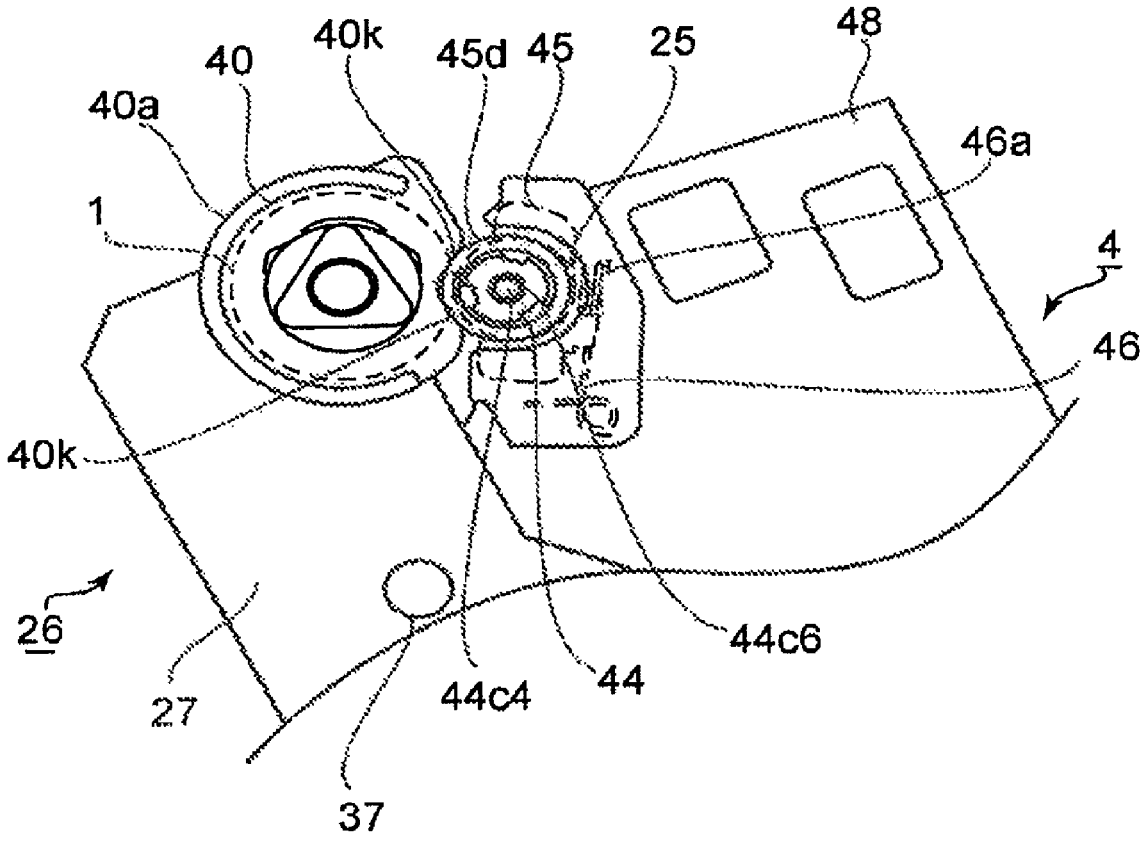
FIG. 22 is a schematic drawing for describing the movement of the couplings of the cartridge in the first embodiment, which occurs when the development roller is separated from the photosensitive drum.
Figure 23:
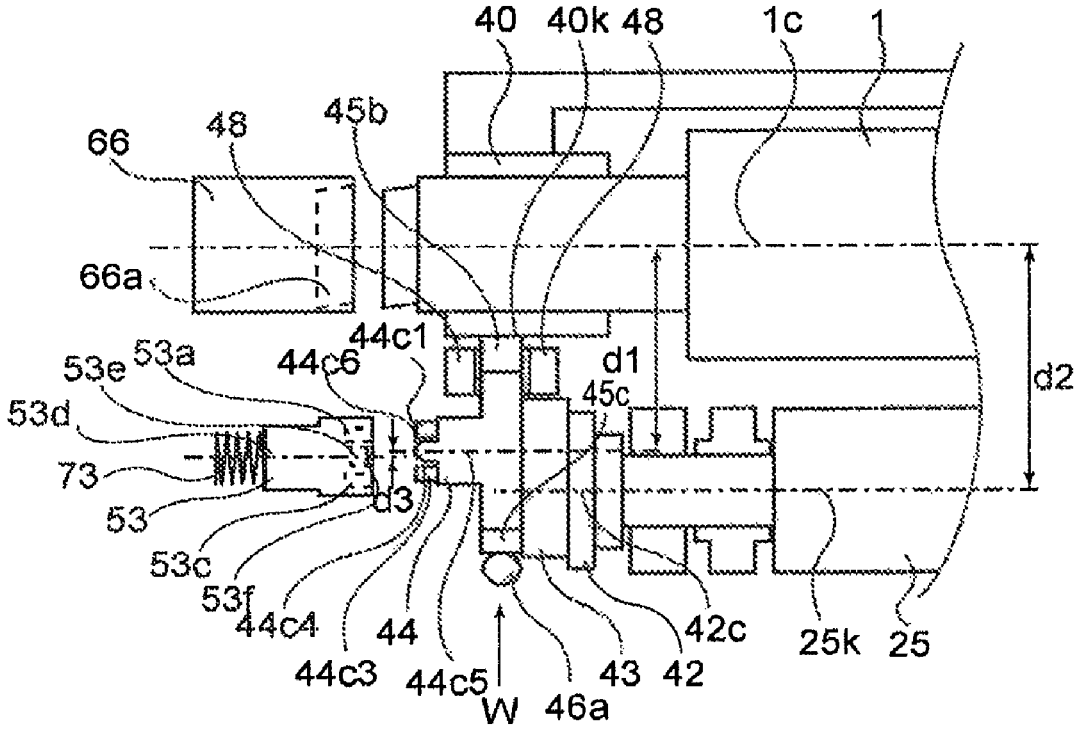
FIG. 23 is a schematic drawing for describing the movement of the couplings of the cartridge in the first embodiment, which occurs when the development roller is separated from the photosensitive drum.

FIG. 22 is a side view of the cartridge 7 when there is a preset amount of a gap between the development roller 25 and the photosensitive drum 1. FIG. 23 is a sectional view of the lengthwise end portion of the cartridge 7 having the coupler 44, when there is a preset amount of a gap between the development roller 25 and the photosensitive drum 1, at a plane which coincides with the axial line of the development roller 25 and photosensitive drum 1.

Referring to FIG. 22, when the apparatus main assembly 100*a* is not in operation, the development roller 25 (outlined with a broken line) remains separated from the photosensitive drum 1 (outlined with a broken line). When the cartridge 7 is in the condition shown in FIG. 22, the arm portion 46*a* of the torsional coil spring 46 (pressure applying member) located in the side cover 48 is in contact with the engaging portion 45*c* of the coupling bearing 45, and keeps the engaging portion 45*c* pressed. Therefore, the engaging portion 44 remains pressed in the direction (indicated by arrow mark W in FIG. 23) perpendicular to the axial line of the development roller 25, and the contacting portion 45*d* of the coupling bearing 45 remains in contact with the contacting portion 40*k* (holding portion) of the drum bearing 40, that is, the photosensitive drum bearing rear member. Therefore, the coupling bearing 45 is kept accurately positioned. That is, the engaging portion 44 is kept in a preset position. The contacting portion 40*k* of the drum bearing 40 is V-shaped is cross section; it has two surfaces which are parallel to the axial line of the photosensitive drum 1. The coupling bearing 45 is placed in contact with the contacting portion 40*k*, whereby the coupling bearing 45 is held so that its axial line remains parallel to the axial line of the photosensitive drum 1.

The drum bearing 40 is provided with the aforementioned main assembly contacting portion 40*a*, which is formed as an integral part of the drum bearing 40. Therefore, the engaging portion 44, which is rotatably supported by the coupling bearing 45, is accurately positioned relative to the lateral plate 82, relative to which the main assembly contacting portion 40*a* is positioned. The lateral plate 82 is a part of the apparatus main assembly 100*a*. Therefore, the engaging portion 44 is accurately positioned also relative to the axial line 53*d* of the coupling 53. The engaging portion 44 of the Oldham's coupling 41 is rotatably borne by the coupling bearing 45. In this state, therefore, the axial line 44*c*5 of the engaging portion 44 is not in alignment with the axial line 53*d* of the development roller 25. Further, the axial line 44*c*5 is closer to the axial line 53*d* than the axial line 25*k* of the development roller 25 is. That is, where the engaging portion 44 is positioned is where the engaging portion 44 can smoothly engage with the coupling 53 as the cartridge 7 is inserted into the apparatus main assembly 100*a*. In this embodiment, the torsional coil spring 46 (pressure applying member) is used as the member for applying pressure to the coupling bearing 45. However, the member for applying pressure does not need to be in the form of a torsional coil spring. For example, the coupling bearing 45 may be provided with an elastically deformable portion, which is integral with the coupling bearing 45 so that the coupling bearing 45 is kept pressed upon the contacting portion 40*k*.

Next, referring to FIG. 23, the action of the Oldham's coupling will be described in more detail.

The image forming apparatus 100 in this embodiment is structured so that as the engaging portion 44 is rotated by the coupling 53 by becoming engaged with the coupling 53, it is positioned by the coupling 53, as will be described later. In other words, when the cartridge 7 is mounted into the apparatus main assembly 100*a*, the contacting portion 45*d* is not in contact with the contacting portion 40*k*. Therefore, when the advancement of the cartridge 7 into the apparatus main assembly 100*a* begins to cause the engaging portion 44 to engage with the coupling 53, the axial line 44*c*5 of the engaging portion 44 is offset relative to the axial line of the coupling 53 by a distance d3 toward the photosensitive drum 1. Thus, as the cartridge 7 is advanced further into the apparatus main assembly 100*a*, the chamfered portion 44*c*6 (FIG. 20) of the centering boss 44*c*4 comes into contact with the chamfered edge 53*f* (FIG. 21) of the hole 53*e*. Therefore, the coupling 53 and 44 engage with each other while compensating for the misalignment between their axial lines.

When the coupling 53 and engaging portion 44 are in the state shown in FIG. 23, there is a gap between the development roller 25 and photosensitive drum 1. In this state, the axial line of the engaging portion 44 is not in alignment with the axial line 25*k* of the development roller 25, as described above. That is, the distance d1 between the axial line 1*c* (rotational axis) of photosensitive drum 1 and the axial line 44*c*5 of the engaging portion 44 is smaller than a distance d2 between the axial line 1*c* of the photosensitive drum 1 and the axial line 25*k* of the development roller 25. Therefore, the engaging portion 44 is closer to the photosensitive drum 1 than to the development roller 25.

Further, even when there is a gap between the development roller 25 and the photosensitive drum 1, the engaging portion 43 is in engagement with the engaging portion 44 and 42. Therefore, even while the development roller 25 moves between the position in which it is in contact with the photosensitive drum 1 and the position in which it is held a preset distance from the photosensitive drum 1, the engaging portion 43 is allowed to move while remaining in engagement with the engaging portion 44 and 42.

Also when the coupling 53 and engaging portion 44 are in the state shown in FIG. 23, the engaging portion 44 is kept accurately positioned relative to the coupling 53 by the contacting portion 40*k*. Therefore, the chamfered portions 44*c*6 and 53*f* do not need to be very large, making it possible to reduce the engaging portion 44 and coupling 53 in size.

Figure 25:
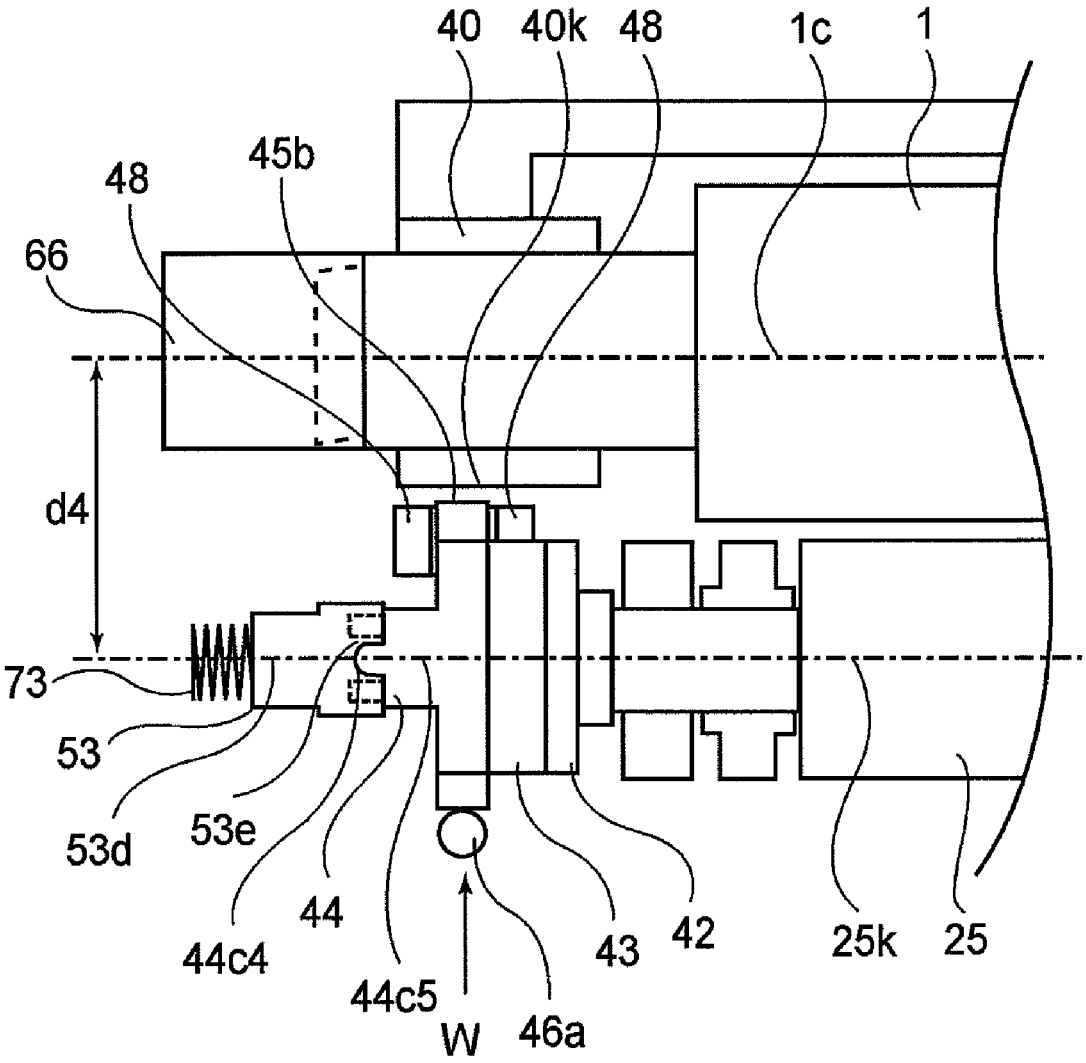
FIG. 25 is a schematic drawing for describing the movement of the couplings of the cartridge in the first embodiment, which occurs when the development roller is placed in contact with the photosensitive drum.

Next, referring to FIG. 25, as the rotation of the coupling 53 causes the projections 44*c*1-44*c*3 to align with the holes 53*a*-53*c* (recesses) of the coupling 53, the boss 44*c*4 fits into the hole 53*e*, causing thereby the axial line 44*c*5 of the engaging portion 44 to align with the axial line 53*d* of the coupling 53. That is, the engaging portion 44 is positioned by the coupling 53. As a result, the coupling bearing 45 becomes separated from the drum bearing 40. At this point, the distance between the axial line 1*c* of the photosensitive drum 1 and the axial line 44*c*5 of the engaging portion 44 is a distance d4, which is larger by a distance d3 than the distance d1 shown in FIG. 23; the axial line 44*c*5 of the engaging portion 44 is farther from the axial line 1*c* of the photosensitive drum 1 by d3 than when the coupling 53 and engaging portion 44 are in the state shown in FIG. 23. However, the distance between the engaging portion 44 and the photosensitive drum 1 is smaller than that between the engaging portion 44 and development roller 25.

Figure 24:
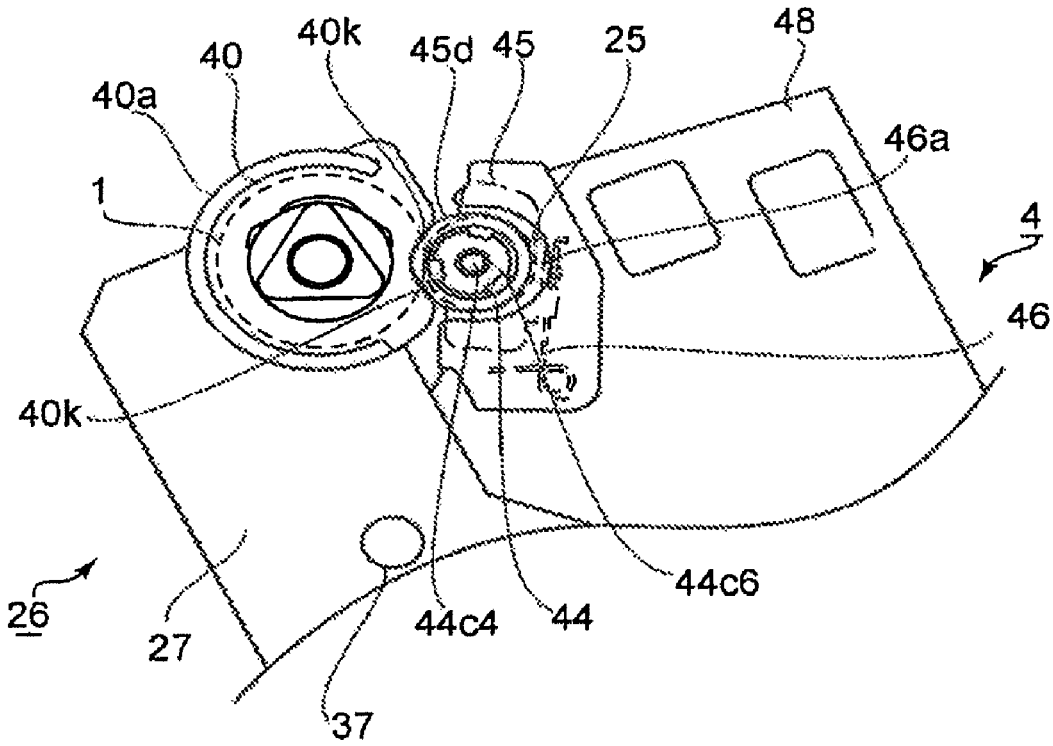
FIG. 24 is a schematic drawing for describing the movement of the couplings of the cartridge in the first embodiment, which occurs when the development roller is placed in contact with the photosensitive drum.

FIG. 24 is a side view of the cartridge 7 when its development roller 25 is in contact with its photosensitive drum 1. FIG. 25 is a sectional view of the driving force receiving end portion of the cartridge 7 when the development roller 25 is in contact with the photosensitive drum 1.

As an image forming operation is initiated, the development roller separating member 111 retreats to its preset position (retreat position), allowing the development unit 4 to rotationally move about the shaft 37, which supports the development roller supporting rear bearing 32R of the drum unit frame 27. Thus, the development roller 25 comes into contact with the photosensitive drum 1. At this point, the engaging portion 44 and the coupling 53 have already engaged with each other. Therefore, even when the development unit 4 rotationally moves, the engaging portion 44 of the Oldham's coupling 41 remains in the same position while remaining engaged with the coupling 53. That is, the engaging portion 44 does not rotationally move. Further, the engaging portion 44 and the coupling 53 are in engagement with each other, with a gap remaining between the coupling bearing 45 and the drum bearing 40, as shown in FIG. 25. Further, the axial line 25*k* of the development roller 25, the axial line 44*c*5 of the engaging portion 44, and the axial line 53*d* of the coupling 53 are roughly in alignment. The distances from the axial lines 25*k*, 44*c*5, and 53*d* to the axial line 1*c* of the photosensitive drum 1 are the same, being the distance d4.

As described above, in this embodiment, the couplings 53 and 66 rotate independently from each other. The coupling 66 inputs a rotational force into the photosensitive drum 1, and the coupling 53 directly inputs the rotational force into the development roller 25 through the Oldham's coupling 41. Therefore, not only is the rotation of the development roller 25 not affected by the rotation of the photosensitive drum 1, but also, the development roller 25 can be rotated more accurately. Therefore, it is possible to yield an image which is significantly superior in quality than an image formed by a conventional image forming apparatus.

Further, the engaging portion 44 is positioned relative to the cartridge 7 so that a preset positional relationship is realized between the engaging portion 44 and the cartridge 7, and also, so that the engaging portion 44 is allowed to move in the direction perpendicular to the axial line 25*k* of the development roller 25. Therefore, a large guide or the like, which a conventional image forming apparatus requires to make the coupling 53 and the engaging portion 44 engage with each other is unnecessary, making it possible to eliminate the space for the large guide or the like. Therefore, this embodiment can reduce an image forming apparatus in size, and also, can improve an image forming apparatus in terms of the operation for mounting a process cartridge into the main assembly of the image forming apparatus.

Further, the engaging portion 44 can be kept in the preset position even though the development roller 25 remains separated from the photosensitive drum 1 when the cartridge 7 is mounted. Therefore, the image forming apparatus 100 in this embodiment is superior to a conventional image forming apparatus in terms of the operation for mounting a process cartridge into the main assembly of the image forming apparatus.

Further, the Oldham's coupling 41 is used as the means for transmitting the rotational force from the apparatus main assembly 100*a* to the development roller 25. Therefore, a rotational force can be transmitted to the development roller 25 even when the development roller 25 is not in contact with the photosensitive drum 1. Therefore, it is possible to start rotating the development roller 25 before the development roller 25 is placed in contact with the photosensitive drum 1. Therefore, it is possible to give the toner on the development roller 25 a sufficient amount of triboelectric charge by the development blade 35 before the development roller 25 is placed in contact with the photosensitive drum 1. Therefore, it is possible to prevent the problem that because it is impossible to give the toner on the development roller 25 a sufficient amount of triboelectric charge, the toner is transferred from the photosensitive drum 1 onto the secondary transfer roller 18 (FIG. 1) by way of the intermediary transfer belt 5, and then, soils the back surface of a recording medium (for example, paper).

Therefore, it is possible to prevent the problem that because the toner on the development roller 25 is not sufficiently charged before the development roller 25 is placed in contact with the photosensitive drum 1, the waste toner storage bin of the belt cleaning apparatus 23 has be frequently replaced.

Further, the employment of the Oldham's coupling 41 makes it possible to continue to rotate the development roller 25 even while the development roller 25 is moved from the separation position to the contact position. Therefore, it is possible to place the development roller 25 in contact with the photosensitive drum 1 while rotating both the development roller 25 and the photosensitive drum 1. Therefore, it is possible to minimize the impact to which the photosensitive drum 1 is subjected when the development roller 25 comes into contact with the photosensitive drum 1.

In this embodiment, the Oldham's coupling 41 is used as the means for transmitting a rotational force from the apparatus main assembly 100*a* to the development roller 25. However, the means for transmitting the rotational force from the apparatus main assembly 100*a* to the development roller 25 does not need to be limited to the Oldham's coupling 41. That is, any coupling (for example, a lateral coupling) may be employed, as long as the coupling is capable of sufficiently absorbing (compensating for) the rotational anomalies which occur if the axial line of the coupling on the rotational transmitting side and that on the rotational force receiving side are not in alignment with each other.

As described above, the structure of the cartridge 7 in this embodiment is as follows:

The cartridge 7 comprises the drum unit 26, which supports the photosensitive drum 1.

It has the development roller 25 for developing the electrostatic latent image formed on the photosensitive drum 1. The development roller 25 develops the electrostatic latent image while remaining in contact with the photosensitive drum 1. The development roller 25 is supported by the development unit 4. The development unit 4 is connected to the drum unit 26 in such a manner that it is allowed to rotationally move relative to the drum unit 26.

Further, the cartridge 7 is provided with the drum coupling 1*b* (drum driving force receiving portion) for receiving the rotational force for rotating the photosensitive drum 1, from the drum driving force transmitting coupling 66 (drum rotating force transmitting portion), when the cartridge 7 is in its image forming position in the apparatus main assembly 100*a*.

In terms of the direction indicated by the arrow mark F, in which the cartridge 7 is mounted into the apparatus main assembly 100*a*, the drum coupling 1*b* is at the leading end of the drum unit 26.

Also, the cartridge 7 has the Oldham's coupling 41 (development roller driving force receiving portion) for receiving the rotational force for rotating the development roller 25, from the development roller driving force transmitting coupling 53 (development roller rotating force transmitting portion), when the cartridge 7 is in its image forming position in the apparatus main assembly 100*a*. In terms of the cartridge mounting direction F, the coupling 41 is at the leading end of the development unit 4.

Further, the cartridge 7 has the main assembly contacting first portion (cartridge positioning first portion) 40*a* (having portions 40*a*1 and 40*a*2), which is positioned by the bearing catching portion 82*a* (82*a*1 and 82*a*2) when the cartridge 7 is mounted into the apparatus main assembly 100*a*, and also, remains positioned by the bearing catching portion 82*a* (having portions 82*a*1 and 82*a*2) while the cartridge 7 is in its image forming position in the apparatus main assembly 100*a*. The main assembly contacting portion 40*a* (cartridge positioning portion) is positioned by the bearing catching portion portion 82*a* by being placed in contact with the cartridge contacting portions 82*a* by the pressure (force) applied by the bearing pressing member 83. In terms of the cartridge mounting direction F, the main assembly contacting portion 40*a* (cartridge positioning portion) is at the downstream end of the drum unit 26. The bearing pressing member 83 is a member of the apparatus main assembly 100*a*, which is for keeping pressed, or pushing up, the main assembly contacting portion 40*a* (cartridge positioning portion). Further, the bearing catching portion 82*a* is the cartridge positioning first portion of the apparatus main assembly 100*a*.

The main assembly contacting portion 40*a* (having portions 40*a*1 and 40*a*2) is at one of the lengthwise ends of the photosensitive drum 1. The portions 40*a*1 and 40*a*2 are two portions of the peripheral surface of the drum bearing 40, which will face upward when the cartridge 7 is in its image forming position in the apparatus main assembly 100*a*. They are located close to each other.

Further, the cartridge 7 has the drum bearing 40 (drum shaft bearing first member), which supports one of the lengthwise ends of the photosensitive drum 1. The portions 40*a*1 and 40*a*2 of the main assembly contacting portion 40*a* (cartridge positioning portion) are the two portions of the peripheral surface of the drum bearing 40.

Further, the cartridge 7 has the main assembly contacting portion 50*a* (cartridge positioning portion) (having cartridge positioning third portion 50*a*1 and cartridge positioning fourth portion 50*a*2), that is, the main assembly contacting second portion (cartridge positioning second portions) of the cartridge, which is positioned by the bearing catching portion 92*a* (having portions 92*a*1 and 92*a*2), when the cartridge 7 is mounted into the apparatus main assembly 100*a*, and while the cartridge 7 is in its image forming position in the apparatus main assembly 100*a*. The main assembly contacting portion 50*a* is accurately positioned relative to the bearing catching portions 92*a* by being placed in contact with the bearing pressing portions 92*a* by the pressure applied by the bearing (cartridge) lifting member 93. In terms of the cartridge mounting direction, the main assembly contacting portion 50*a* (having cartridge positioning third portion 50*a*1 and cartridge positioning fourth portion 50*a*2) is on the upstream side of the drum unit 26. The bearing (cartridge) lifting member 93 is the bearing pressing second member of the apparatus main assembly 100*a*. The bearing catching portion 92*a* is the bearing (cartridge) positioning second portion of the apparatus main assembly 100*a*.

The main assembly contacting portion 50*a* (bearing positioning portion) (having cartridge positioning third portion 50*a*1 and cartridge positioning fourth portion 50*a*2) is at the other lengthwise end of the cartridge 7. The main assembly contacting portion 50*a* (cartridge positioning portion) is made up of the cartridge positioning third portion 50*a*1 and cartridge positioning fourth portion 50*a*2 of the peripheral surface of the rear bearing 50 of the photosensitive drum, which face upward when the cartridge 7 is in its image forming portion in the apparatus main assembly 100*a*.

Therefore, in terms of the lengthwise direction of the cartridge 7, one end of the cartridge 7 and the other are positioned relative to the apparatus main assembly 100*a* by coming into contact with the bearing catching portions 82*a* and 92*a*, respectively. Therefore, it is ensured that the cartridge 7 is accurately positioned relative to the apparatus main assembly 100*a* when it is mounted into the apparatus main assembly 100*a*, and also, so that the cartridge 7 remains accurately positioned relative to the apparatus main assembly 100*a* while it is in the apparatus main assembly 100*a*.

The portions 40*a*1 and 40*a*2 of the main assembly contacting portions 40*a* are the two portions of the peripheral surface of the drum bearing 40, which face upward when the cartridge 7 is in its image forming position in the apparatus main assembly 100*a*. The portions 40*a*1 and 40*a*2 are located close to each other. Further, the cartridge positioning third portion 50*a*1 and cartridge positioning fourth portion 50*a*2 of the main assembly contacting portion 50*a* (cartridge positioning portion) are the two portions of the peripheral surface of the drum bearing 50, which face upward when the cartridge 7 is in its image forming position in the apparatus main assembly 100*a*. The cartridge positioning third portion 50*a*1 and cartridge positioning fourth portion 50*a*2 are located close each other.

This structural arrangement also ensures that the cartridge 7 is accurately positioned relative to the apparatus main assembly 100*a* when it is mounted into the apparatus main assembly 100*a*, and also, that the cartridge 7 remains accurately positioned relative to the apparatus main assembly 100*a* while it is in the apparatus main assembly 100*a*.

Further, the cartridge 7 has the drum bearing 50 (photosensitive drum shaft bearing second member), which supports the opposite end from the end supported by the drum bearing 40. The cartridge positioning third portion 50*a*1 and the cartridge positioning fourth portion 50*a*2 of the main assembly contacting portion 50*a* are the two portions of the peripheral surface of the drum bearing 50.

Further, the main assembly contacting portions 40*a* (which has portions 40*a*1 and 40*a*2) is a part of the peripheral surface of the arcuate portion of the drum bearing 40, being therefore arcuate in cross section. It is a preset distance apart from the axial line of the drum bearing 40. The main assembly contacting portion 50*a* (cartridge positioning portion) (which has cartridge positioning third portion 50*a*1 and cartridge positioning fourth portion 50*a*2) is a part of the peripheral surface of the arcuate portion of the drum bearing 50. It is a preset distance apart from the axial line of the drum bearing 50. Therefore, it is ensured that the main assembly contacting portions 40*a* and 50*a* are accurately positioned relative to the bearing catching portions 82*a* and 92*a*, each of which has two slanted surfaces.

As described above, the main assembly contacting portions 40*a* (which has portions 40*a*1 and 40*a*2) is a part of the drum bearing 40, and the main assembly contacting portion 50*a*

(cartridge positioning portion) (which has portions 50*a*1 and 50*a*2) is a part of the drum bearing 50. Therefore, the cartridge 7 is accurately positioned relative to the apparatus main assembly 100*a* so that the photosensitive drum 1 is accurately positioned relative to the apparatus main assembly 100*a*.

Further, the cartridge 7 has the development roller separating member catching portion 31*b* (development roller separating force receiving portion) for receiving from the development roller separating member 111 (development roller separating force applying portion), the pressure (force) for separating the development roller 25 from the photosensitive drum 1. The development roller separating member catching portion 31*b* belongs to the development unit 4.

The roller separating member catching portion 31*b*, which is in the form of a rib, perpendicularly protrudes from the surface of the development unit 4, which faces downward when the cartridge 7 is in its image forming position in the apparatus main assembly 100*a*. It extends in the lengthwise direction of the photosensitive drum 1.

Further, the cartridge 7 has the shaft 27*b*. The shaft 27*b* regulates the rotational movement of the drum unit 26, which rotation is liable to occur as the couplings 41 and 66 receive the rotational force from the apparatus main assembly 100*a*, and also, when the development roller separating member catching portion 31*b* is pressed by the apparatus main assembly 100*a*, by engaging into the cross-sectionally elongated hole 82*b*, while the cartridge 7 is in the image forming position in the apparatus main assembly 100*a*. In terms of the cartridge mounting direction, the shaft 27*b* is at the downstream end of the drum unit 26. The cross-sectionally elongated hole 82*b* is the cartridge rotation regulating first portion of the apparatus main assembly 100*a*, and the shaft 27*b* is the cartridge rotation regulating first portion of the cartridge 7.

In terms of the cartridge mounting direction F, the shaft 27*b* is at the downstream end of the cartridge 7, and projects downstream. Further, when the cartridge 7 is in its image forming position in the apparatus main assembly 100*a*, the shaft 27*b* is in the cross-sectionally elongated hole 82*b*, preventing thereby the drum unit 26 from rotating, by being in contact with the internal surface of the hole 82*b*.

Further, the cartridge 7 has the groove 27*c*, in which the shaft 92*c* fits to prevent the unit 26 from rotating, when the couplings 41 and 66 receive the rotational force from the apparatus main assembly 100*a* while the cartridge 7 is in its image forming position in the apparatus main assembly 100*a*, and also, when the development roller separating member catching portion 31*b* receives pressure from the apparatus main assembly 100*a*. In terms of the cartridge mounting direction, the groove 27*c* is at the upstream (rear) end of the drum unit 26. The groove 27*c* is the drum unit rotation preventing second portion of the cartridge 7, whereas the shaft 92*c* is the drum unit rotation preventing second portion of the apparatus main assembly 100*a*. The coupling 66 is the drum rotating force receiving portion.

The groove 27*c* belongs to the portion of the drum unit 26, which projects downward when the cartridge 7 is in its image forming position in the apparatus main assembly 100*a*. The groove 27*c* is the groove in which the shaft 92*c* of the lateral plate 92 fits when the cartridge 7 is in its image forming position in the apparatus main assembly 100*a*. That is, the drum unit 26 is prevented from rotating, by the contact between the shaft 92*c* of the lateral plate 92 and the internal wall of the groove 27*c*.

In terms of the lengthwise direction of the photosensitive drum 1, the Oldham's coupling 41 (development roller rotating force receiving portion) is on the inward side of the coupling 66 (drum rotating force receiving portion). The Oldham's coupling 41 is attached to the development unit 4 in such a manner that it is allowed to move in the direction perpendicular to the abovementioned lengthwise direction. As the development roller 25 receives the rotational force from the Oldham's coupling 41, the development unit 4 tends to rotate in the counterclockwise direction (indicated by arrow mark B) as seen from the rear of the cartridge 7 in terms of the lengthwise direction of the cartridge 7 (FIG. 2). On the other hand, the development unit 4 and the drum unit 26 are pressured by the resiliency of the spring 38 in the direction to cause the development roller 25 to contact the photosensitive drum 1. In addition, the drum unit 26 is prevented from rotating, by the abovementioned structural arrangement. Therefore, the counterclockwise movement of the development unit 4 is regulated by the resiliency of the spring 38. Therefore, it is ensured that the development roller 25 flawlessly receives the rotational force from the Oldham's coupling 41.

It is a part of the rotational force which the development roller 25 receives from the Oldham's coupling 41 that is transmitted to the toner supply roller 34.

As described above, according to this embodiment, when the cartridge 7 is mounted into, or removed from, the apparatus main assembly 100*a*, the pressure applied to the cartridge 7 by the bearing pressing portion of the pressing member 83 is cancelled by the portion of the bearing pressing member 83, which is located farther from the rotational axis of the bearing pressing member 83 than the bearing pressing portion is. Further, the portions of the surface of the cartridge 7, which directly contact the apparatus main assembly 100*a* when the cartridge 7 is mounted or removed, are rendered different from the cartridge positioning portions of the cartridge 7. In addition, when the cartridge 7 is in its image forming position in the apparatus main assembly 100*a*, the drum unit 26 is kept accurately positioned relative to the apparatus main assembly 100*a* by the cartridge positioning portion and the cartridge rotation regulating portion. Thus, as the development roller separating member catching portion 31*b* is pressed by the development roller separating member 111, the development roller 25 separates from the photosensitive drum 1.

Also in this embodiment, the rotational force for rotating the development roller 25 is transmitted directly from the power source to the development roller 25 by way of the Oldham's coupling 41, that is, independently from the route through which the rotational force is transmitted to the photosensitive drum 1. Further, the engaging portion 44 of the Oldham's coupling 41, which is the engaging portion of the Oldham's coupling located on the main assembly side, is positioned relative to the cartridge 7 so that a preset positional relationship is realized between the engaging portion 44 and cartridge 7.

As described above, in this embodiment, the cartridge 7 is positioned relative to the apparatus main assembly 100*a* by pressing the cartridge 7 upward with the use of the above described structural arrangement. Therefore, the amount of load to which the cartridge 7 is subjected by the bearing pressing members 83 and 93 when the cartridge 7 is mounted into the apparatus main assembly 100*a* is significantly smaller than the amount of load to which a conventional process cartridge is subjected when it is mounted into the main assembly of a conventional image forming apparatus. Therefore, the amount of force necessary to mount the cartridge 7 is significantly smaller than the amount of force necessary to mount a conventional process cartridge.

Further, the main assembly contacting portions 40*a* does not rub against the apparatus main assembly 100*a*. Therefore, the main assembly contacting portions 40*a* is not shaved by the apparatus main assembly 100*a*. Therefore, it is ensured that the cartridge 7 is accurately positioned relative to the apparatus main assembly 100*a* throughout its service life.

Further, the cartridge 7 is provided with two cartridge rotation regulating portions, which are at one of the lengthwise ends of the cartridge 7 and the other, respectively, more specifically, at the rear and front ends of the drum unit 26, respectively. Therefore, it is ensured that the cartridge 7 remains accurately positioned relative to the apparatus main assembly 100*a* when the development roller 25 and the photosensitive drum 1 receive the rotational force from the apparatus main assembly 100*a*, and when the development roller separating member catching portion 31*b* is pressed by the apparatus main assembly 100*a*. Further, it is possible to position the engaging portion 44 relative to the cartridge 7 so that a preset positional relationship is realized between the engaging portion 44 and cartridge 7. Therefore, when the cartridge 7 is in its image forming portion in the apparatus main assembly 100*a*, the engaging portion 44 is smoothly engaged with the rotational force transmitting means, with which the apparatus main assembly 100*a* is provided. Therefore, the cartridge 7 is significantly superior to a conventional process cartridge, in term of the cartridge mounting operation, and can be positioned relative to the apparatus main assembly 100*a* at a higher level of accuracy than the conventional process cartridge can be positioned relative to the main assembly of an image forming apparatus usable therewith, throughout its service life.

[Embodiment 2]

Next, referring to FIG. 26, the structure of the image forming apparatus in the second embodiment of the present invention will be described. The basic structure of the image forming apparatus in this embodiment is the same as that of the image forming apparatus in the first embodiment. The portions of the image forming apparatus in this embodiment, which are similar in structure to the counterparts of the image forming apparatus in the first embodiment will not be described. That is, only the portions of the image forming apparatus in this embodiment, which are different from the counterparts of the image forming apparatus in the first embodiment, will be described. Further, the components of the image forming apparatus in this embodiment, which are the same in function as the counterparts of the image forming apparatus in the first embodiment are given the same reference symbols as those given to their counterparts. This practice will also be applied to the description of the third embodiment of the present invention.

In the first embodiment, the cartridge 7 is provided with a single development roller separating member catching portion 31*b*, which the development roller separating member 111 contacts and presses to separate the development roller 25 from the photosensitive drum 1. Further, the development roller separating member catching portion 31*b* is on the surface of the development unit frame 31 of the development unit 4, which faces downward when the cartridge 7 is in its image forming position in the apparatus main assembly 100*a*. However, the cartridge 7 may be provided with multiple (two in this embodiment: 31*b* and 31*c*) development roller separating member catching portions, which are distributed in the lengthwise direction of the cartridge 7, as shown in FIG. 26, and which the development roller separating members 111 contact and press, one for one, to separate the development roller 25 from the photosensitive drum 1.

Figure 26:
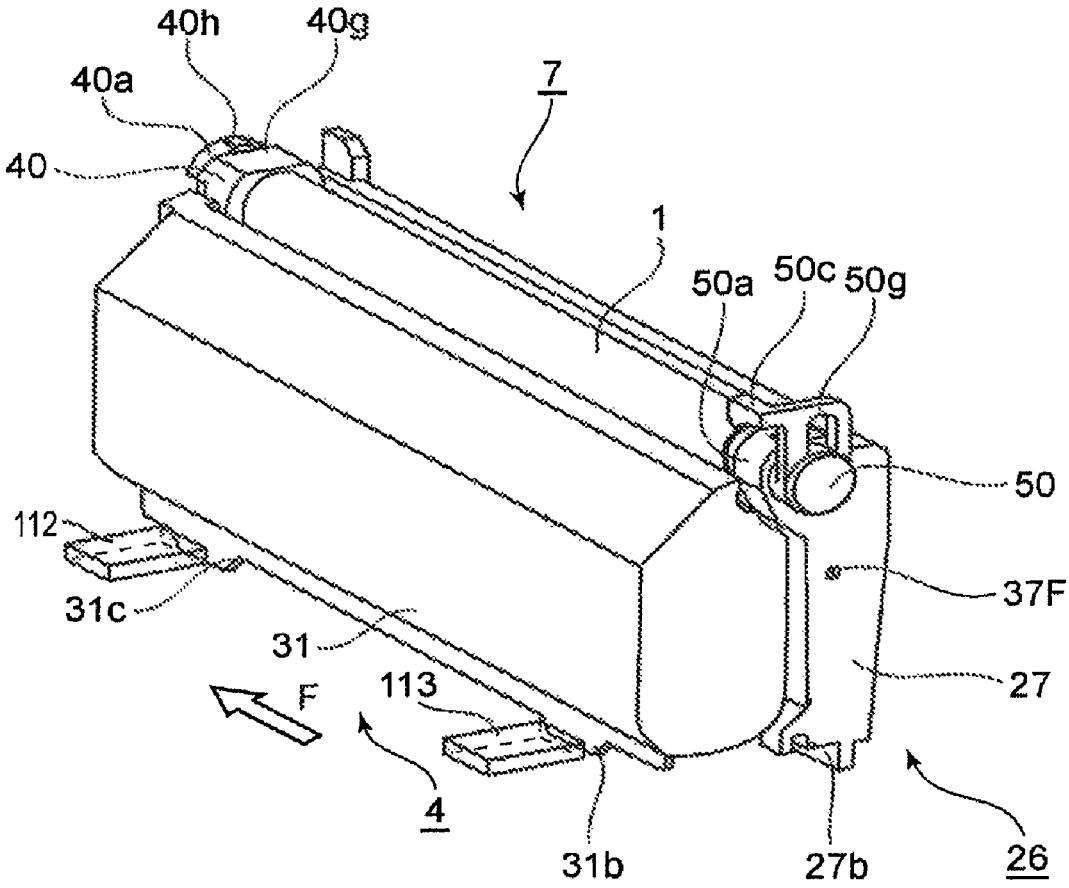
FIG. 26 is an external perspective view of the cartridge in the second embodiment.

FIG. 26 is an external perspective view of the cartridge 7 in this embodiment. The apparatus main assembly 100*a* is provided with a development roller separating first member 112 and a development roller separating second member 113, which are the means for separating the development roller 25 from the photosensitive drum 1. In terms of the direction in which the cartridge 7 is inserted, the development roller separating first member 112 is in a preset position at the front (leading) end of the cartridge 7, and the development roller separating second member 113 is in the preset position at the rear (trailing end). The development roller separating first and second members 112 and 113 are movable between the position in which they contact cartridge 7, that is, the position in which they keep the development roller 25 separated from the photosensitive drum 1, and the positions into which they retreat to maintain a preset amount of distance from the cartridge 7. Further, it is at the same time that the development roller separating member 112 and 113 move into their positions in which they keep the development roller 25 separated from the photosensitive drum 1, or retreat into their positions in which they allow the development roller 25 to remain in contact with the photosensitive drum 1. On the other hand, the cartridge 7 is provided with a development roller separating member caching first portion 31*b* and a development roller separating member catching portion second member 31*c*, which are on the surface of the development unit frame 31, which faces downward when the cartridge 7 is in its image forming position in the apparatus main assembly 100*a*. Further, the development roller separating member catching first and second portions 31*b* and 31*c* are positioned so that when the cartridge 7 is in its image forming position in the apparatus main assembly 100*a*, they oppose the development roller separating first and second members 112 and 113, respectively.

When the apparatus main assembly 100*a* is not in action, the development roller separating member catching first and second portions 31*b* and 31*c* of the development unit 4 remains under the pressure from the development roller separating first member 112 and the pressure from the development roller separating second member 113, respectively. Also when the apparatus main assembly 100*a* is not in action, the shaft 27*b* projecting from one of end surfaces of the drum unit 26 is in the cross-sectionally elongated hole 82*b* of the apparatus main assembly 100*a*, and the shaft 92*c* of the lateral plate 92 of the apparatus main assembly 100*a* is in the groove 27*c* of the same end surface of the drum unit 26. Therefore, the drum unit 26 is prevented from moving in the direction from which the development roller separating member catching first and second portions 31*b* and 31*c* are pressed by the development roller separating first and second members 112 and 113. Therefore, the development unit 4 rotationally moves about the shafts 37 (37R and 37F) (connective pins), by which the development unit 4 is connected with the drum unit 26, causing the development roller 25 to be separated, and remain separated, from the photosensitive drum 1. Therefore, even if the cartridge 7 is left unused for a long time in its image forming position in the apparatus main assembly 100*a*, the elastic layer of the development roller 25 does not deform. Therefore, it does not occur that an image, which is nonuniform in density, and the nonuniformity of which is attributable to the deformation of the elastic layer of the development roller 25, which will occur if a conventional process cartridge is left unused in the apparatus main assembly 100*a* for a long time, is formed. In other words, the second embodiment can also provide the same effects as those provided by the first embodiment.

As will be evident from the description of the second embodiment given above, providing the development unit 4 with multiple development roller separating member catching portions, which are distributed across the development unit 4 in terms of the lengthwise direction of the cartridge 7 is particularly useful for a process cartridge, such as a process cartridge for forming an image on a large sheet of a recording medium, which is substantially longer than an ordinary process cartridge. It is also useful for a process cartridge which is substantially greater in capacity, that is, a process cartridge which is substantially greater in the amount of the pressure which the weight of the development roller 25 applies to the photosensitive drum 1. That is, it can evenly distribute the force to which the development roller separating member catching portions, and the development roller separating force applying member, are subjected. Therefore, it can minimize the deformation of the development roller separating member and development roller separating member catching portion.

[Embodiment 3]

Next, referring to FIG. 27, the structure of the image forming apparatus in the third embodiment will be described. In the first embodiment, the image forming apparatus was structured so that the development roller bearing member 45 is pressed upon the bearing 40 of the photosensitive drum 1. However, it is feasible to provide a drum unit frame 27 with a development roller bearing member supporting portion (bearing member holding portion) as shown in FIG. 27.

Figure 27:
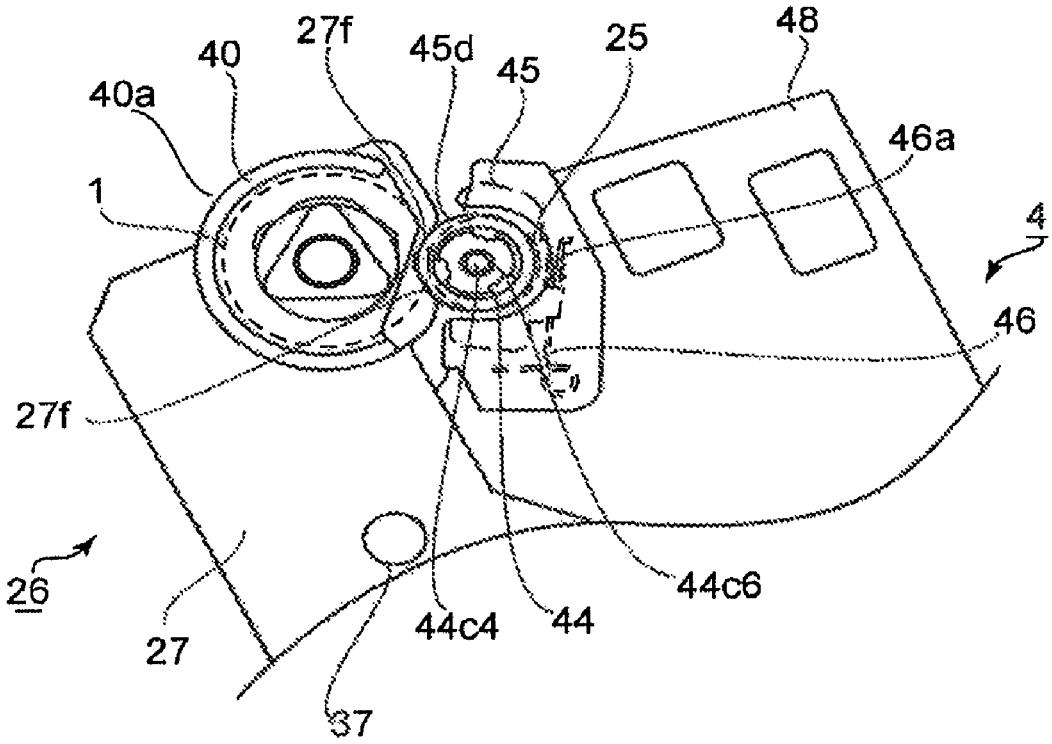
FIG. 27 is a schematic drawing for describing the movement of the couplings of the cartridge in the third embodiment, which occurs when the development roller is separated from the photosensitive drum.

FIG. 27 is a plan view of the lengthwise end of the cartridge 7 in the third embodiment, as seen from the side having the couplers, when the development roller 25 is holding the preset amount of gap from the photosensitive drum 1. The development unit 4 is in its preset position (outlined with broken line in FIG. 27) in which its development roller 25 holds the preset amount of gap from the photosensitive drum 1, and into which it has been moved by the development roller separating member 111 of the apparatus main assembly 100*a*, as it is in the first embodiment. When the development unit 4 is in the above described position, the arm portion 46*a* of the spring 46 (pressure applying member) located inside the side cover 48 is in contact with the engaging portion 45*c* of the coupling bearing 45. Thus, the engaging portion 44 is kept pressed in the direction intersecting the axial line of the development roller 25. Therefore, the contacting portion 45*d* of the coupling bearing 45 comes into contact with the contacting portion 27*f* with which the drum unit frame 27. The contacting portion 27*f* of the drum unit frame 27 is a groove which is V-shaped in cross section; it has two surfaces parallel to the axial line of the photosensitive drum 1. Further, the drum unit frame 27 is provided with the drum bearing 40, which has the main assembly contacting portions 40*a*, which is an integrally formed part of the drum bearing 40. Thus, also in this embodiment, the engaging portion 44, rotatably supported by the coupling bearing 45, is accurately positioned relative to the axial line 53*d* of the coupling 53.

According to each of the preceding embodiments described above, it is ensured that even a process cartridge designed to be positioned relative to the main assembly of an electrophotographic image forming apparatus by being pressed upward in the main assembly is reliably positioned relative to the main assembly.

Also according to each of the preceding embodiments described above, it is possible to improve even a process cartridge designed to be accurately positioned relative to the main assembly of an electrophotographic image forming apparatus by being pressed upward in the main assembly, in terms of the level of accuracy at which it is positioned relative to the main assembly.

Further, according to each of the preceding embodiments described above, a process cartridge can be reliably positioned relative to the main assembly even when it is receiving the rotational force for rotating the development roller and the photosensitive drum from the apparatus main assembly.

Further, according to each of the preceding embodiments described above, a process cartridge can reliably positioned relative to the main assembly even when it is receiving the force for separating the development roller from the photosensitive drum from the apparatus main assembly.

Further, according to each of the preceding embodiments described above, it is ensured that a process cartridge, designed to be accurately positioned relative to the main assembly of an image forming apparatus by being pressed upward in the main assembly, is reliably positioned relative to the main assembly, even when it is receiving the rotational force for rotating the development roller and photosensitive drum from the apparatus main assembly.

Further, according to each of the preceding embodiments described above, it is ensured that a process cartridge, designed to be accurately positioned relative to the main assembly of an image forming apparatus by being pressed upward in the main assembly, is reliably positioned relative to the main assembly even when it is receiving the force for separating the development roller from the photosensitive drum from the apparatus main assembly.

Further, according to each of the preceding embodiments described above, a process cartridge, designed to be accurately positioned relative to the main assembly of an image forming apparatus by being pressed upward in the main assembly, can be accurately positioned relative to the main assembly, even when it is receiving the rotational force for rotating the development roller and photosensitive drum from the apparatus main assembly.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 138045/2008 filed May 27, 2008 which is hereby incorporated by reference.

What is claimed is:

1. A process cartridge detachably mountable to a main assembly of an electrophotographic image forming apparatus, the apparatus including a first main assembly side positioning portion, a second main assembly side positioning portion, a first main assembly side urging member for upward urging, a second main assembly side urging member for upward urging, a first main assembly side regulating portion and a second main assembly side regulating portion, said process cartridge comprising:

an electrophotographic photosensitive drum;

a drum unit supporting said electrophotographic photosensitive drum;

a developing roller for developing an electrostatic latent image formed on said electrophotographic photosensitive drum, said developing roller developing the electrostatic latent image while being in contact with said electrophotographic photosensitive drum;

a developing unit supporting said developing roller and connected with said drum unit;

a first cartridge side portion-to-be-positioned configured to be positioned in a direction crossing with a longitudinal direction of said electrophotographic photosensitive drum by contacting to the first main assembly side positioning portion by an urging force of said the main assembly side urging member when said process cartridge is mounted to the main assembly, said first cartridge side portion-to-be-positioned being provided downstream of said drum unit with respective to a mounting direction in which said process cartridge is mounted to the main assembly;

a first cartridge side portion-to-be-regulated for preventing said first cartridge side portion-to-be-positioned from contacting to the first main assembly side positioning portion by limiting upward movement by contacting to the first main assembly side regulating portion by being urged upwardly by the urging force of the first main assembly side urging member when said process cartridge is being mounted to the main assembly, said first cartridge side portion-to-be-regulated being provided downstream of said drum unit with respect to the mounting direction;

a first recessed surface provided upstream of said first cartridge side portion-to-be-regulated with respect to the mounting direction and having a height smaller than said first cartridge side portion-to-be-regulated, wherein said first recessed surface is spaced from the first main assembly side regulating portion which is out of contact with said first cartridge side portion-to-be-regulated when said first cartridge side portion-to-be-positioned is positioned to the first main assembly side positioning portion;

a second cartridge side portion-to-be-positioned to be positioned in a direction crossing with the longitudinal direction of said electrophotographic photosensitive drum by contacting to the second main assembly side positioning portion by an urging force of the second main assembly side urging member when said process cartridge is mounted to the main assembly, said second cartridge side portion-to-be-positioned being provided upstream of said drum unit with respect to the mounting direction;

a second cartridge side portion-to-be-regulated for preventing said second cartridge side portion-to-be-positioned from contacting to the second main assembly side positioning portion by limiting upward movement by contacting to the second main assembly side regulating portion by being urged upwardly by the urging force of the second main assembly side urging member when said process cartridge is being mounted to the main assembly, said second cartridge side portion-to-be-regulated being provided upstream of said drum unit with respect to the mounting direction; and a second recessed surface provided upstream of said second cartridge side portion-to-be-regulated with respect to the mounting direction and having a height smaller than said second cartridge side portion-to-be-regulated, wherein said second recessed surface is spaced from the second main assembly side regulating portion which is out of contact with said second cartridge side portion-to-be-regulated when said second cartridge side portion-to-be-positioned is positioned to the second main assembly side positioning portion.

2. A process cartridge according to claim 1, further comprising a cartridge longitudinal direction positioning portion for positioning said process cartridge in the longitudinal direction of said electrophotographic photosensitive drum by contacting to a main assembly side longitudinal direction positioning portion provided in the main assembly when said process cartridge is mounted to the main assembly, said cartridge longitudinal direction positioning portion being provided downstream of said drum unit with respect to the mounting direction.

3. A process cartridge according to claim 1, wherein said first cartridge side portion-to-be-positioned is disposed at each of two positions on a surface which takes an upper position at one longitudinal end portion when said process cartridge is mounted to the main assembly, and said first cartridge side portion-to-be-regulated is provided between said positions with respect to a direction perpendicular to the longitudinal direction of said electrophotographic photosensitive drum, and wherein said second cartridge side portion-to-be-positioned is disposed at each of two positions on a surface which takes an upper position at the other longitudinal end portion when said process cartridge is mounted to the main assembly, and said second cartridge side portion-to-be-regulated is provided between said positions with respect to a direction perpendicular to the longitudinal direction of said electrophotographic photosensitive drum.

4. A process cartridge according to claim 1, further comprising a first bearing member supporting one longitudinal end portion of said electrophotographic photosensitive drum, and a second bearing member supporting the other longitudinal end portion of said electrophotographic photosensitive drum, wherein said first cartridge side portion-to-be-positioned and said first cartridge side portion-to-be-regulated are disposed on an outer surface of said first bearing member, and said second cartridge side portion-to-be-positioned and said second cartridge side portion-to-be-regulated are disposed on an outer surface of said second bearing member.

5. A process cartridge according to claim 4, wherein said first bearing member is provided with said first recessed surface, and said second bearing member is provided with said second recessed surface.

6. A process cartridge according to claim 1, wherein said first cartridge side portion-to-be-positioned and said second cartridge side portion-to-be-positioned are convex outwardly.

7. An electrophotographic image forming apparatus for forming an image on a recording material, comprising:

(a) a first main assembly side positioning portion;

(b) a second main assembly side positioning portion;

(c) a first main assembly side urging member for upward urging;

(d) a second main assembly side urging member for upward urging;

(e) a first main assembly side regulating portion;

(f) a second main assembly side regulating portion;

(g) a process cartridge detachably mounted to the main assembly of the electrophotographic image forming apparatus, said process cartridge including:

(i) an electrophotographic photosensitive drum, (ii) a drum unit supporting said electrophotographic photosensitive drum, (iii) a developing roller for developing an electrostatic latent image formed on said electrophotographic photosensitive drum, said developing roller developing the electrostatic latent image while being in contact with said electrophotographic photosensitive drum, (iv) a developing unit supporting said developing roller and connected with said drum unit, (v) a first cartridge side portion-to-be-positioned configured to be positioned in a direction crossing with a longitudinal direction of said electrophotographic photosensitive drum by contacting to said first main assembly side positioning portion by an urging force of said first main assembly side urging member when said process cartridge is mounted to the main assembly, said first cartridge a portion-to-be-positioned being provided downstream of said drum unit with respective to a mounting direction in which said process cartridge is mounted to the main assembly, (vi) a first cartridge side portion-to-be-regulated for preventing said first cartridge side portion-to-be-positioned from contacting to said first main assembly side positioning portion by limiting upward movement by contacting to said first main assembly side regulating portion by being urged upwardly by the urging force of said first main assembly side urging member when said process cartridge is being mounted to said main assembly, said first cartridge side portion-to-be-regulated being provided downstream of said drum unit with respect to the mounting direction, (vii) a first recessed surface provided upstream of said first cartridge side portion-to-be-regulated with respect to the mounting direction and having a height smaller than said first cartridge side portion-to-be-regulated, wherein said first recessed surface is spaced from said first main assembly side regulating portion which is out of contact with said first cartridge side portion-to-be-regulated when said first cartridge side portion-to-be-positioned is positioned to said first main assembly side positioning portion;

(viii) a second cartridge portion-to-be-positioned to be positioned in a direction crossing with the longitudinal direction of said electrophotographic photosensitive drum by contacting to said second main assembly side positioning portion by urging force of said second main assembly side urging member when said process cartridge is mounted to said main assembly, said second cartridge side portion-to-be-positioned being provided upstream of said drum unit with respect to the mounting direction, (ix) a second cartridge side portion-to-be-regulated for preventing said second cartridge side portion-to-be-positioned from contacting to said second main assembly side positioning portion by limiting upward movement by contacting to said second main assembly side regulating portion by being urged upwardly by the urging force of the second main assembly side urging member when said process cartridge is being mounted to the main assembly, said second cartridge side portion-to-be-regulated being provided upstream of said drum unit with respect to the mounting direction, and (x) a second recessed surface provided upstream of said second cartridge side portion-to-be-regulated with respect to the mounting direction and having a height smaller than said second cartridge side portion-to-be-regulated, wherein said second recessed surface is spaced from said second main assembly side regulating portion which is out of contact to said second cartridge side portion-to-be-regulated when said second cartridge side portion-to-be-positioned is positioned to said second main assembly side positioning portion; and (h) feeding means for feeding the recording material.

8. An apparatus according to claim 7, further comprising a cartridge longitudinal direction positioning portion for positioning said process cartridge in the longitudinal direction of said electrophotographic photosensitive drum by contacting to a main assembly side longitudinal direction positioning portion provided in said main assembly when said process cartridge is mounted to said main assembly, said cartridge longitudinal direction positioning portion being provided downstream of said drum unit with respect to the mounting direction.

9. An apparatus according to claim 7, wherein said first cartridge side portion-to-be-positioned is disposed at each of two positions on a surface which takes an upper position at one longitudinal end portion when said process cartridge is mounted to said main assembly, and said first cartridge side portion-to-be-regulated is provided between said positions with respect to a direction perpendicular to the longitudinal direction of said electrophotographic photosensitive drum, and wherein said second cartridge side portion-to-be-positioned is disposed at each of two positions on a surface which takes an upper position at the other longitudinal end portion when said process cartridge is mounted to the main assembly, and said second cartridge side portion-to-be-regulated is provided between said positions with respect to a direction perpendicular to the longitudinal direction of said electrophotographic photosensitive drum.

10. An apparatus according to claim 7, further comprising a first bearing member supporting one longitudinal end portion of said electrophotographic photosensitive drum, and a second bearing member supporting the other longitudinal end portion of said electrophotographic photosensitive drum, wherein said first cartridge side portion-to-be-positioned and said first cartridge side portion-to-be-regulated are disposed on an outer surface of said first bearing member, and said second cartridge side portion-to-be-positioned and said second cartridge side portion-to-be-regulated are disposed on an outer surface of said second bearing member.

11. An apparatus according to claim 10, wherein said first bearing member is provided with said first recessed surface, and said second bearing member is provided with said second recessed surface.

12. An apparatus according to claim 7, wherein said first cartridge side portion-to-be-positioned and said second cartridge side portion-to-be-positioned are convex outwardly.

13. A cartridge detachably mountable to a main assembly of an image forming apparatus, said main assembly including a main assembly side positioning portion, a main assembly side urging member for applying an upward urging force, and a main assembly side regulating portion, said cartridge comprising:

a cartridge side portion to be positioned for being positioned in a direction crossing a longitudinal direction of said cartridge by contacting the main assembly side positioning portion by the urging force of the main assembly side urging member when said cartridge is mounted to the main assembly;

a cartridge side portion to be regulated for being regulated in a upward movement by contacting the main assembly side regulating portion by being urged upwardly by the urging force of the main assembly side urging member, thus preventing contact of said cartridge side portion to be positioned to the main assembly side positioning portion in the process of mounting said cartridge to the main assembly; and a recess provided upstream of said cartridge side portion to be regulated with respect to the mounting direction and which is recessed beyond said cartridge side portion to be regulated, wherein when said cartridge side portion to be positioned is positioned to the main assembly side positioning portion, said recess is out of contact with the main assembly side regulating portion which is out of contact with said cartridge side portion to be regulated.

14. An image forming apparatus for forming an image on a recording material, comprising:

(a) main assembly side positioning portion;

(b) a main assembly side urging member for applying an upward urging force;

(c) a main assembly side regulating portion;

(d) a cartridge detachably mounted to said main assembly of the image forming apparatus, said cartridge including:

(i) a cartridge side portion to be positioned for being positioned in a direction crossing a longitudinal direction of said cartridge by contacting the main assembly side positioning portion by the urging force of the main assembly side urging member when said cartridge is mounted to the main assembly, (ii) a cartridge side portion to be regulated for being regulated in a upward movement by contacting the main assembly side regulating portion by being urged upwardly by the urging force of the main assembly side urging member, thus preventing contact of said cartridge side portion to be positioned to the main assembly side positioning portion in the process of mounting said cartridge to the main assembly, and (iii) a recess provided upstream of said cartridge side portion to be regulated with respect to the mounting direction and which is recessed beyond said cartridge side portion to be regulated, wherein when said cartridge side portion to be positioned is positioned to the main assembly side positioning portion, said recess is out of contact with the main assembly side regulating portion which is out of contact with said cartridge side portion to be regulated; and (e) feeding means for feeding the recording material.

* * * * *